US005471006A

United States Patent [19]

Schwartz et al.

[11] Patent Number: 5,471,006

[45] Date of Patent: Nov. 28, 1995

[54] ELECTRONIC CARILLON SYSTEM AND SEQUENCER MODULE THEREFOR

[75] Inventors: Gregory L. Schwartz, Spinnerstown; Karl Frick, Richlandtown, both of Pa.

[73] Assignee: Schulmerich Carillons, Inc., Sellersville, Pa.

[21] Appl. No.: 992,832

[22] Filed: Dec. 18, 1992

[51] Int. Cl.[6] ..... G10H 7/00

[52] U.S. Cl. ..... 84/609; 368/273

[58] Field of Search ..... 84/609, 611, 614; 368/272, 273

[56] References Cited

U.S. PATENT DOCUMENTS

| | | | |
|---|---|---|---|
| 4,159,491 | 6/1979 | Beach | 84/62 X |
| 4,245,336 | 1/1981 | Stietenroth | 84/604 X |
| 4,271,495 | 6/1981 | Scherzinger et al. | 84/609 X |
| 4,368,989 | 1/1983 | Kawashima | 84/609 X |
| 4,385,841 | 5/1983 | Kramer . | |
| 4,805,511 | 2/1989 | Schwartz . | |
| 5,092,216 | 3/1992 | Wadhams | 84/602 |
| 5,195,064 | 3/1993 | Hegarty et al. | 368/272 |
| 5,296,642 | 3/1994 | Konishi | 84/609 |

*Primary Examiner*—William M. Shoop, Jr.

*Assistant Examiner*—Jeffrey W. Donels

*Attorney, Agent, or Firm*—Woodcock, Washburn, Kurtz, Mackiewicz & Norris

[57] ABSTRACT

An electronic carillon system comprising a sequencer module (10) programmed for receiving, storing and outputting timing data and sequence data representing a prescribed number of distinct bell strikes, a tone generator (12) for generating, in accordance with sequence and timing data, analog bell-strike signals, amplifiers (18, 20) for amplifying the bell-strike signals, and speakers (22, 24) for converting the bell-strike signals, after amplification, to audible bell sounds. The sequencer module comprises a clock for generating clock signals indicative of the time of day; program memory for memorizing defined program points representing intervals of time during which an event is to occur; music sequencer hardware and software for reading musical selections composed of pre-defined arrangements of the bell strikes from an electronic memory card and memorizing the selections; user-interface hardware and software for programmatically displaying information to and receiving information from a user; and review hardware and software for displaying previously-entered program points in response to inputs received via the user-interface. The system may employ synthesis techniques or digital sampling and reproduction.

23 Claims, 38 Drawing Sheets

| SPECIAL PROGRAM DATA FORMAT | |
|---|---|
| BYTE 1 | MSB=0 : PLAY SPECIAL ONLY |
| BYTE 1 | MSB=1 : PLAY SPECIAL ALSO |
| BYTE 1 | 5 LSB'S : MONTH DATA |
| BYTE 2 | 6 LSB'S : DATE DATA |
| BYTE 3 | 2 MSB'S : LIBRARY DATA |
| BYTE 3 | BIT D5 : AM/PM DATA |
| BYTE 3 | 5 LSB'S : HOUR DATA |
| BYTE 4 | 7 LSB'S : MINUTE DATA |
| BYTE 5 | FUNCTIONS TO PLAY |

SPECIAL PROGRAM INFORMATION IS STORED IN A 512 BYTE AREA OF RAM CALLED SPECIALS. MAXIMUM STORAGE IS 512/5 = 102 PROGRAM POINTS.

| NORMAL PROGRAM DATA FORMAT | |
|---|---|
| BYTE 1 | 2 MSB'S : LIBRARY DATA |
| BYTE 1 | BIT D5 : AM/PM DATA |
| BYTE 1 | 5 LSB'S : HOUR DATA |
| BYTE 2 | 7 LSB'S : MINUTE DATA |
| BYTE 3 | FUNCTIONS TO PLAY |

NORMAL PROGRAM INFORMATION IS STORED IN 7 SPECIFIC 512-BYTE AREAS OF RAM CALL DAY1 THRU DAY7. MAXIMUM STORAGE PER DAY IS 512/3 = 171 PROGRAM POINTS.

SOFTWARE MACRO : SCROLLIN

DISPLAY A MESSAGE REPRESENTING AN OPTION CHOICE. WAIT FOR OPERATOR INPUT. IF INPUT IS ENTER, USE DISPLAYED OPTION. IF INPUT IS SCROLL, EXIT MACRO, USUALLY TO NEXT CHOICE. THE CLEAR KEY WILL FORCE THE PROGRAM FLOW TO ENTER AUTOMATIC MODE FROM WITHIN THE WAIT4KEY CALL. ANY OTHER INPUT WILL BE DISREGARDED.

FLOW CHART REPRESENTATION:

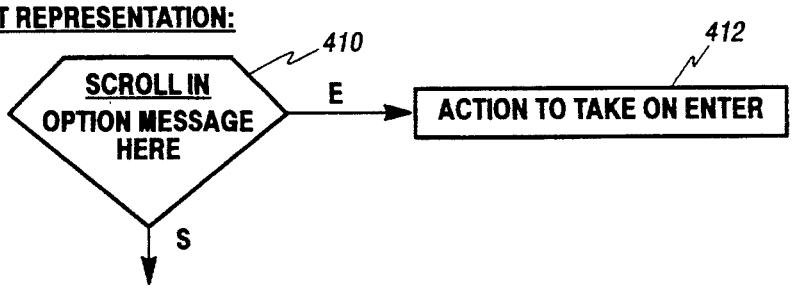

*Figure 10A*

SOFTWARE IMPLEMENTATION:

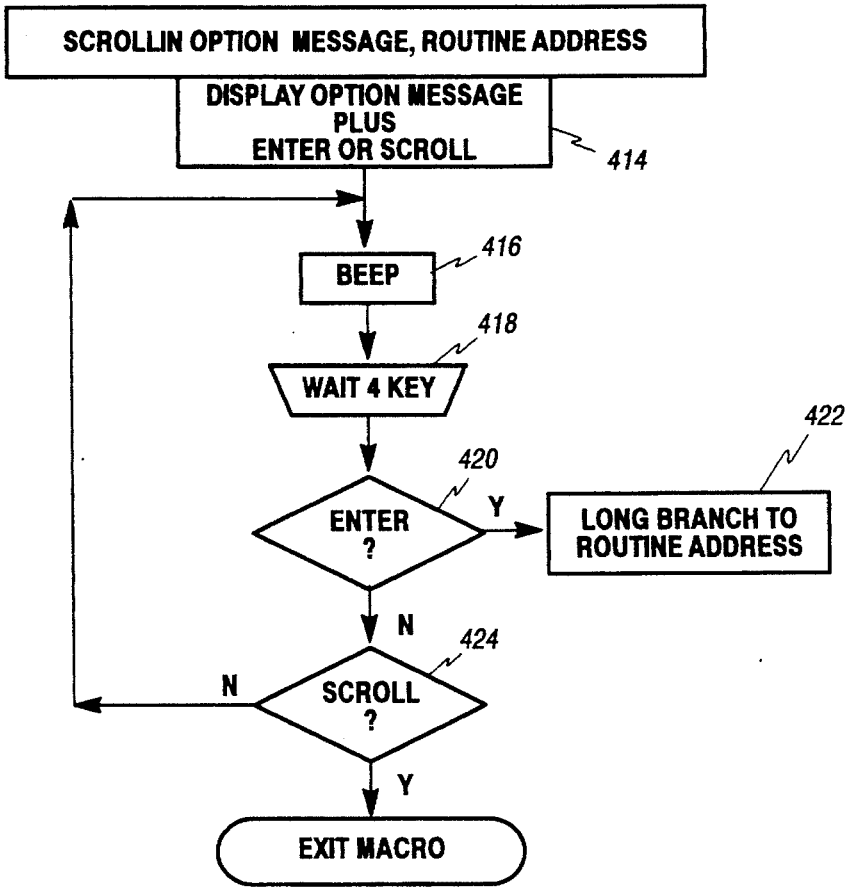

*Figure 10B*

ELECTRONIC CARILLON SYSTEM AND SEQUENCER MODULE THEREFOR

FIELD OF THE INVENTION

The present invention generally relates to electronic carillons and more particularly relates to a sequencer module of an electronic carillon system for programmatically reading, storing and outputting timing and sequence data for use in reproducing or simulating bell sounds.

BACKGROUND OF THE INVENTION

An electronic carillon system is a system which synthesizes or reproduces (when sampling is employed) the sounds of a set of bells. With the proper hardware modules, such a system is capable of imitating (i.e., synthesizing or reproducing) the sound of a single bell strike, a single swinging bell, a number of bells swinging in or out of sync with one another, and even musical compositions. Electronic carillon systems are most often found in churches, but they also can be advantageously employed in government buildings, universities, department stores, etc. Typical applications include announcing the time of day and playing music. Prior art electronic carillon systems comprise a variety of separate hardware modules, where each module is hard-wired to perform one specific function. One major disadvantage of such a system is that it is very difficult to add new functionality to a given hardware module. Another major disadvantage is that a separate module must be provided for each function, which adds to the cost of the system. A further disadvantage of prior art electronic carillon systems is that they employ magnetic tape drives that contain moving parts and thus wear out and become unreliable over time. Further background on the present invention can be found in commonly assigned U.S. Pat. No. 4,805,511 (Schwartz), titled *Electronic Bell-Tone Generating System*, which issued Feb. 21, 1989 and which is hereby incorporated by reference into this specification.

SUMMARY OF THE INVENTION

Accordingly, a primary object of the present invention is to provide an electronic carillon system that is easy to program, integrates a variety of functions into one unit, has no moving parts (which contributes to reliability) and is highly flexible in terms of the types of bell sounds it is capable of synthesizing or reproducing. The present invention meets these goals.

An electronic carillon system in accordance with the present invention comprises sequencer means for programmatically receiving, storing and outputting timing data and sequence data representing a prescribed number of distinct bell strikes. Each bell strike is composed of a unique combination of bell tones defining a particular musical note of a corresponding bell voice. The sequencer means comprises program memory means for memorizing user-defined program points representing intervals of time during which an event is to occur; music sequencer means for reading musical selections composed of pre-defined arrangements of the bell strikes from an electronic memory card and memorizing the selections; user-interface means for programmatically displaying information to and receiving information from a user; review means for displaying previously-entered program points in response to inputs received via the user-interface means; and program code means for controlling the operation of the music sequencer means, user-interface means and review means.

Preferred embodiments of the present invention further comprise tone generator means for generating, in accordance with sequence and timing data provided by the sequencer means, analog bell-strike signals representative of both individual bell strikes and/or a selected combination of bell strikes; amplifier means for amplifying the bell-strike signals; and speaker means coupled to the amplifier means for converting the bell-strike signals, after amplification, to audible bell sounds.

Preferred embodiments of the invention may also advantageously comprise volume control means for receiving volume control information from a user and outputting the same to the tone generator means and/or lock switch means for selectively preventing the sequencer means from performing at least one pre-defined set of functions.

Specific embodiments of the invention may comprise means for automatically generating, at selected intervals within a selected block of time during a prescribed set of days, a sequence of bell strikes indicative of the time of day followed by sequence and timing data representing a musical arrangement.

Embodiments of the invention may also comprise means for automatically generating, at selected intervals during a prescribed set of days, sequence and timing data representing the swinging of a selected combination of bells for a selected length of time.

In addition, embodiments of the invention may comprise means for automatically generating, at selected intervals during a prescribed day, sequence and timing data representing the swinging of a selected combination of bells for a selected length of time.

Embodiments of the invention may also comprise means for automatically generating, at selected intervals during a prescribed set of days, sequence and timing data representing the tolling of one selected bell for a selected length of time.

In addition, embodiments of the invention may comprise means for automatically generating sequence and timing data representing an Angelus followed by a selected prayer comprising one of: a pre-defined number of bell tolls, a single bell swing, and a multi-bell peal.

Embodiments of the invention may also comprise means for manually initiating the generation of sequence and timing data representing the tolling of a single bell a selected number of times and means for manually initiating the generation of sequence and timing data representing the tolling of a selected combination of bells until stopped by a user.

Embodiments of the invention may also comprise means for manually initiating the generation of sequence and timing data representing the swinging of a selected combination of bells until stopped by a user.

Embodiments of the invention may also comprise remote control means for displaying information to and receiving information from a user at a remote location.

Other embodiments of the present invention include a recording medium (e.g., magnetic disk, magnetic tape, an integrated circuit memory device) bearing signals representing computer software for controlling the operation of an electronic carillon system. The program code includes instructions for controlling the system in performing the functions of memorizing user-defined program points representing intervals of time during which an event is to occur, reading and memorizing a pre-recorded musical arrangement from a storage medium, and controlling the operation of the system in accordance with previously-entered program points to automatically generate a sequence of bell strikes indicative of the time of day followed by sequence and timing data representing the musical arrangement.

The present invention also encompasses methods for operating an electronic carillon system. Methods in accordance with the invention comprise the steps of reading and memorizing user-defined program points representing intervals of time during which an event is to occur, reading a pre-recorded musical arrangement from a storage medium and memorizing the arrangement, and automatically generating, in accordance with previously-entered program points, a sequence of bell strikes indicative of the time of day followed by sequence and timing data representing the musical arrangement.

Other features of the invention are described below.

BRIEF DESCRIPTION OF THE DRAWINGS

FIG. 10A depicts the symbol used in the drawings to represent a ScrollIn macro and FIG. 10B is a flowchart of the ScrollIn macro.

DETAILED DESCRIPTION OF PREFERRED EMBODIMENTS

Figure 1A:
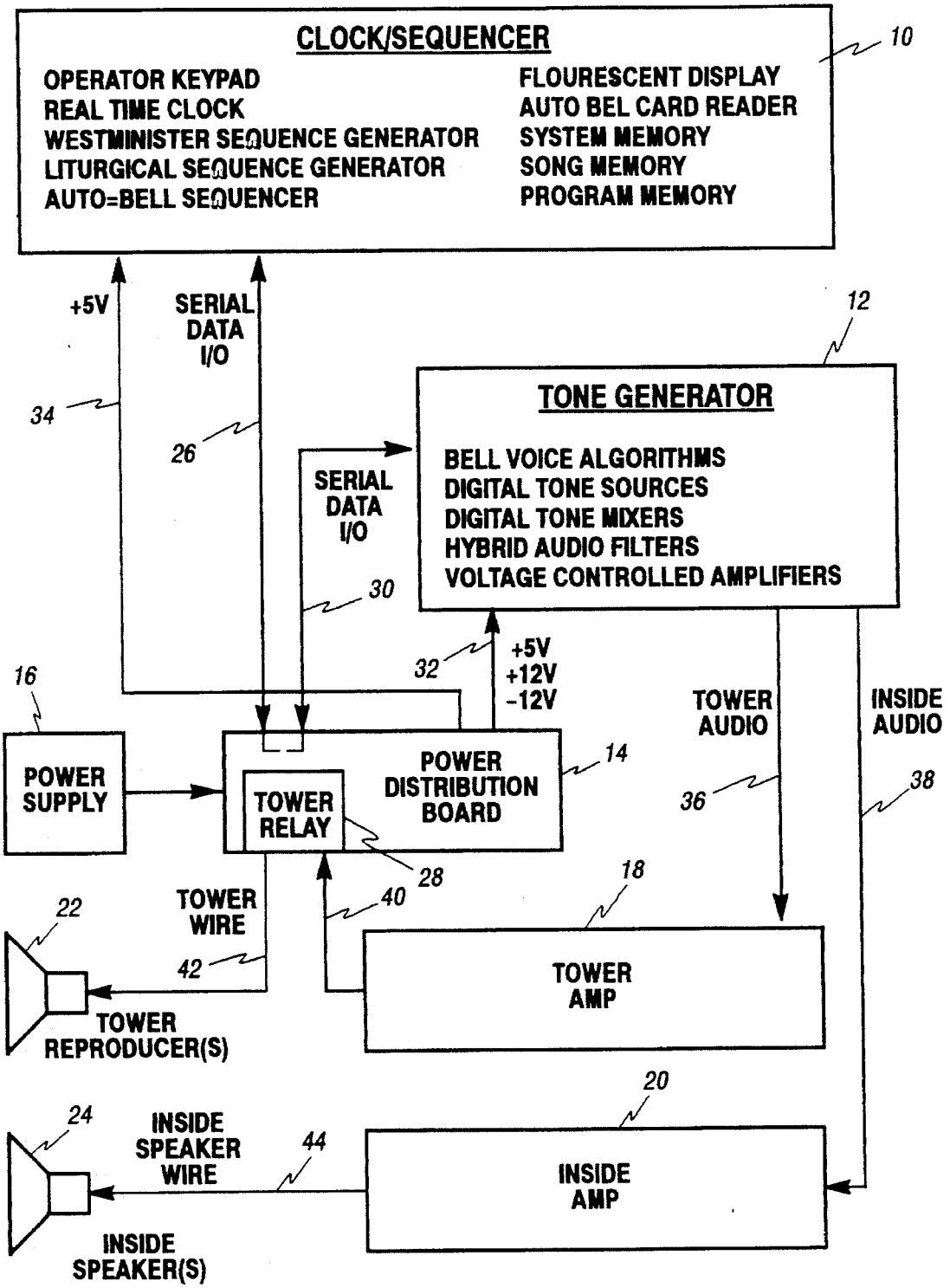
FIG. 1A is a block diagram of an electronic carillon system in accordance with the present invention.

FIG. 1A is a block diagram of an electronic carillon system in accordance with the present invention. This system comprises: a clock/sequencer module 10; a tone generator module 12; a power distribution board 14; a power supply 16; a first amplifier 18, referred to as a tower amp; a second amplifier 20, referred to as an inside amp; a tower reproducer, or speaker, 22; and an inside reproducer (speaker) 24. The clock/sequencer module 10 is coupled via a serial data bus 26 to a relay 28 on the power distribution board 14. The relay 28 is further coupled via a serial data bus 30 to the tone generator module 12. Power from the power supply module 16 is provided through the power distribution board 14 to the tone generator module 12 via a first power bus 32 and to the clock/sequencer module 10 via a second power bus 34. The dashed line in block 14 indicates a common connection between serial buses 26 and 30.

The relay 28 performs two functions, each of which is directly related to the tower reproducer(s) 22. First, the relay 28, in the energized position, connects the output of the tower amp 18 to the tower wire 42, thus delivering the amplified audio to the tower reproducer(s) 22. Control voltage for the relay 28 originates in the tone generator 12 and passes through the first power bus 32 to the power distribution board 14. In this way, there is little possibility of audio being sent to the tower at the wrong time. The second function of the relay 28 is to connect the tower wire 42 to appropriate lightning protection circuitry (not shown) when the relay 28 is in the relaxed position.

The following table shows one preferred format (communication standard) for the serial data sent by the sequencer 10 to the other modules (e.g., the tone generator module 12). The meaning of the parameters will be clear after a reading of the remainder of this specification.

SERIAL DATA FORMAT 1. 0XXX, XXXX = NOTE = 1 → $126_{(dec)}$ = (01 → 7E)$_{hex}$
2. 1XXX, XXXX = DELAY BYTE - 1 → $127_{(dec)}$ = (01 → 7F)$_{(hex)}$
3. [7F] = SYSTEM STATUS MESSAGE . . . READ NEXT BYTE(S) . . .
   - 3a. [70] = UPPER STOPS FOLLOW . . . READ NEXT BYTE . . .
     - 3a1. [00] = CANCEL UPPER STOPS
     - 3a2. [01] = CAST BELL UPPER STOP
     - 3a3. [02] = ENGUSH BELL UPPER STOP
     - 3a4. [03] = TEMBREL BELL UPPER STOP
     - 3a5. [04] = CHIME BELL UPPER STOP
     - 3a6. [05] = HARP BELL UPPER STOP
     - 3a7. [06] = CELESTE BELL UPPER STOP
   - 3b. [71] = LOWER STOPS FOLLOW . . . READ NEXT BYTE . . .
     - 3b1. [00] = CANCEL LOWER STOPS
     - 3b2. [01] = CAST BELL LOWER STOP
     - 3b3. [02] = ENGUSH BELL LOWER STOP
     - 3b4. [03] = TEMBREL BELL LOWER STOP
     - 3b5. [04] = CHIME BELL LOWER STOP
     - 3b6. [05] = HARP BELL LOWER STOP
     - 3b7. [06] = CELESTE BELL LOWER STOP
   - 3c. [72] = DECAY DATA FOLLOWS . . . READ NEXT BYTE . . .
     - 3c1. [9D . . . 61 . . . 25]$_{(hex)}$ = 30 Hz . . . 60 Hz . . . 120 Hz
   - 3d. [73] = INSIDE VOLUME FOLLOWS . . . READ NEXT BYTE . . .
     - 3d1. [00 . . . 32 . . . 64]$_{(hex)}$ = 0% . . . 50% . . . 100%
   - 3e. [74] = TOE STUD DATA FOLLOWS . . . READ NEXT BYTE . . .
     - 3e1.

| d7 | d6 | d5 | d4 | d3 | d2 | d1 | d0 | |
|---|---|---|---|---|---|---|---|---|
| 0 | 0 | 0 | 0 | 0 | 0 | 0 | X | UPPER VAK (0 = OFF, 1 = ON) |
| 0 | 0 | 0 | 0 | 0 | 0 | X | 0 | LOWER VAK (0 = OFF, 1 = ON) |
| 0 | 0 | 0 | 0 | 0 | X | 0 | 0 | DECADENCE (0 = OFF, 1 = ON) |

Note: all 3 codes may be set or reset in the same byte.

- 3f. [75] = KEYSWITCH STATUS DATA FOLLOWS . . . READ NEXT BYTE . . .
     - 3f1. [0XXX, XXXX] = KEYSWITCH OFF (XXX, XXXX = DEVICE ADDR.)
       [1XXX, XXXX] = KEYSWITCH ON (XXX, XXXX = DEVICE ADDR.)
   - 3g. [76] = TRANSPOSE DATA FOLLOWS . . . READ NEXT BYTE . . .
     - 3g1. [01 . . . 07 . . . 0C]$_{(hex)}$ = −6 . . . NORM . . . +6
   - 3h. [77] = DETUNE DATA FOLLOWS . . . READ NEXT BYTE . . .
     - 3h1. [01 . . . 06 . . . 0B]$_{(hex)}$ = A435 . . . A440 . . . A445
   - 3i. [78] = DEVICE STATUS REQUEST (no following byte)
   - 3j. [79] = DEVICE RESET (no following byte)
   - 3k. [7A] = TOWER VOLUME DATA FOLLOWS . . . READ NEXT BYTE . . .
     - 3k1. [00 . . . 32 . . . 64]$_{(hex)}$ = 0% . . . 50% . . . 100%
   - 3l. [7B] = TOWER RELAY ON/OFF DATA FOLLOWS . . . READ NEXT BYTE . . .
     - 3l1. [00] = TOWER OFF [01] = TOWER ON
   - 3m. [7C] RESERVED
   - 3n. [7D] RESERVED
   - 3p. [7E] RESERVED
   - 3q. [60] = LOCKSWITCH STATUS REQUEST (no following byte)
   - 3r. [61] RESERVED
   - 3s. [62] RESERVED
   - 3t. [68] RESERVED
   - 3u. [6A] = REMOTE FUNCTION START . . . READ NEXT BYTE . . .
     - 3u1. [00] = ALL STOP
     - 3u2 [01,02,04,08,10,20,40,80]$_{(hex)}$ = FUNCTION 1 through 8 START
     - 3u3 [88] = CLOCK BUSY
     - 3u4. [BB] = SWINGING FUNCTION STOP (blinks remote LED)
   - 3v. [6B] = REMOTE/KBD INSIDE SPKR. ON/OFF . . . READ NEXT BYTE . . .
     - 3v1. [00] = INSIDE OFF [01] = INSIDE ON
   - 3w. [AA] = STATUS O.K. RETURNED AS REQUEST FOR [7F,78]
   - 3x [91] = FILTER TEST REQUEST . . . READ NEXT BYTE . . .
     - 3x1. [01 . . . 08] = TURN ON FILTER TEST, OCTAVES [1 . . . 8]
     - 3x2. [00] = TURN OFF ANY FILTERS WHICH ARE ON
   - 3y. [92] = CAC PARTIAL TEST . . . READ NEXT BYTE . . .
     - 3y1. [00] = ALL PARTIALS OFF.
     - 3y2. [01 →→→ 60]$_{(hex)}$ = PARTIALS #1 →→ #96$_{(dec)}$ TURN ON.

(Note that the delay byte (no. 2 in the above list) tells the system (e.g., the sequencer) how long to wait before playing the next note. This is a data compression technique.)

Output signals of the tone generator module 12 are provided to the tower amp 18 and inside amp 20 via audio buses and 38, respectively. Amplified tower audio signals are provided by tower amp 18 to the power distribution board 14 via an audio wire 40. This signal is in turn provided via an audio wire 42 to the tower reproducer 22. In addition, inside audio signals are provided via audio wire 38 to inside amp 20; these signals are amplified by inside amp 20 and provided over inside speaker wire 44 to inside speaker 24.

The clock/sequencer module 10 (or sequencer module) is the main control module for the system. This module contains means for storing Westminster and all Liturgical bell sequences and generating control signals for reproducing (playing) these sequences. The sequencer module also includes song memory, a forty-character vacuum fluorescent display module, an operator keypad, a system lockswitch, an electronic card reader, and a real-time clock. Sequence data is transmitted over the serial data bus 26 to the tone generator module. Timing signals are also generated by the sequencer module 10. The sequence and timing data is generated with software algorithms (referred to as routines or procedures), which are described below in sufficient detail to enable a skilled programmer to practice the invention. Sequence variable parameters (described below) may be modified and stored in on-board random access memory (RAM). Sequences may be programmed to play at any time. The sequencer module 10 may be programmed through the keypad in accordance with messages generated by user-interface components of the software and displayed on the vacuum display (not shown).

Figure 1B:
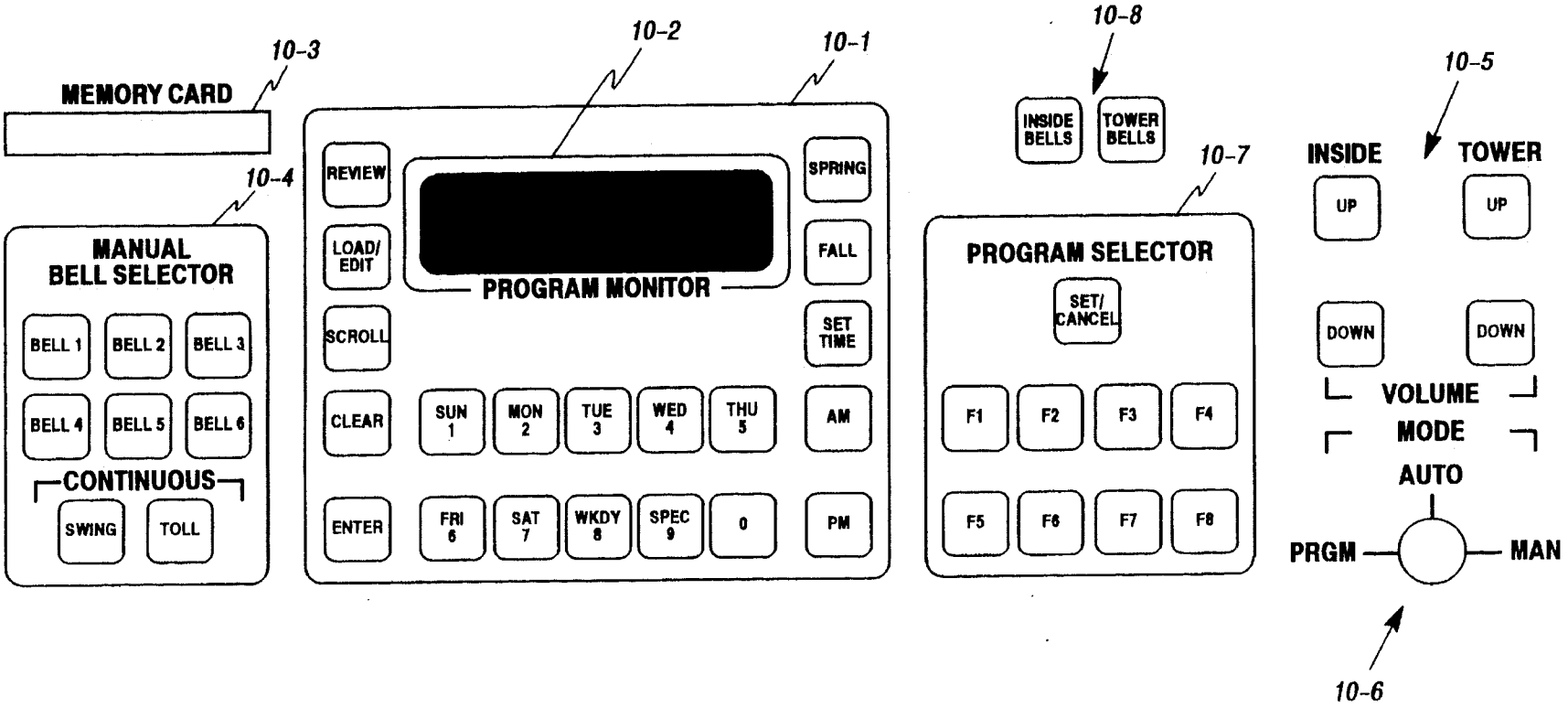
FIG. 1B depicts the front panel of the sequencer 10 of FIG. 1A.

FIG. 1B depicts an exemplary configuration of the front panel of the sequencer module 10. The panel includes a main keypanel section 10-1, display (program monitor) 10-2, memory card slot 10-3, manual bell control keys 10-4, volume controls 10-5, lockswitch 10-6, program selector (function keys) 10-7, and inside/tower bells selection keys 10-8. The functionality of these elements is described below in connection with the description of the software.

The tone generator module 12 contains the hardware and software necessary to create realistic bell tones in accordance with sequence data provided by the clock/sequencer module 10 or as requested by a user via the keypad. In preferred embodiments of the invention, information describing the harmonic content of six distinct bell voices is passed to a series of digital-to-analog convertors (DACs). The outputs of these DACs are summed, filtered, summed again, and passed through two voltage-controlled amplifiers to the tower amp 18 and/or the inside amp 20. The tone generator module 12 of the presently preferred embodiments of the invention is an enhanced version of the system described in U.S. Pat. No. 4,805,511, issued Feb. 21, 1989. However, any known tone generating system conforming to the above-described communication standard may be employed. Moreover, the present invention may also be practiced by employing digital sampling instead of synthesis.

Figure 2:
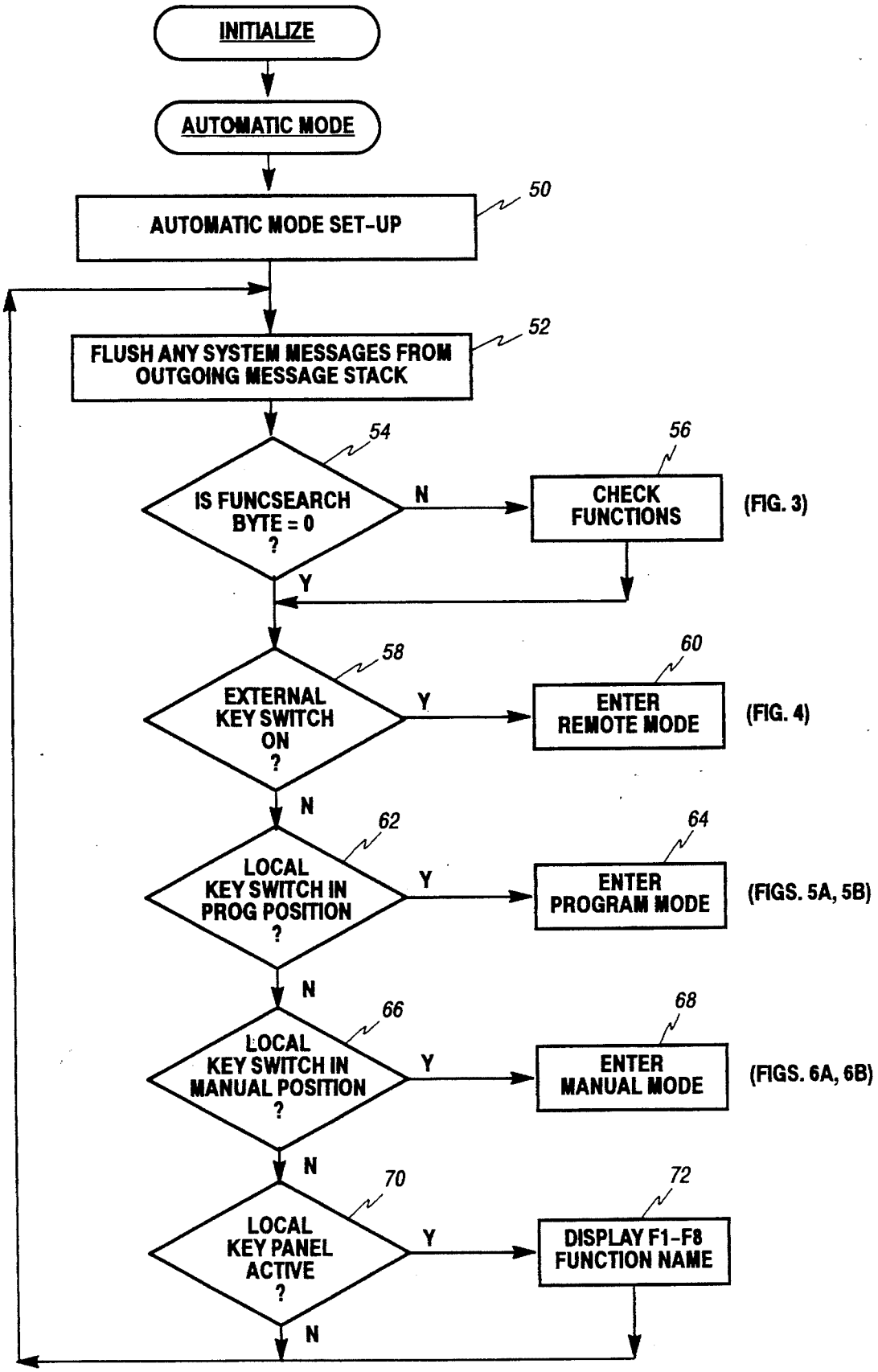
FIG. 2 is a flowchart of a program for operating the sequencer 10 of FIG. 1A in an automatic mode.

FIG. 2 is a flowchart for an AUTOMATIC MODE procedure for operating the clock/sequencer module 10 in accordance with a preferred automatic mode of operation. The system is first initialized by performing the following procedures:

1. Disable interrupts.
2. Turn off beeper.
3. Set system IRQ and STACK pointers.
4. Set Real Time Clock Chip (RTCC) for 12-hour mode.
5. Blink all LEDS.
6. Copy time template to TOD_RAM.
7. Copy time change indicator to TOD_RAM if SPRING or FALL TIME CHANGE is enabled.
8. Check SYSTEM VOLUME values and set to 50% if needed.
9. Clear any pending keyboard input.
10. Set return address for CLEAR key to AUTOMATIC MODE.
11. Clear the Vacuum Fluorescent Display Module (VFM).

After system initialization, the AUTOMATIC MODE procedure is entered. An automatic mode SET-UP procedure is executed at step 50. Next, at step 52, any system messages are flushed from an outgoing message stack. A determination is then made at step 54 whether a FUNCSEARCH byte is equal to zero. If not, a CHECK FUNCTIONS procedure is executed at block 56. This procedure is described below with reference to FIG. 3. If the FUNCSEARCH byte is equal to zero, a determination is made at decision block 58 of whether an external keyswitch is in the "ON" position. If the keyswitch is in the ON position, the module at block 60 branches to a REMOTE MODE procedure, which is described below with reference to FIG. 4. If the keyswitch is not in the ON position, a determination is made at decision block 62 of whether a local keyswitch is in the "PROGRAM" position. If so, the module at block 64 branches to a PROGRAM MODE procedure, which is described below with reference to FIGS. 5A and 5B. If the local keyswitch is not in the PROGRAM position, a determination is made at decision block 66 of whether the local keyswitch is in a "MANUAL" position. If so, the module at block 68 branches to a MANUAL MODE procedure, which is described below with reference to FIGS. 6A and 6B. If the local keyswitch is not in the MANUAL position, a determination is made at decision block 70 of whether a local keypanel is active. If so, the module at block 72 displays the function names corresponding to function keys F1 through F8. If the local keypanel is not active, the program branches back to block 52.

Figure 3:
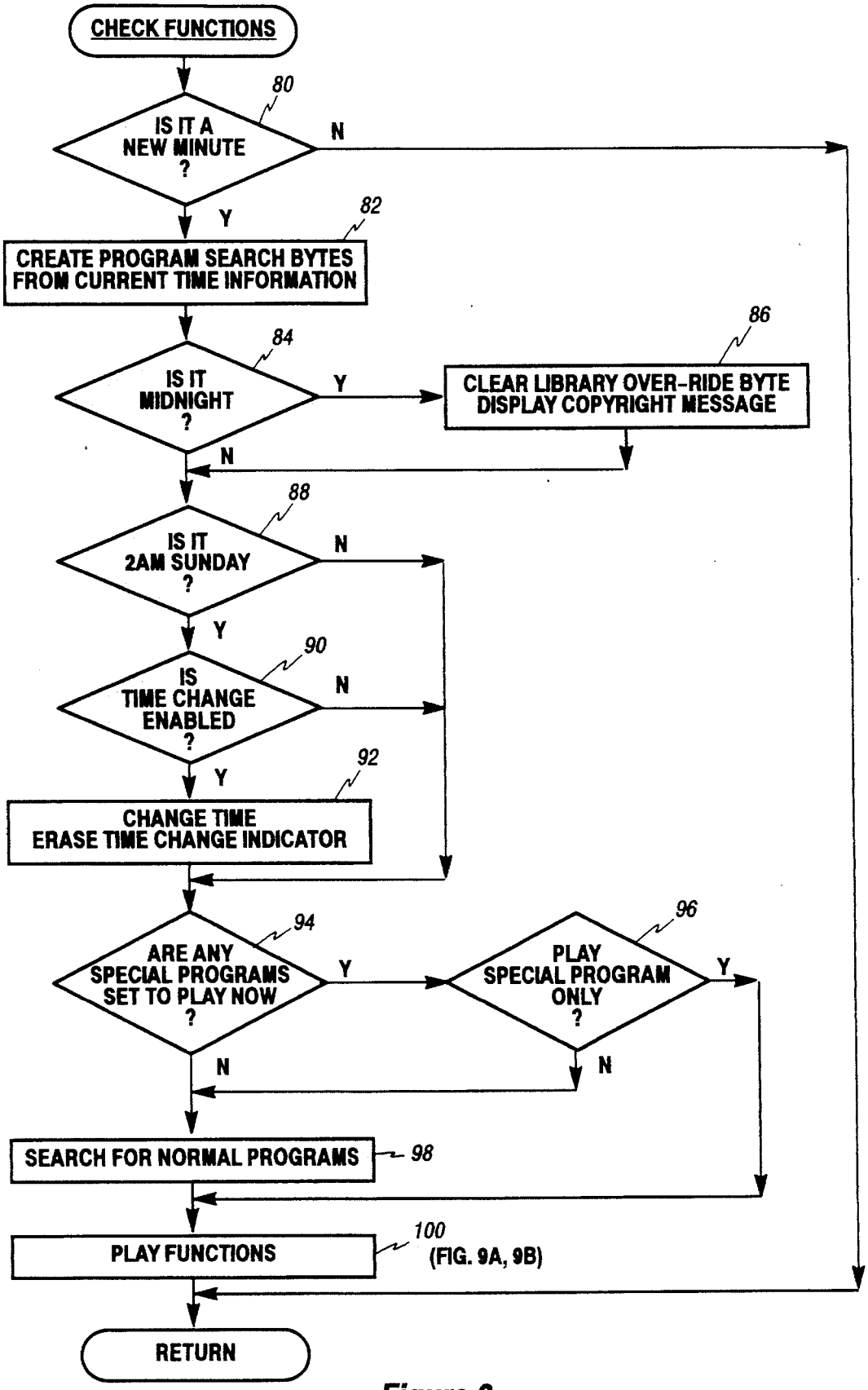
FIG. 3 is a flowchart of a program corresponding to the CHECK FUNCTIONS block of FIG. 2.

FIG. 3 is a flowchart for the CHECK FUNCTIONS procedure of block 56 of FIG. 2. At decision block 80 a determination is made of whether a new minute has begun. If not, the program returns to the AUTOMATIC MODE procedure at the entry point of decision block 58 (see FIG. 2). If a new minute has begun, current time information is employed to create program search bytes, at block 82. Next, at decision block 84 a determination is made of whether the time is midnight. If so, at block 86 a LIBRARY OVERRIDE byte is cleared and a "COPYRIGHT" message is displayed. Next, at decision block 88 a determination is made of whether the time is 2:00 a.m. Sunday. If so, at decision block 90 a determination is made of whether a TIME CHANGE function is enabled. If so, at block 92 the time is changed and a TIME CHANGE indicator is erased. If the decision in either of decision blocks 88 or 90 is negative or following the execution of the procedure of block 92, the next step of the program is the execution of decision block 94, where a determination is made of whether any SPECIAL program(s) is set to play at the current time. If so, a determination is made at decision block 96 of whether only the SPECIAL program is to be played. If so, the CHECK FUNCTIONS procedure branches to the PLAY FUNCTIONS block 100. If the decision of either of the decision blocks 94 or 96 is negative, a search for NORMAL programs is made at block 98. Next, the procedure of the PLAY FUNCTIONS block 100 is executed. This procedure is described below with reference to FIGS. 9A and 9B. The CHECK FUNCTIONS procedure then returns to the AUTOMATIC MODE procedure (FIG. 2).

Figure 4:
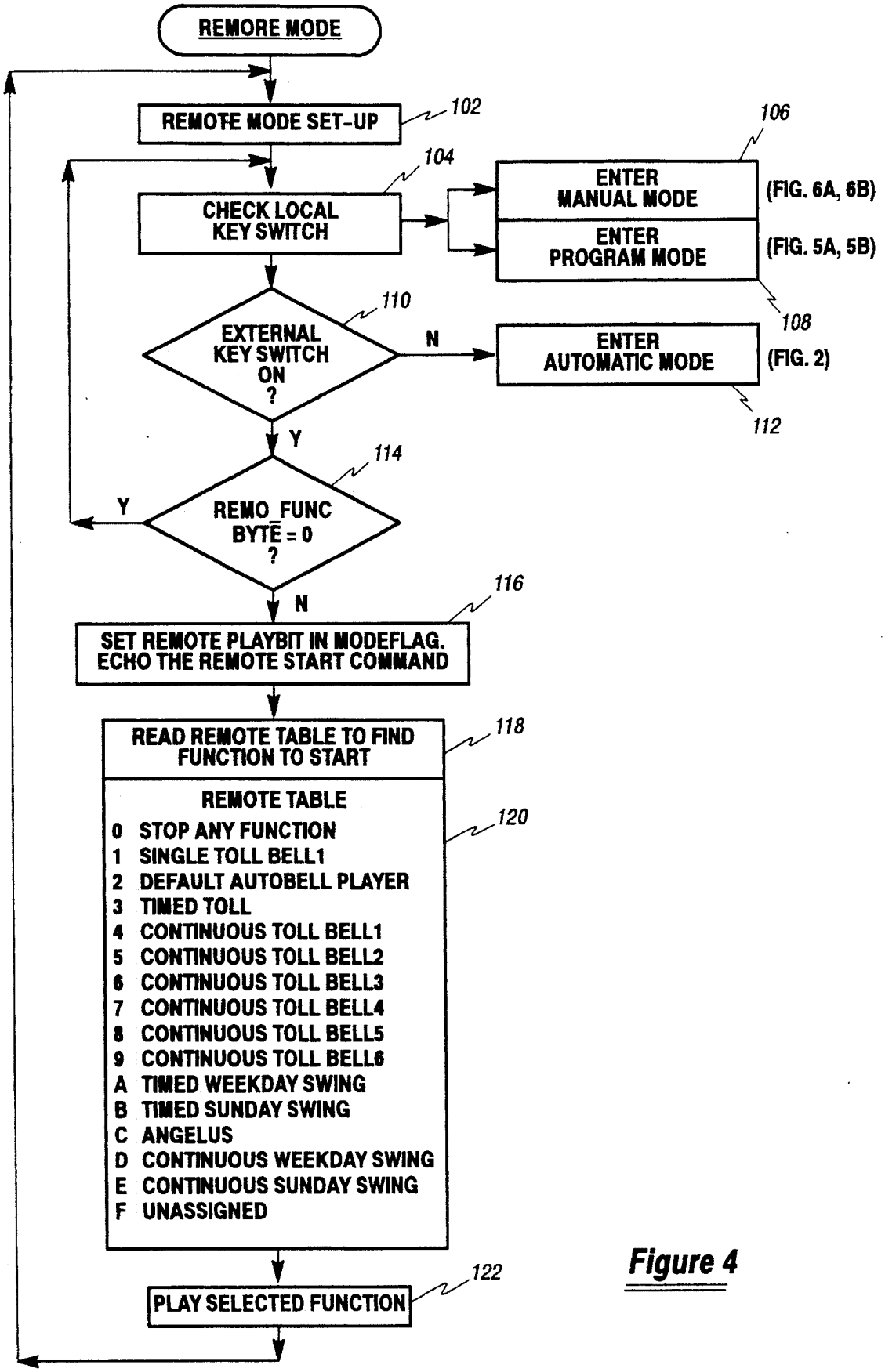
FIG. 4 is a flowchart of a program corresponding to the REMOTE MODE block of FIG. 2.
Figure 5A:
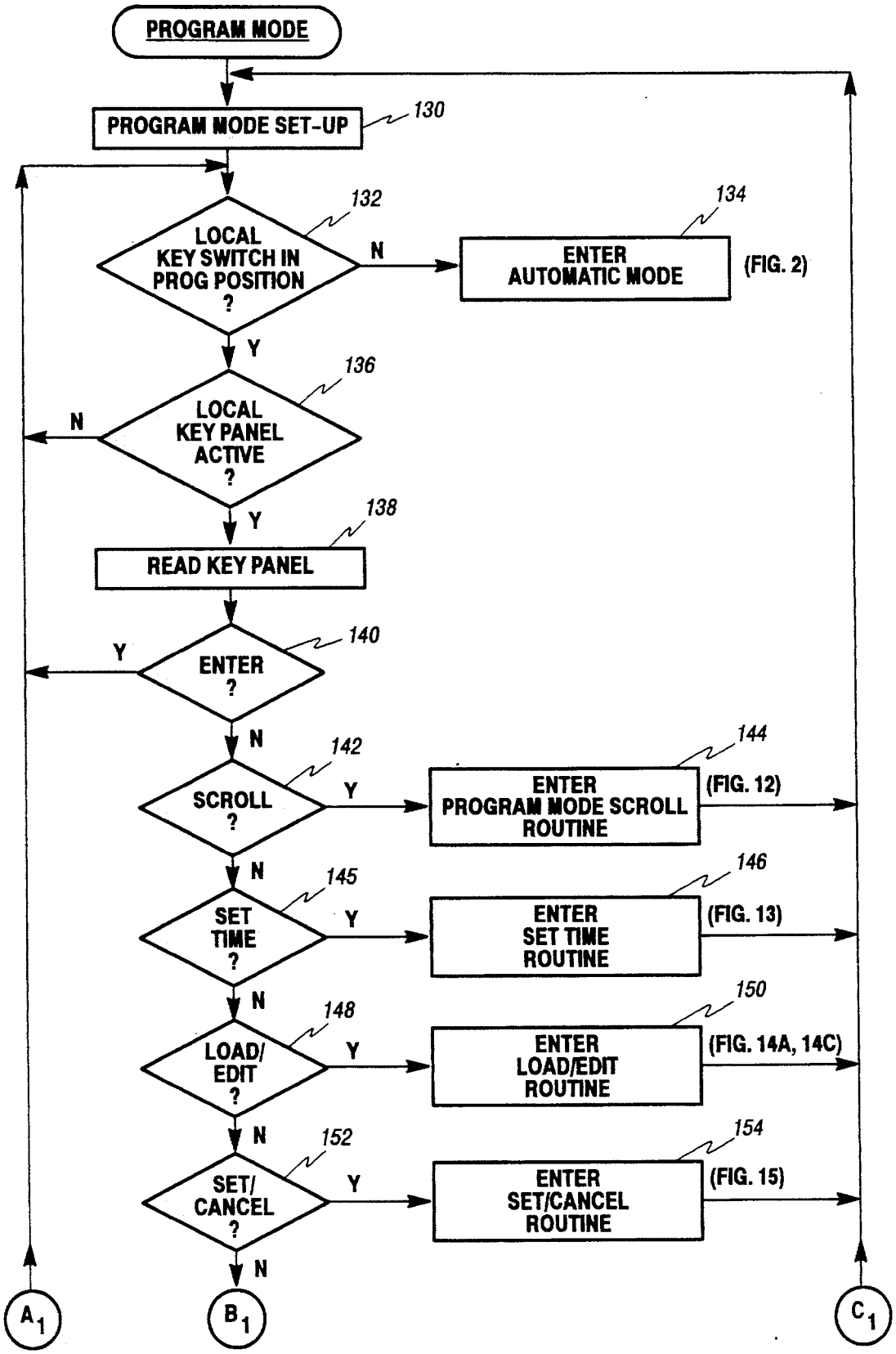
FIGS. 5A and 5B are a flowchart of a program corresponding to the PROGRAM MODE block of FIG. 2.
Figure 5B:
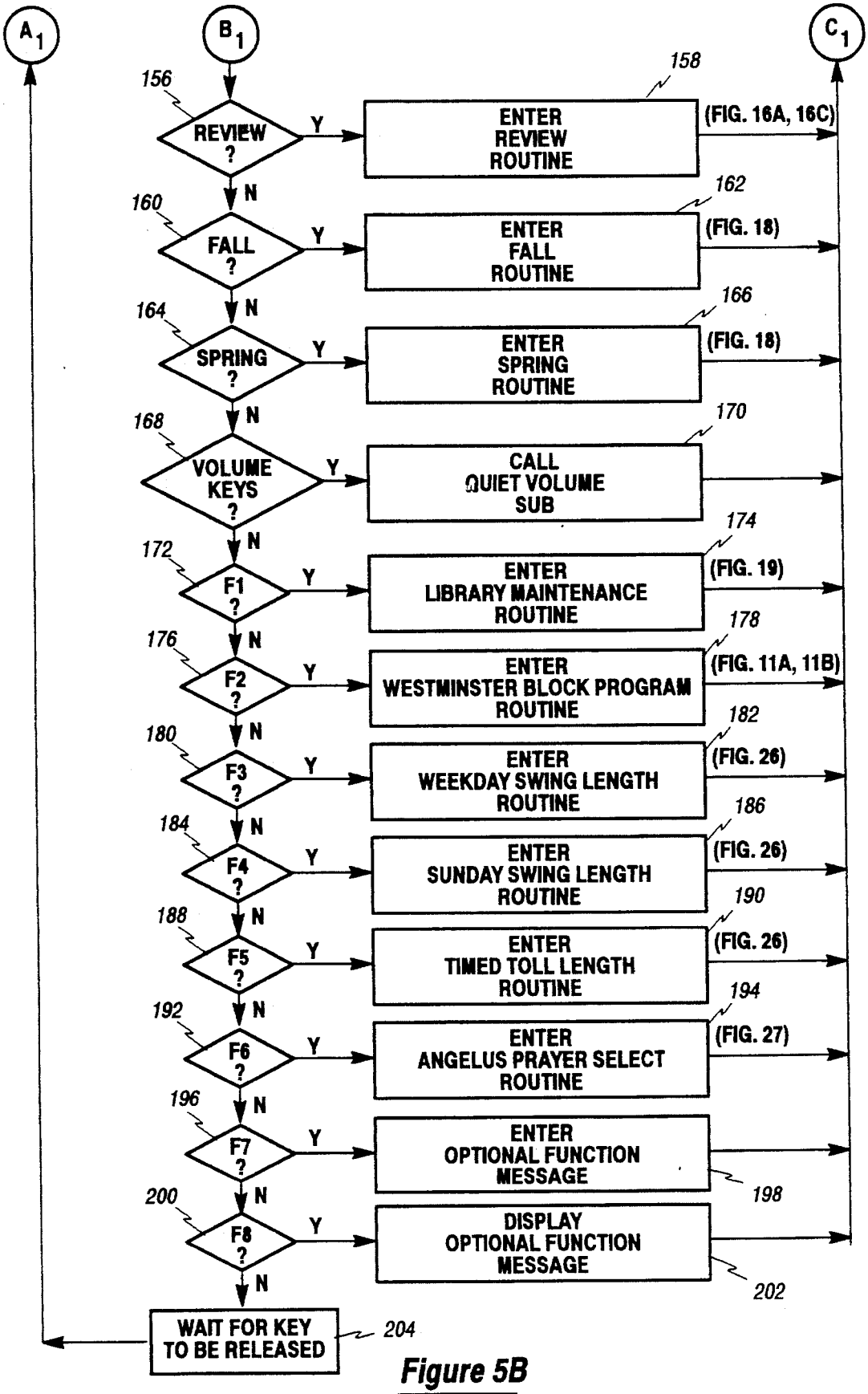
Figure 6A:
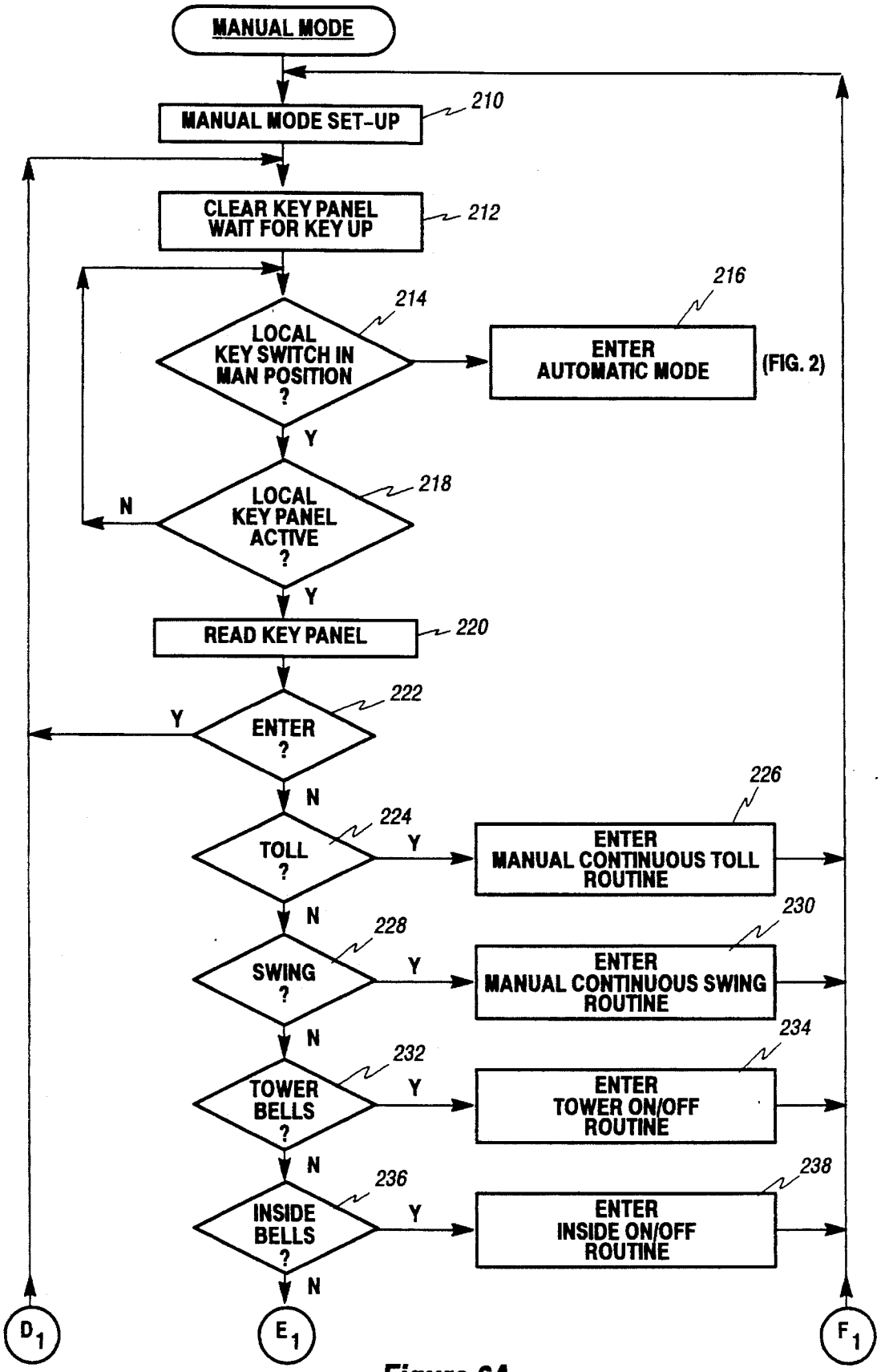
FIGS. 6A and 6B are a flowchart of a program corresponding to the MANUAL MODE block of FIG. 2.
Figure 6B:
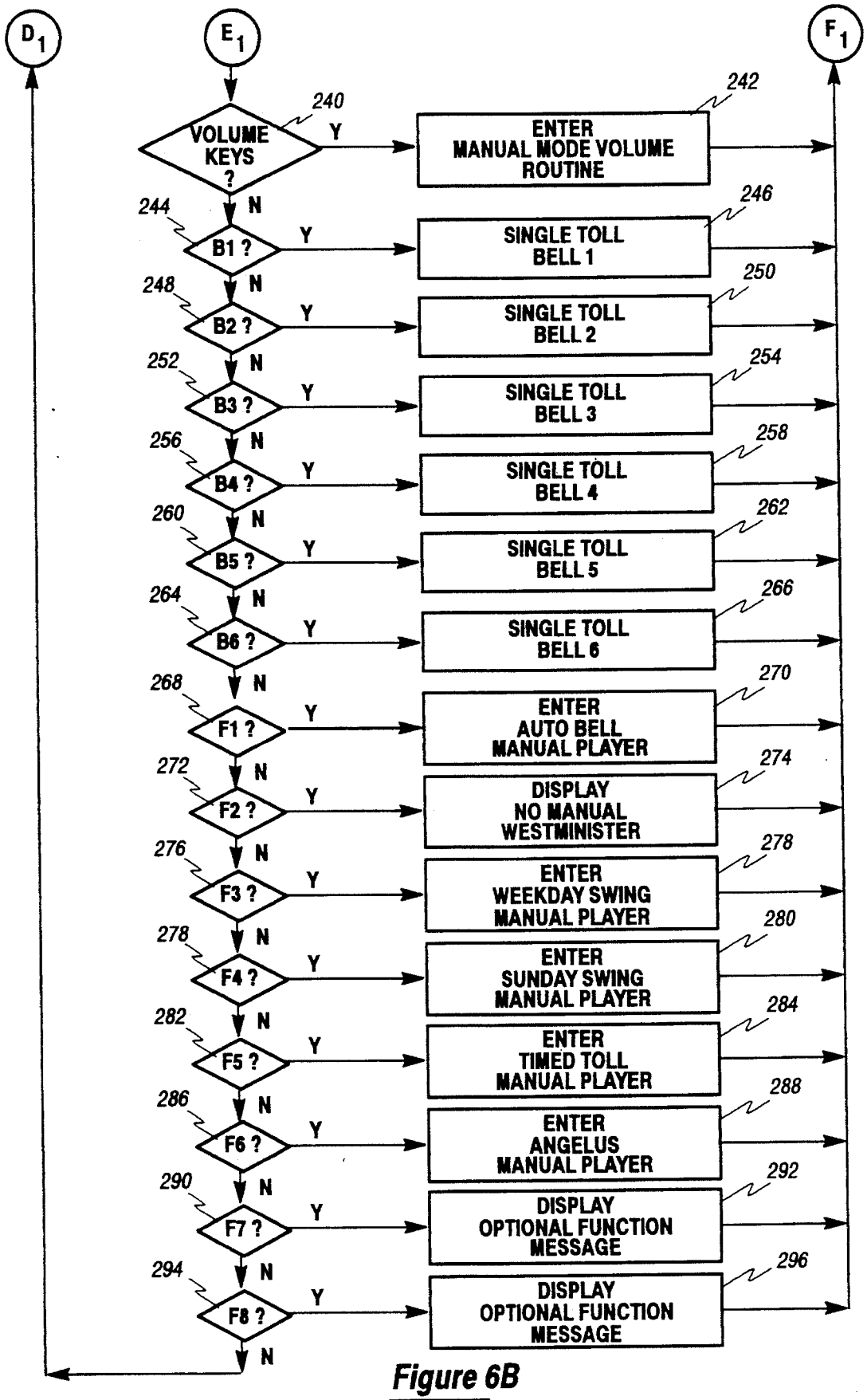

FIG. 4 is a flowchart for the REMOTE MODE procedure of block 60 of FIG. 2. Upon entering the REMOTE MODE procedure, a SET-UP procedure is executed at block 102. Next, the local keyswitch is checked at block 104. If the keyswitch is set to either a MANUAL MODE or PROGRAM MODE position, the system branches to a corresponding MANUAL MODE procedure at block 106 or a PROGRAM MODE procedure at block 108. A flowchart for the PROGRAM MODE procedure is depicted in FIGS. 5A and 5B and a flowchart for the MANUAL MODE procedure is depicted in FIGS. 6A and 6B; these procedures are described below. If the local keyswitch is not set to either the MANUAL MODE or PROGRAM MODE position, a determination is made at decision block 110 of whether the external keyswitch is in the ON position. If not, the system at block 112 enters the AUTOMATIC MODE procedure. If the external keyswitch is in the ON position, a determination is made at decision block 114 of whether a REMO_FUNC (remote function) byte is equal to zero. If this byte is equal to zero, the REMOTE MODE procedure branches back to block 104; if it is not equal to zero the procedure proceeds to block 116. At block 116, a bit referred to herein as the REMOTE PLAYBIT in a flag referred to herein as the MODE FLAG is set and a REMOTE START command is echoed (displayed). Next, at block a table referred to herein as the REMOTE TABLE is read to determine the function to start. An example of this table is depicted in block 120. As shown, there are sixteen entries numbered 00-0F (hexadecimal) in the REMOTE TABLE. These sixteen entries are:

| | |
|---|---|
| 0x00 | ALL STOP<br>Will cause any playing function to STOP<br>Swinging functions will "Swing down" one bell at a time. |
| Ox01 | AUTO=BELL default player (F1)<br>Operation is the same as an AUTOMATIC CLOCK START of the AUTO=BELL PLAYER. |
| 0x02 | Timed WEEKDAY (F3) swing<br>Operation is the same as an AUTOMATIC CLOCK START of the F3 WEEKDAY SWING. |
| 0x03 | Continuous WEEKDAY (F3) swing<br>Same bells as the F3 WEEKDAY SWING, but will ring continuously until turned off. |
| 0x04 | Timed SUNDAY (F4) swing<br>Operation is the same as an AUTOMATIC CLOCK START of the F4 SUNDAY SWING. |
| 0x05 | Continuous SUNDAY (F4) swing<br>Same bells as the F4 SUNDAY SWING, but will ring continuously until turned off. |
| 0x06 | TIMED TOLL (F5)<br>Operation is the same as an AUTOMATIC CLOCK START of the F5 TIMED TOLL. |
| 0x07 | UNIPLAY(A) (F7)<br>Operation is the same as an AUTOMATIC CLOCK START of the F7 UNIPLAY(A) PLAYER. |
| 0x08 | TAPS (future)<br>Operation is the same as an AUTOMATIC CLOCK START of the TAPS PLAYER. |
| 0x?9 | SINGLE TOLL BELL ? (0x19 = BELL1, 0x29 = BELL2, etc.) |
| 0x0A | COUNTED TOLL<br>Remote Start of user-set COUNTED TOLL. |
| 0x0B | Unassigned |
| 0x0C | Unassigned |
| 0x0D | Unassigned |
| 0x0E | Unassigned |
| 0x0F | Unassigned |

At block 122 the selected function is performed. The REMOTE MODE procedure then branches back to block 102.

FIGS. 5A and 5B depicts the PROGRAM MODE procedure. Upon entering this procedure, a SET-UP procedure is performed at block 130. Next, at decision block 132 a determination is made of whether the local keyswitch is in the "PROGRAM" position. If the local keyswitch is not in the "PROGRAM" position, the procedure at block 134 returns the system to the AUTOMATIC MODE procedure. If the local keyswitch is in the "PROGRAM" position, a judgment is made at decision block 136 of whether the local keypanel is active. The PROGRAM MODE procedure branches to decision block 132 if the local keypanel is not active and proceeds to the READ KEYPANEL procedure of block 138 if the local keypanel is active.

The READ KEYPANEL procedure gets the RAW KEY information from a keyboard scanner chip. This RAW KEY value is added to the keyboard table base address, and this location is read to return a page address of the converted key code. This value is placed in the low byte of the Program Counter, forcing program execution to continue at the new address. The CONVERTED KEY CODE is loaded to a D register, and program execution returns to the calling routine.

Figure 18:
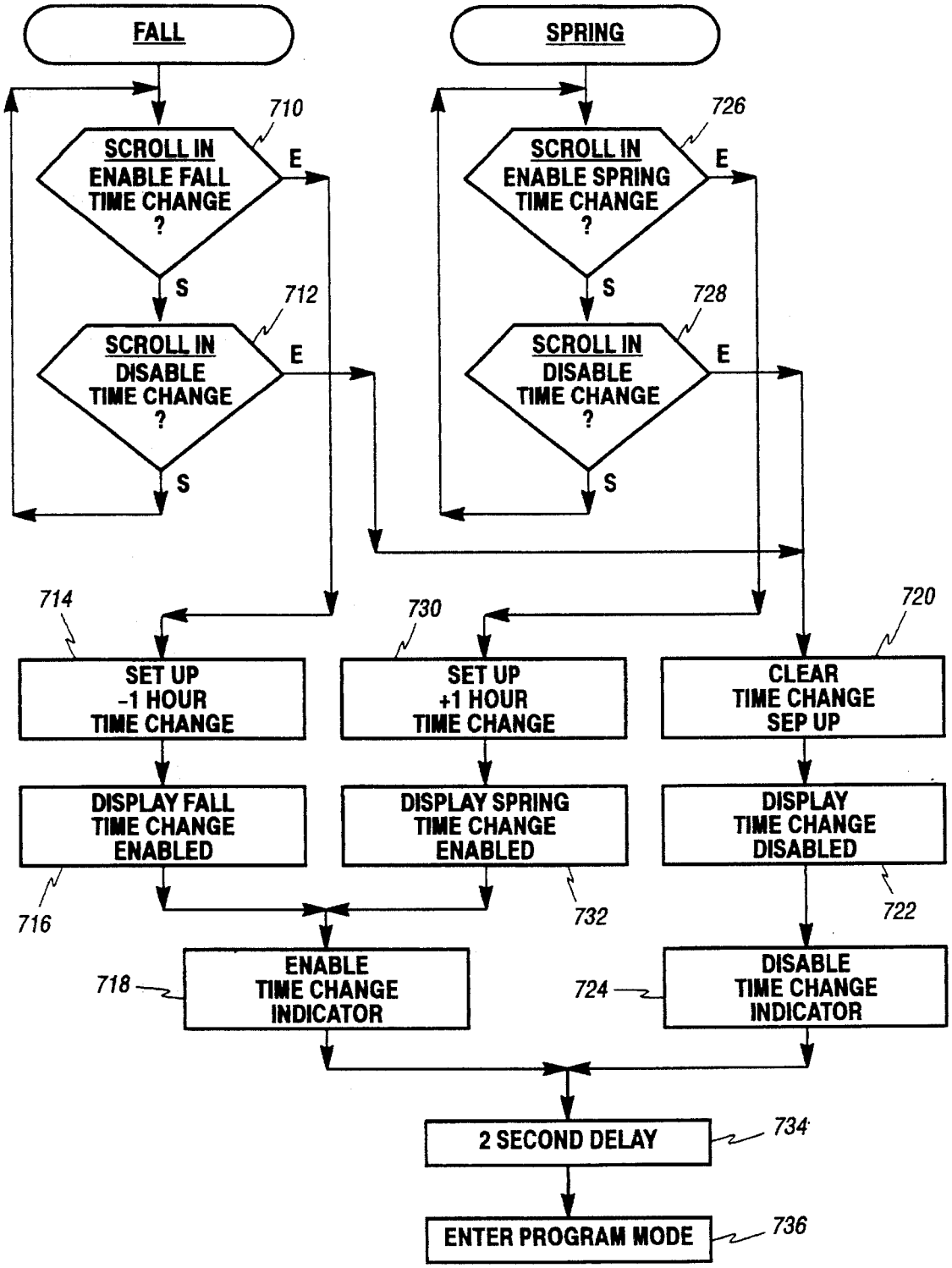
FIG. 18 is a flowchart of a program corresponding to the SPRING and FALL blocks of FIG. 5B.

In accordance with the READ KEYPANEL procedure, the local keypanel is read to determine whether the "ENTER," "SCROLL," "SET TIME,"["LOAD/EDIT," "SET/CANCEL," "REVIEW," "FALL," "SPRING," or "VOLUME KEYS," key has been pressed by the user. As shown in the flowchart, the PROGRAM MODE procedure branches to a procedure corresponding to the pressed key; these corresponding procedures are represented by the following blocks:

Block 144=PROGRAM MODE SCROLL
Block 146=SET TIME
Block 150=LOAD/EDIT
Block 154=SET/CANCEL
Block 158=REVIEW (FIG. 5B)
Block 162=FALL
Block 166=SPRING
Block 170=QUIET VOLUME (In block 170 a QUIET VOLUME subroutine is called.) The routines represented by blocks 144, 146, 150, 154, 158, 162 and 166 are depicted in FIGS. 12, 13, 14A–14C, 15, 16A–16C, and 18, respectively (FIG. 18 depicts both the FALL and SPRING routines), and are described below.

The function keys of the local keypanel are read to determine whether any of one those keys has been pressed (see decision blocks 172, 176, 180, 184, 188, 192, 196 and 200) and the PROGRAM MODE procedure carries out one of the following procedures or routines in accordance with the pressed function key:

Block 174=LIBRARY MAINTENANCE
Block 178=WESTMINSTER BLOCK PROGRAM
Block 182=WEEK DAY SWING LENGTH
Block 186=SUNDAY SWING LENGTH
Block 190=TIMED TOLL LENGTH
Block 194=ANGELUS PRAYER SELECT
Block 198=DISPLAY "OPTIONAL FUNCTION" MESSAGE
Block 202=DISPLAY "OPTIONAL FUNCTION" MESSAGE The routines represented by blocks 174–194 are depicted in FIGS. 19, 11A and 11B, 26, 26, 26 and 27, respectively, and are described below with reference to those figures.

If none of the local keypanel keys has been pressed and then released, at block 204 the system waits for the key to be released, and then returns to block 132 (FIG. 5A).

FIGS. 6A and 6B are a flowchart for the MANUAL MODE procedure. At block 210 a SET-UP procedure is performed. Next, the keypanel is cleared and the system waits for the occurrence of a key-up event (i.e., where a key is pressed and then released). When a key-up event has been detected, the system determines at decision block 214 whether the local keyswitch is in the "MANUAL" position. If the keyswitch is not in the "MANUAL" position, the system at block 216 returns to the AUTOMATIC MODE procedure (FIG. 2). If the local .keyswitch is in the "MANUAL" position, a decision is made at decision block 218 whether the local keypanel is active. If the keypanel is not active, the MANUAL MODE procedure branches back to the entry point for decision block 214. If the keypanel is active, the MANUAL MODE procedure proceeds to block 220.

At block 220, the local keypanel is read and a determination is made at decision blocks 222 through 294 of what key has been pressed. At decision block 222 the "ENTER" key is checked and if this key has been pressed the MANUAL MODE procedure branches back to block 212. However, if the "ENTER" key has not been pressed, the "TOLL" key is tested at decision block 224. If this key has been pressed, a MANUAL CONTINUOUS TOLL procedure is executed at block 226 and the MANUAL MODE procedure branches back to block 210. At decision 228, the "SWING" key is tested. If this key has been pressed the MANUAL CONTINUOUS SWING procedure is executed at block 230 and then the MANUAL MODE procedure branches back to block 210. At decision block 232 the "TOWER BELLS" key is tested and if this key has been pressed a TOWER ON/OFF procedure is executed at block 234, and then the MANUAL MODE procedure branches back to block 210. At decision block 236 the "INSIDE BELLS" key is tested and if this key has been pressed an INSIDE ON/OFF procedure if executed at block 238 and then the MANUAL MODE procedure branches back to block 210.

Referring now to FIG. 6B, the "VOLUME KEYS" key is tested at decision block 240 and if this key has been pressed a MANUAL MODE VOLUME routine is executed at block 242. At block 244 the "B1" key is tested and if this key has been pressed a SINGLE TOLL BELL 1 procedure is executed at block 246. At block 248 the "B2" key is tested and if this key has been pressed a SINGLE TOLL BELL 2 procedures is executed at block 250. In a similar fashion, keys "B3–B6" are tested at blocks 252 through 264, respectively, and corresponding single toll procedures are executed at blocks 254 to 266. At decision blocks 268 through 292 the function keys "F1" through "F8" are tested and corresponding procedures are executed in accordance with the outcome of those tests. Procedure blocks 270–296 correspond to the following procedures:

Block 270=AUTOBELL MANUAL PLAYER

Block 274=NO MANUAL WESTMINSTER

Block 278=WEEKDAY SWING MANUAL PLAYER

Block 280=SUNDAY SWING MANUAL PLAYER

Block 284=TIMED TOLL MANUAL PLAYER

Block 288=ANGELUS MANUAL PLAYER

Block 292=OPTIONAL FUNCTION

Block 296=OPTIONAL FUNCTION

The MANUAL MODE procedure branches back to block 210 after all of the local keypanel keys have been tested.

Figures 7A, 7B:
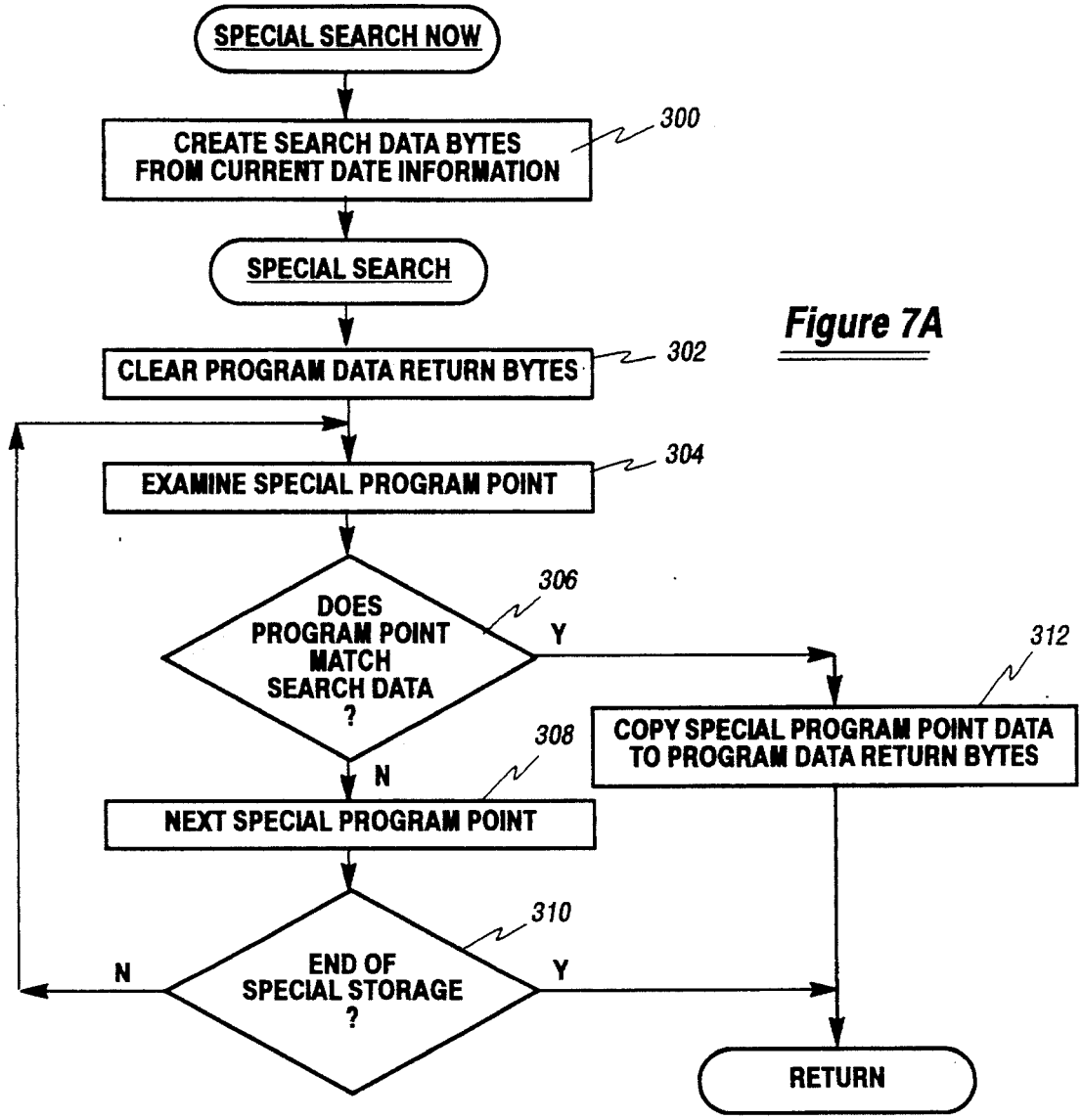
FIG. 7A is a flowchart of a SPECIAL PROGRAM SEARCH routine and FIG. 7B is a representation of a preferred format for special program data.

FIG. 7A is a flowchart of a SPECIAL PROGRAM SEARCH routine and FIG. 7B is an illustration of a preferred format for special program data. Referring to FIG. 7A, a SPECIAL SEARCH NOW routine is first entered and at block 300 SEARCH DATA bytes are created from current date information. This data, a preferred format of which is depicted in FIG. 7B, is stored in a 512 byte area of random access memory referred to as SPECIALS. Thus there is a maximum storage area of 512/5=102 program points. Referring to FIG. 7B, the preferred SPECIAL PROGRAM data format is as follows:

| | |
|---|---|
| BYTE 1 | MSB = 0: play special only |
| BYTE 1 | MSB = 1: play special also |
| BYTE 1 | 5 LSB'S: month data |
| BYTE 2 | 6 LSB'S: date data |
| BYTE 3 | 2 MSB'S: library data |

-continued

| | |
|---|---|
| BYTE 3 | Bit D5: AM/PM data |
| BYTE 3 | 5 LSB'S: hour data |
| BYTE 4 | 7 LSB'S: minute data |
| BYTE 5 | functions to play |

Referring to FIG. 7A, upon entering the SPECIAL SEARCH routine, the PROGRAM DATA RETURN bytes are cleared at block 302. Next, at block 304, a SPECIAL PROGRAM POINT is examined. Next, at decision block 306, a determination is made of whether the PROGRAM POINT matches the SEARCH DATA; if not, the next SPECIAL PROGRAM POINT is read at block 308. Next, at decision block 310, a judgement is made of whether the end of the SPECIAL STORAGE area has been reached; if so, the procedure returns to the calling routine; if not, the SPECIAL SEARCH procedure branches back to block 304. If at decision block 306 a match is found between the PROGRAM POINT and the SEARCH DATA, the SPECIAL PROGRAM POINT data is copied into the PROGRAM DATA RETURN bytes at block 312 and the system returns to the calling routine.

Figures 8A, 8B:
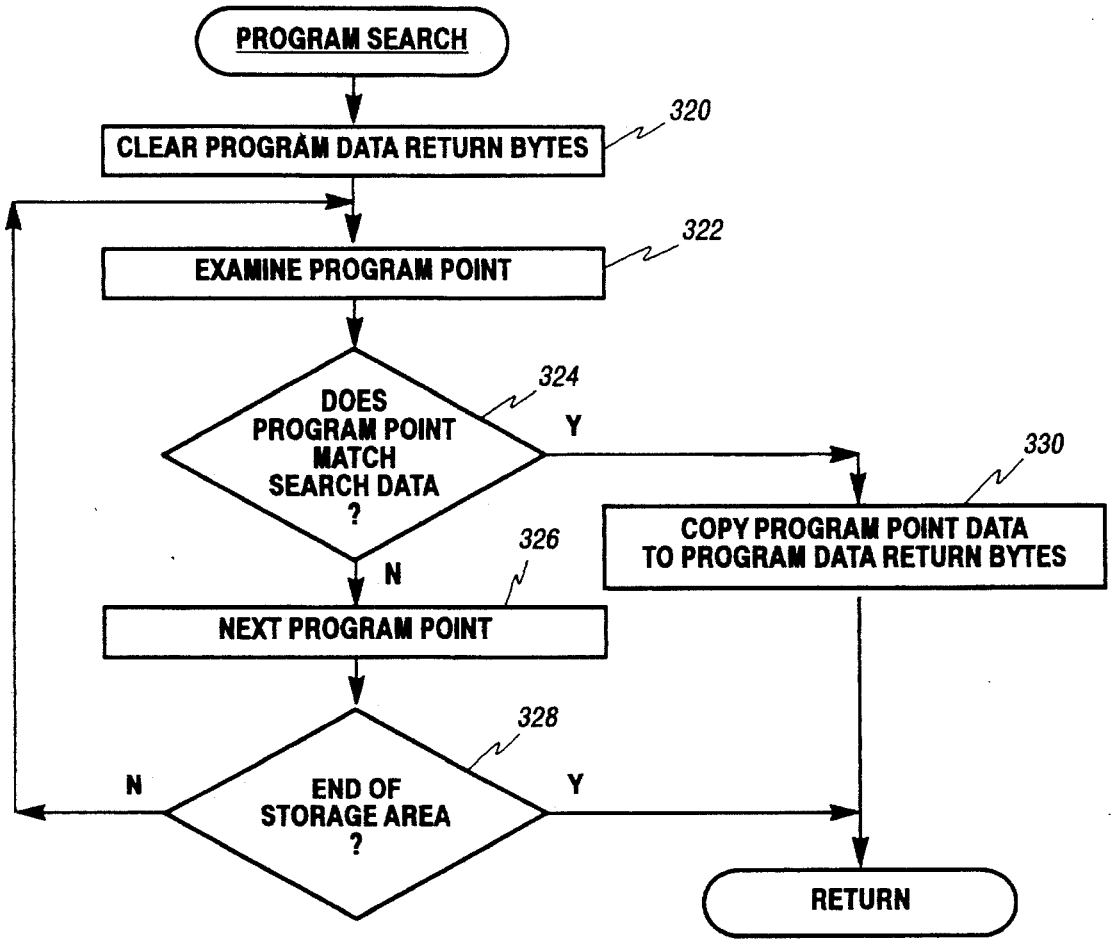
FIG. 8A is a flowchart of a PROGRAM SEARCH routine and FIG. 8B is a representation of a preferred format for normal program data.

FIG. 8A is a flowchart of a PROGRAM SEARCH routine and FIG. 8B depicts a preferred format for normal program data. Upon entering the PROGRAM SEARCH procedure, the PROGRAM DATA RETURN bytes are cleared at block 320. The PROGRAM POINT is examined at block 322. At decision block 324 a judgement is made of whether the PROGRAM POINT matches the SEARCH DATA; at block 326 the next PROGRAM POINT is retrieved if a match is not found at decision block 324, and at decision block 328 a judgement is made of whether the end of the PROGRAM DATA storage area has been reached; if not, the PROGRAM SEARCH procedure branches back to block 322, and if so the procedure returns to the calling routine. If a match is found at decision block 324, the PROGRAM POINT data is copied to PROGRAM DATA RETURN bytes at block 330.

Referring to FIG. 8B, a preferred format for the normal program data is as follows:

| | |
|---|---|
| BYTE 1 | 2 MSB'S: LIBRARY |
| BYTE 1 | Bit D5: am/pm data |
| BYTE 1 | 5 LSB'S: hour data |
| BYTE 2 | 7 LSB'S: minute data |
| BYTE 3 | functions to play |

In preferred embodiments of the invention, the normal program data is stored is seven specific 512-byte areas of RAM called DAY1 through DAY7. The maximum number of program points for each day is 512/3=171.

Figure 9A:
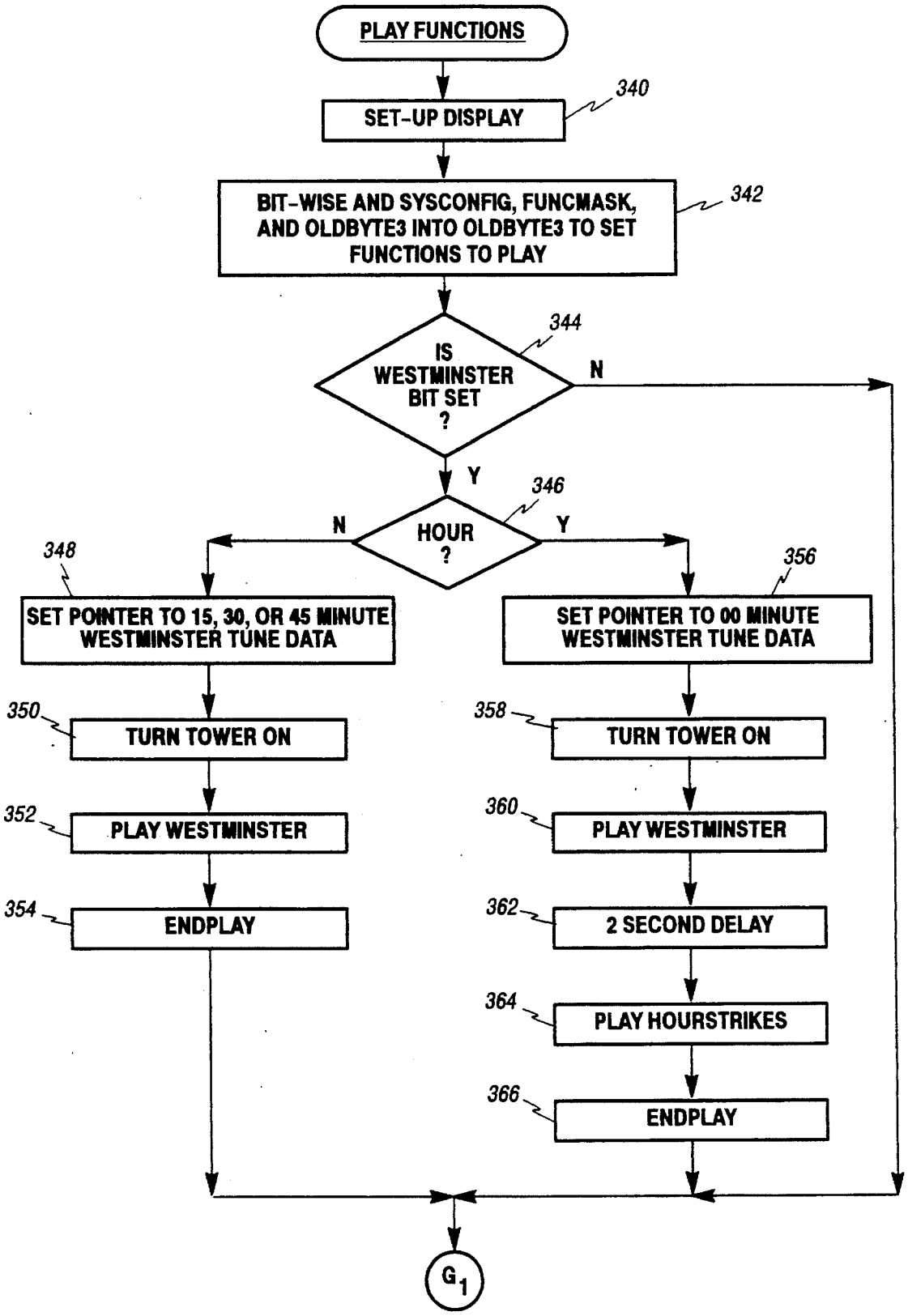
FIGS. 9A and 9B are a flowchart of a program corresponding to the PLAY FUNCTIONS block of FIG. 3.
Figure 9B:
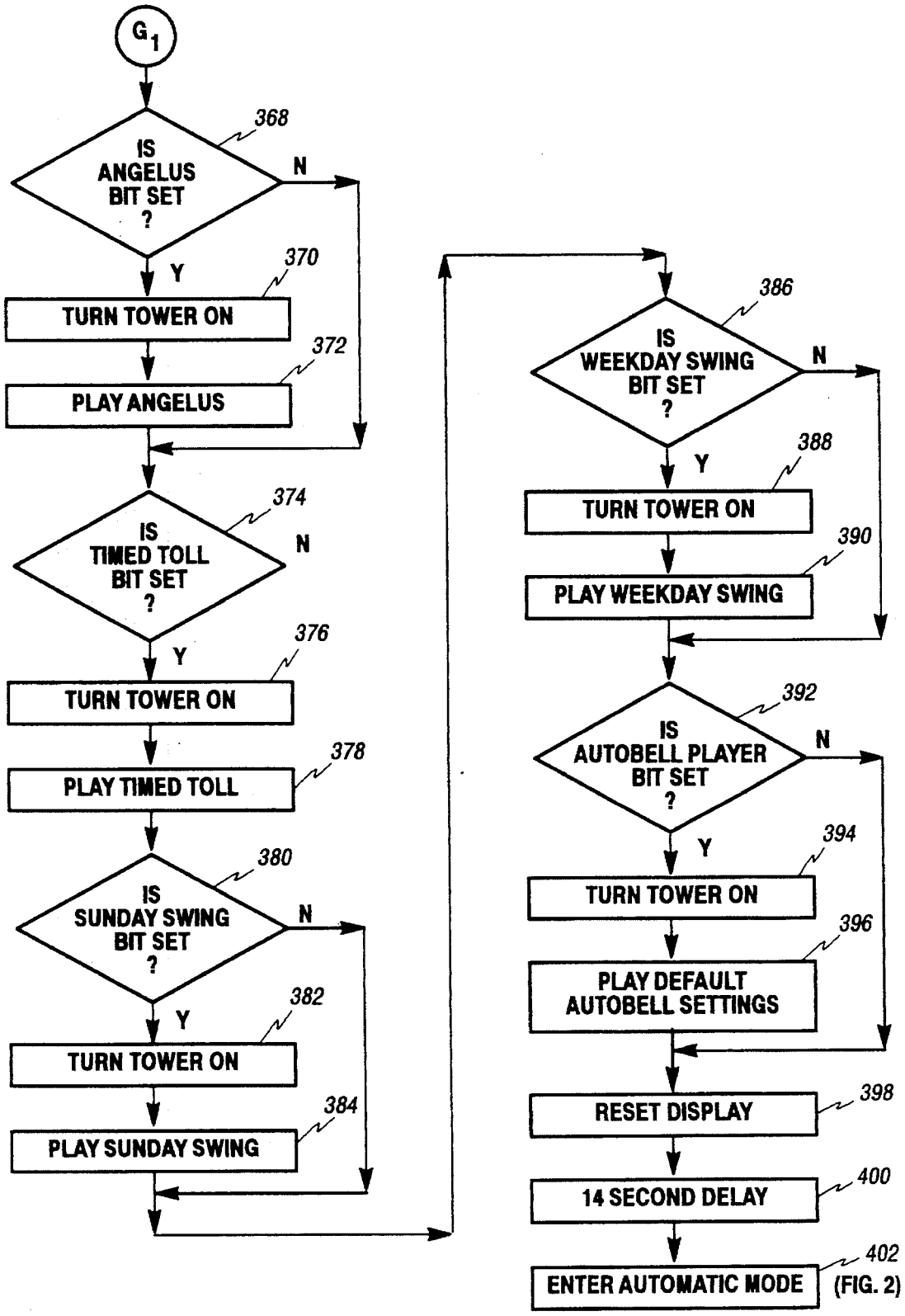

FIGS. 9A and 9B depict the PLAY FUNCTIONS procedure represented by block 100 of FIG. 3. This procedure begins by setting up the display at block 340. A START PLAY routine accepts an input byte containing a single bit set representing which FUNCTION to start, and copies the name of the FUNCTION from the CONFIGURATION TABLE to the bottom line of a time of day RAM (TOD_RAM). It also sets a flag to inhibit writing the DATE INFORMATION to the bottom line of the TOD_RAM. In this way, the TIME OF DAY is displayed along with the currently playing FUNCTION. The START PLAY routine also turns on the tower relay, lights the appropriate FUNCTION LED, and issues a CLOCK BUSY message to the system buss.

At block 342, indications of which functions are to be played are generated by performing a bit-wise AND operation of the following data: SYSCONFIG, FUNCMASK and OLDBYTE3. The result of the bit-wise AND of these three bytes will define which FUNCTIONS are to play at any given CLOCK START.

| | |
|---|---|
| SYSCONFIG: | Hard coded into configuration table. Basic system function definition. |
| FUNCMASK: | RAM byte corresponding to FUNCTIONS ENABLED GREEN LEDS. Set by User. |
| OLDBYTE3: | RAM byte set by PROGRAM (and/or SPECIAL) SEARCH defining clock programmed FUNCTIONS. |

At decision block 344, a judgement is made of whether the WESTMINSTER bit is set; if so, the PLAY FUNCTIONS procedure flows to decision block 346, where a determination is made of whether an HOUR flag is true. If not, the steps indicated on the left hand side of the figure are performed, i.e., at block 348 a pointer is set to 15, 30, or 45 minute WESTMINSTER tune data, at block 350 the tower is turned on, at block 352 the WESTMINSTER data is played, and at block 354 an ENDPLAY routine is executed. If the HOUR flag is true, the above-mentioned pointer is set to 00 minute WESTMINSTER tune data at block 356, the tower is turned on at block 358, at block 360 the play WESTMINSTER procedure is executed, at block 362 the system delays for two seconds, at block 364 a PLAY HOURSTRIKES routine is executed and at block 366 the ENDPLAY routine is executed.

Referring to FIG. 9B, at decision block 368 a determination is made of whether an ANGELUS bit is set; if not, the PLAY FUNCTIONS procedure branches to decision block 374; if so, the tower is turned on at block 370 and at block 372 a PLAY ANGELUS routine is executed. The ANGELUS is a series of three sets of three solemn tolls and three musical "rests." The preferred speed is twenty beats per minute, or one toll (or rest) every three seconds. The ending prayer of the Angelus can be nine tolls (at 20 BPM), a single swinging bell (for the same duration as the nine tolls), or a peal of bells (for the same duration as the nine tolls).

At decision block 374, a determination is made of whether a TIMED TOLL bit is set; if not, the PLAY FUNCTIONS routine branches to decision block 380; if so, the tower is turned on at block 376 and a PLAY TIMED TOLL routine is executed at block 378. At decision block 380, a determination is made of whether a SUNDAY SWING bit is set; if not, the PLAY FUNCTIONS routine branches to decision block 386; if so, the tower is turned on at block 382 and a PLAY SUNDAY SWING routine is executed at block 384. At decision block 386, a determination is made of whether a WEEKDAY SWING bit is set; if not, the PLAY FUNCTIONS procedure branches to decision block 392; if so, the tower is turned on at block 388 and a PLAY WEEKDAY SWING routine is executed at block 390.

At decision block 392, a determination is made of whether an AUTOBELL PLAYER bit is set; if not, the PLAY FUNCTIONS procedure branches to block 398; if so, the tower is turned on at block 394 and default AUTOBELL settings are played at block 396. At block 398, the display is re-set. At block 400, a 14-second delay is implemented, and at block 402 the system enters the AUTOMATIC MODE routine (see FIG. 2).

In preferred embodiments of the software, a macro, referred to herein as "ScrollIn," displays a message representing an option choice, waits for operator input and, if the input is ENTER, acts in accordance with the displayed option; if the input is SCROLL, the system exits from the macro, usually to the next choice. The CLEAR key will force the program flow to enter AUTOMATIC MODE from within the Wait4Key call. Any other input will be disregarded.

The ScrollIn macro is represented in the drawings as shown in FIG. 10A. Thus, the icon corresponding to reference numeral 410 represents the ScrollIn macro and the message to be displayed and the rectangular box corresponding to reference numeral 412 represents the action to be taken upon the user pressing of the "ENTER" key. The actions to be taken upon pressing of the "SCROLL" key are represented by the blocks following the arrow adjacent to the "S."

FIG. 10B is a flowchart for the ScrollIn macro. Upon being executed, the macro at block 414 displays the option message along with "ENTER or SCROLL"; at block 416 a "beep" is played; at block 418 the Wait4Key procedure is executed; at decision block 420 a determination is made of whether the "ENTER" key has been pressed. If the "ENTER" key has been pressed, the macro branches to the address of the appropriate routine at block 422; if the "ENTER" key has not been pressed, a determination is made at decision block 424 of whether the "SCROLL" key has been pressed. If the "SCROLL" key has not been pressed, the macro branches back to block 416; if the "SCROLL" key has been pressed, the macro is exited.

Figure 11A:
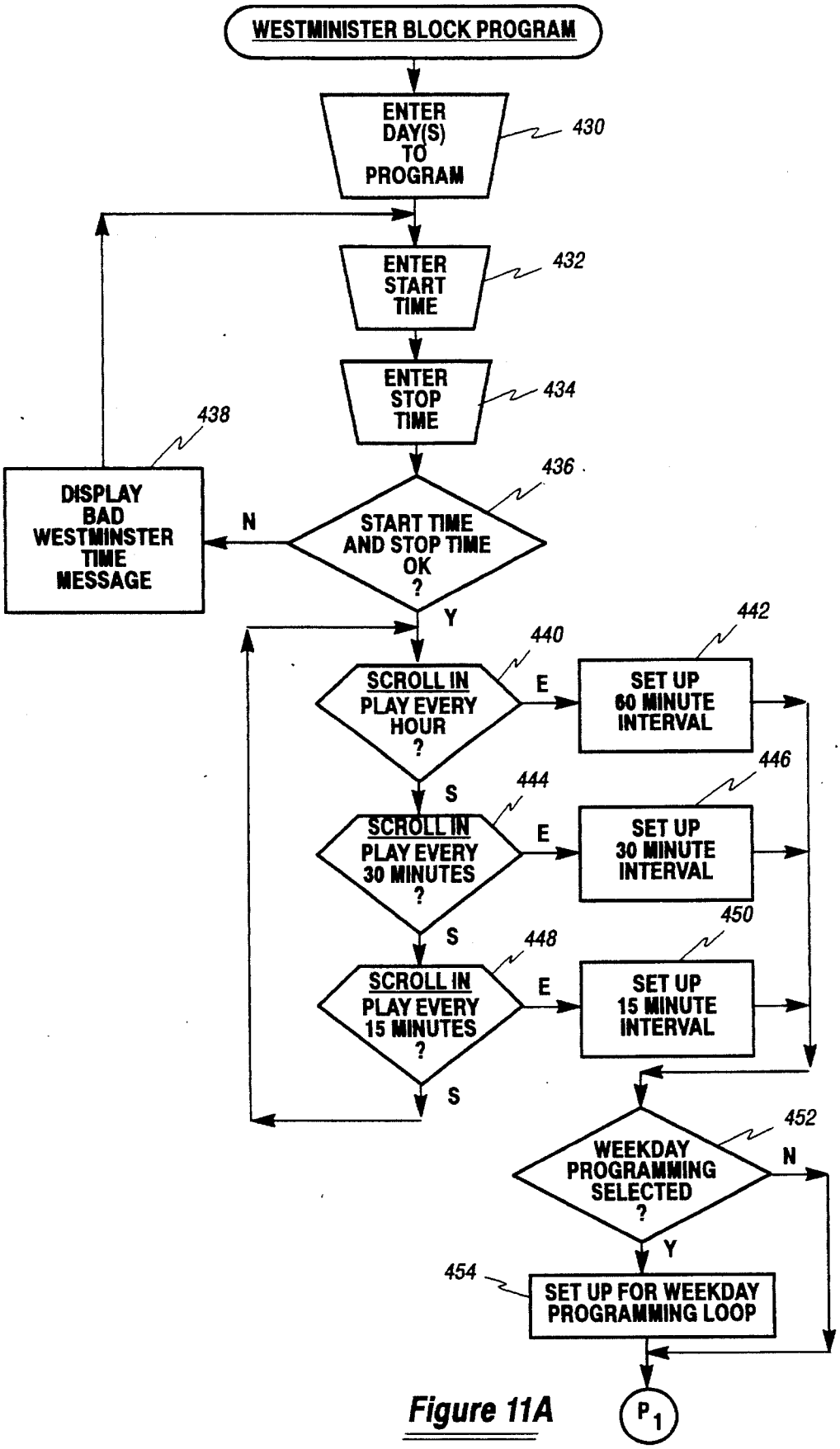
FIGS. 11A and 11B are a flowchart of a program corresponding to the WESTMINSTER BLOCK PROGRAM block of FIG. 5B.
Figure 11B:
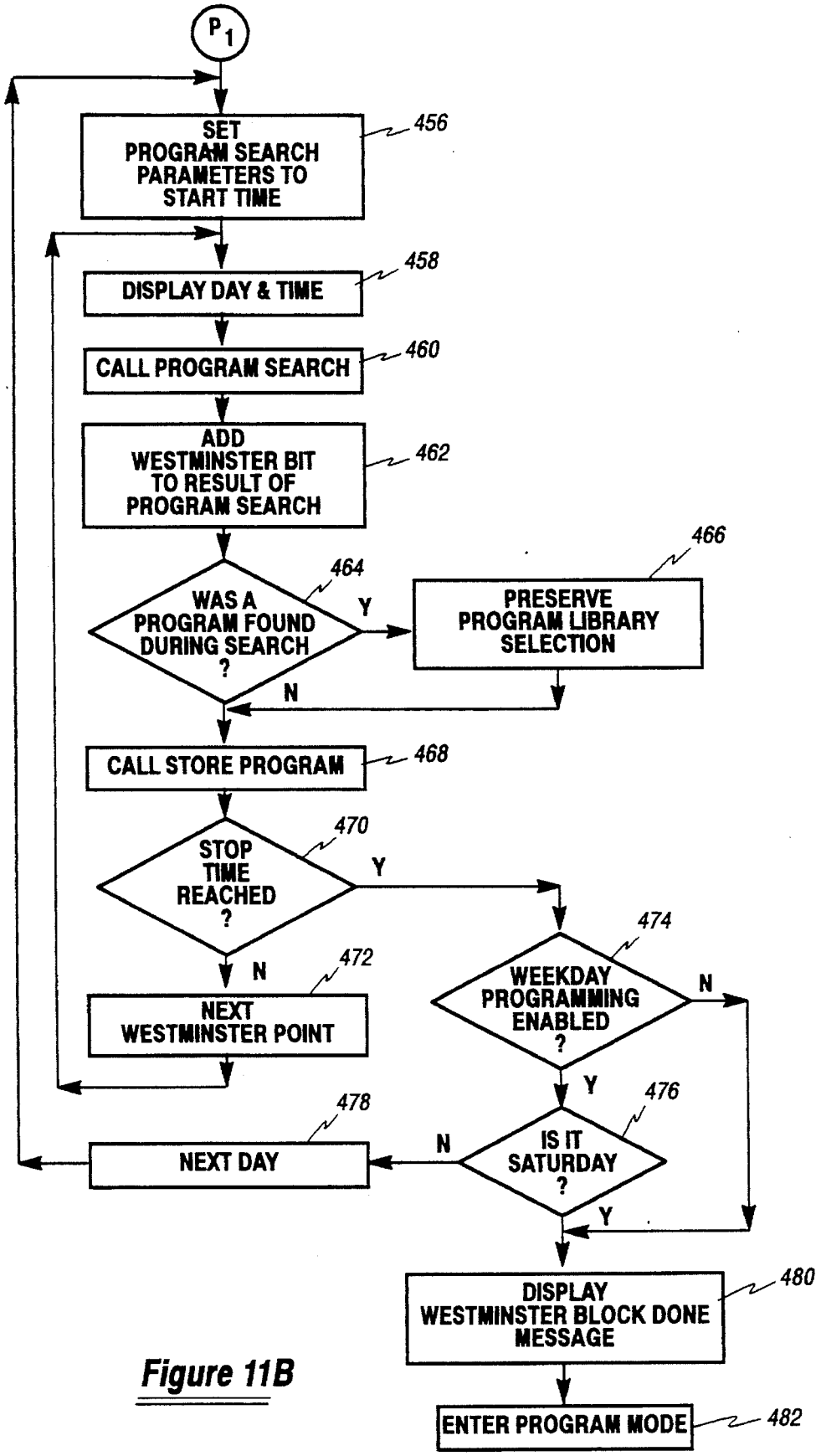

FIGS. 11A and 11B depict the WESTMINSTER BLOCK PROGRAM routine represented by block 178 of FIG. 5B. Upon entering this routine, the sequencer module, at input block 430, prompts the user to enter the day or days for which a program is to be developed. At input block 432 the module prompts the user to enter the start time, and at block 434 the user is asked to enter the stop time. At decision block 436, the routine determines whether the start time and stop time are acceptable. If the start and stop times are not acceptable, the module displays the message "BAD WESTMINSTER TIME" at block 438 and then branches back to input block 432.

If the start and stop times are acceptable, the ScrollIn macro is executed with the message "play every hour?." If the user presses the "ENTER" key, a set-up routine in which 60-minute time intervals are set is executed at block 442. If the user presses the "SCROLL" key, the ScrollIn macro is again executed, at block 444, with a message "PLAY EVERY 30 MINUTES?"; if the user presses the "ENTER" key at this point, the system at block 446 sets up a WESTMINSTER program for thirty-minute time intervals. At block 448, the ScrollIn macro is executed with the message "PLAY EVERY 15 MINUTES?"; if the user presses the "ENTER" key here, the WESTMINSTER program is set up at block 450 for fifteen-minute intervals.

At decision block 452, a determination is made of whether weekday programming has been selected; if not, the routine branches to block 456; if weekday programming has been selected, the program is set up for a weekday programming loop at block 454. At block 456 (FIG. 11B), the PROGRAM SEARCH parameters are set to the START TIME. At block 458 the day and time are displayed. At block 460 the PROGRAM SEARCH routine is called. The PROGRAM SEARCH routine returns OLDBYTE1, OLDBYTE2, and OLDBYTE3 containing the program definition bytes as set forth in FIG. 8B. To preserve the library reference of this program, the 2 MSB's of OLDBYTE1 must be copied to NEWBYTE1. At block 462 the WESTMINSTER BIT is added to the result of the PROGRAM SEARCH. At decision block 464, a determination is made of whether the program was found during the search; if so, at block 466 the program library selection is preserved.

At block 468, the program is stored with a STORE PROGRAM routine. At decision block 470 a determination is made of whether the stop time has been reached. If not, at block 472 the next WESTMINSTER point is retrieved and the procedure branches back to block 458. If so, a determination is made at decision block 474 whether weekday programming is enabled; if not, decision block 476 is skipped and the procedure branches to block 480. If weekday programming is enabled, a determination is made at decision block 476 whether the current day is a Saturday; if not, data for the next day is retrieved at block 478 and the procedure branches back to block 456. If the current day is a Saturday, the message "WESTMINSTER BLOCK DONE" is displayed at block 480, and at block 482 the PROGRAM MODE procedure is entered (the PROGRAM MODE procedure is described above with reference to FIGS. 6A and 6B).

Figure 12:
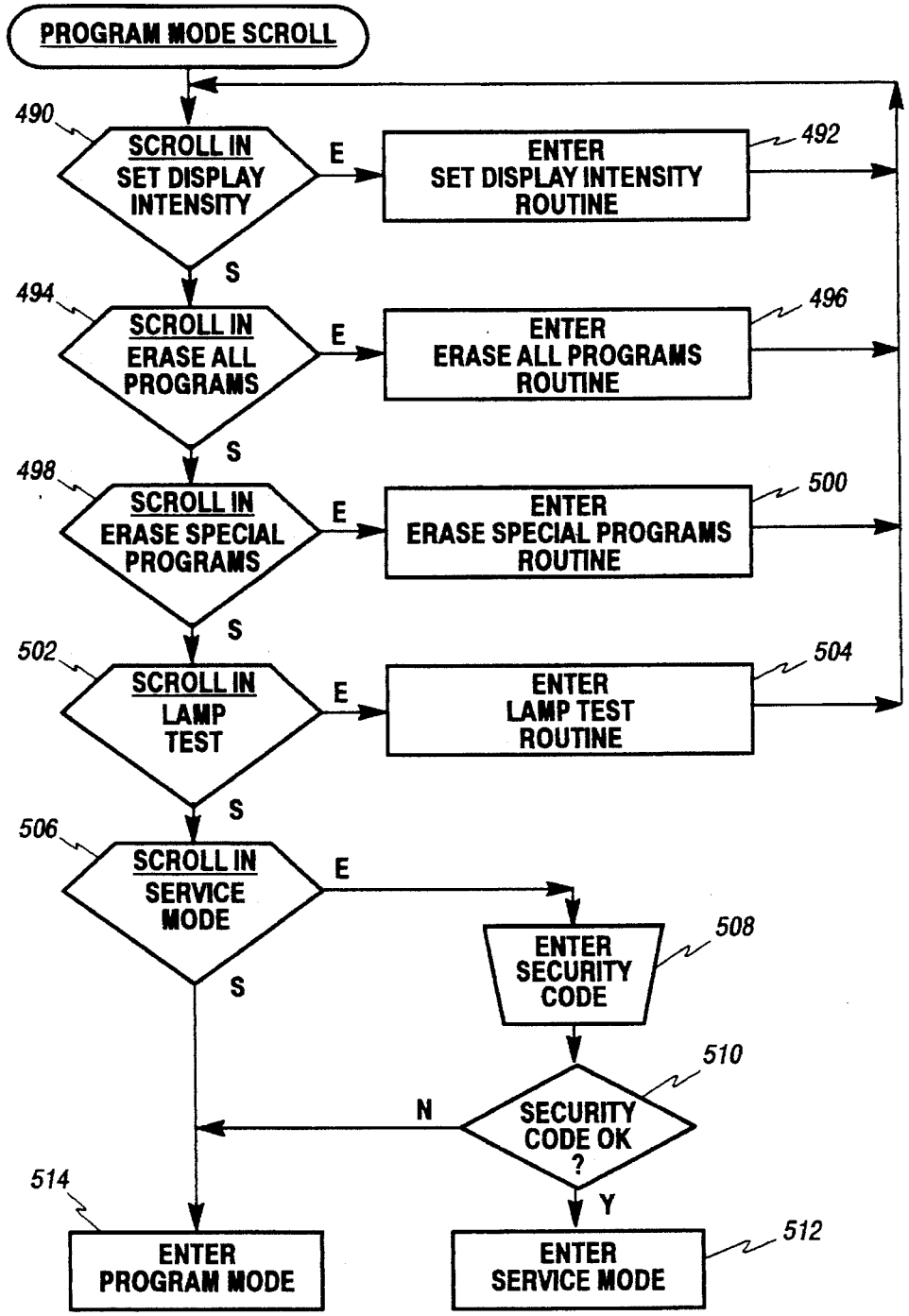
FIG. 12 is a flowchart of a program corresponding to the PROGRAM MODE SCROLL block of FIG. 5A.

FIG. 12 is a flowchart for a PROGRAM MODE "SCROLL" routine. In this routine, the ScrollIn macro is used to prompt the user for instructions. First, at block 490, the macro is used with the message "SET DISPLAY INTENSITY"; if the user presses the "ENTER" key a SET DISPLAY INTENSITY routine is executed at block 492. At block 494 the macro is executed with the message "ERASE ALL PROGRAMS"; if the user presses the "ENTER" key at this point, an ERASE ALL PROGRAMS routine is executed at block 496. At block 498 the macro is executed with the message "ERASE SPECIAL PROGRAMS"; if the user presses the "ENTER" key at this point an ERASE SPECIAL PROGRAMS routine is executed at block 500. At block 502 the macro is executed with the message "LAMP TEST"; if the user presses the "ENTER" key at this point a "LAMP TEST" routine is executed at block 504.

The following paragraphs summarize the PROGRAM MODE SCROLL routines:

SET DISPLAY INTENSITY:

The VFM has 4 levels of brightness: dim, half-dim, half-bright, and bright. Upon entering the SET DISPLAY INTENSITY routine, the user may vary the VFM intensity via the AM (brighter) and the PM (dimmer) keys. At the end of the routine, the user must press ENTER to store the new value.

ERASE ALL PROGRAMS:

Choosing this option will cause the messages "READY TO ERASE ALL PROGRAMS" and "ARE YOU SURE? SCROLL>yes CLEAR>no" to be alternately displayed until either the SCROLL or CLEAR key is pressed. If the SCROLL key is pressed, all information in the DAY1 through DAY7 storage areas will be cleared to 0, as well as the information in the SPECIALS storage area.

ERASE SPECIAL PROGRAMS:

Choosing this option will cause the messages "READY TO ERASE SPECIALS" and "ARE YOU SURE? SCROLL>yes CLEAR>no" to be alternately displayed until either the SCROLL or CLEAR key is pressed. If the SCROLL key is pressed, all information in the SPECIALS storage area will be cleared to 0.

LAMP TEST:

This routine will first display the message "ALL LIGHTS ON", and light all LEDS on the panel. Next, the message "ALL LIGHTS OFF" is displayed, and all panel LEDS are extinguished. Next, the VFM will display the message "DISPLAY TEST", followed by all dots of all characters ON, then all dots for all characters OFF A final message, "LAMP TEST COMPLETE", is displayed before returning to PROGRAM MODE.

At block 506 the ScrollIn macro is executed with the message "SERVICE MODE"; if the user presses the "ENTER" key at this point, input block 508 is executed and the message "ENTER SECURITY CODE" is displayed; the keyboard is then read for the entered security code. At decision block 510, a determination is made of whether the security code that the user entered is acceptable. If so, a SERVICE MODE routine is entered at block 512. If the security code is not acceptable, or if the user has scrolled through all of the available options, the system at block 514 enters the PROGRAM MODE routine (see FIGS. 5A and 5B).

Figure 13:
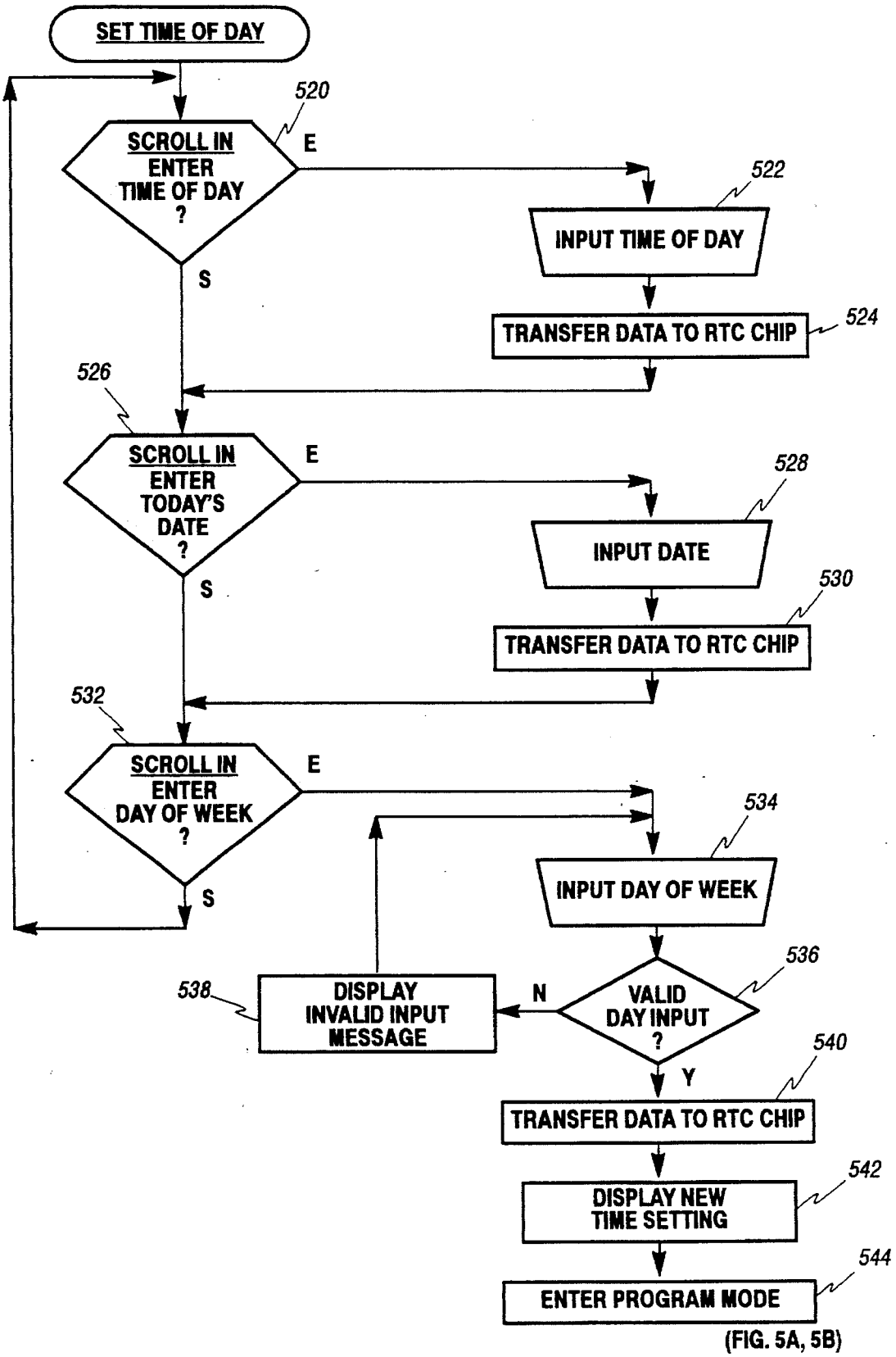
FIG. 13 is a flowchart of a program corresponding to the SET TIME block of FIG. 5A.

FIG. 13 depicts the SET TIME OF DAY routine represented by block 146 of FIG. 5A. Upon entering this routine, the ScrollIn macro is executed at block 520 with the message "ENTER TIME OF DAY?"; if the user presses the "ENTER" key, input block 522 is executed and the user is prompted to input the time of day. At block 524 the time of day data is transferred to the real time clock (RTC). At block 526 the ScrollIn macro is executed with the message "ENTER TODAY'S DATE?"; if the user presses the "ENTER" key at this point, input block 528 is executed and the user is prompted to input the date. At block 530 the date data is transferred to the real time clock. At block 532, the ScrollIn macro is executed with the message "INPUT DAY OF WEEK?"; at this point, pressing of the "ENTER" key causes the routine at block 534 to prompt the user to input the day of the week. At decision block 536, a determination is made of whether the day of week data previously provided by the user is valid. If not, the message "INVALID INPUT" is displayed at block 538; the routine then branches back to block 534. If the day of week data is valid, the data is transferred to the real time clock at block 540 and at block 542 the new time setting is displayed. At block 544, the system enters the PROGRAM MODE routine (see FIGS. 5A and 5B).

Figure 14A:
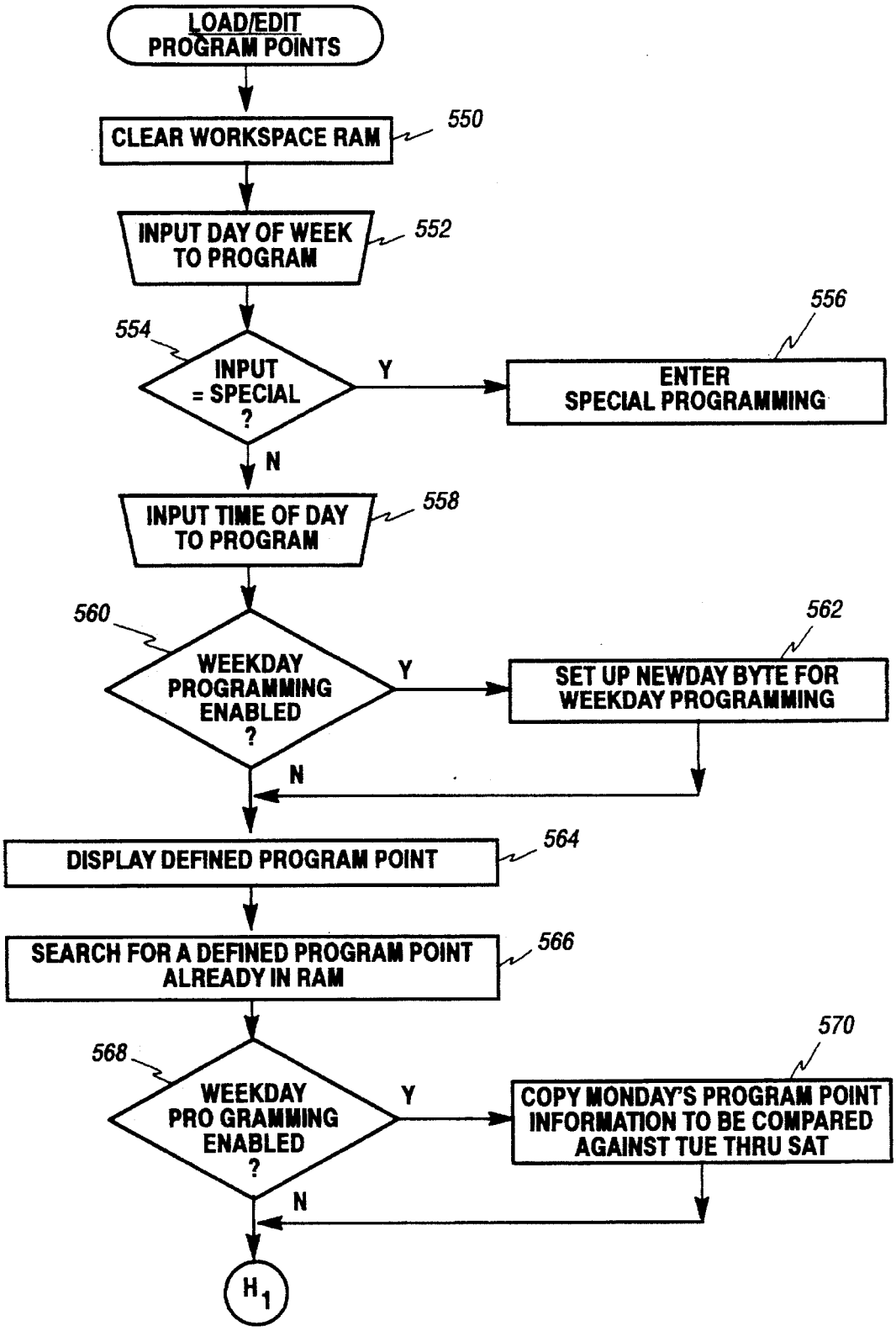
FIGS. 14A–14C are a flowchart of a program corresponding to the LOAD/EDIT block of FIG. 5A.
Figure 14B:
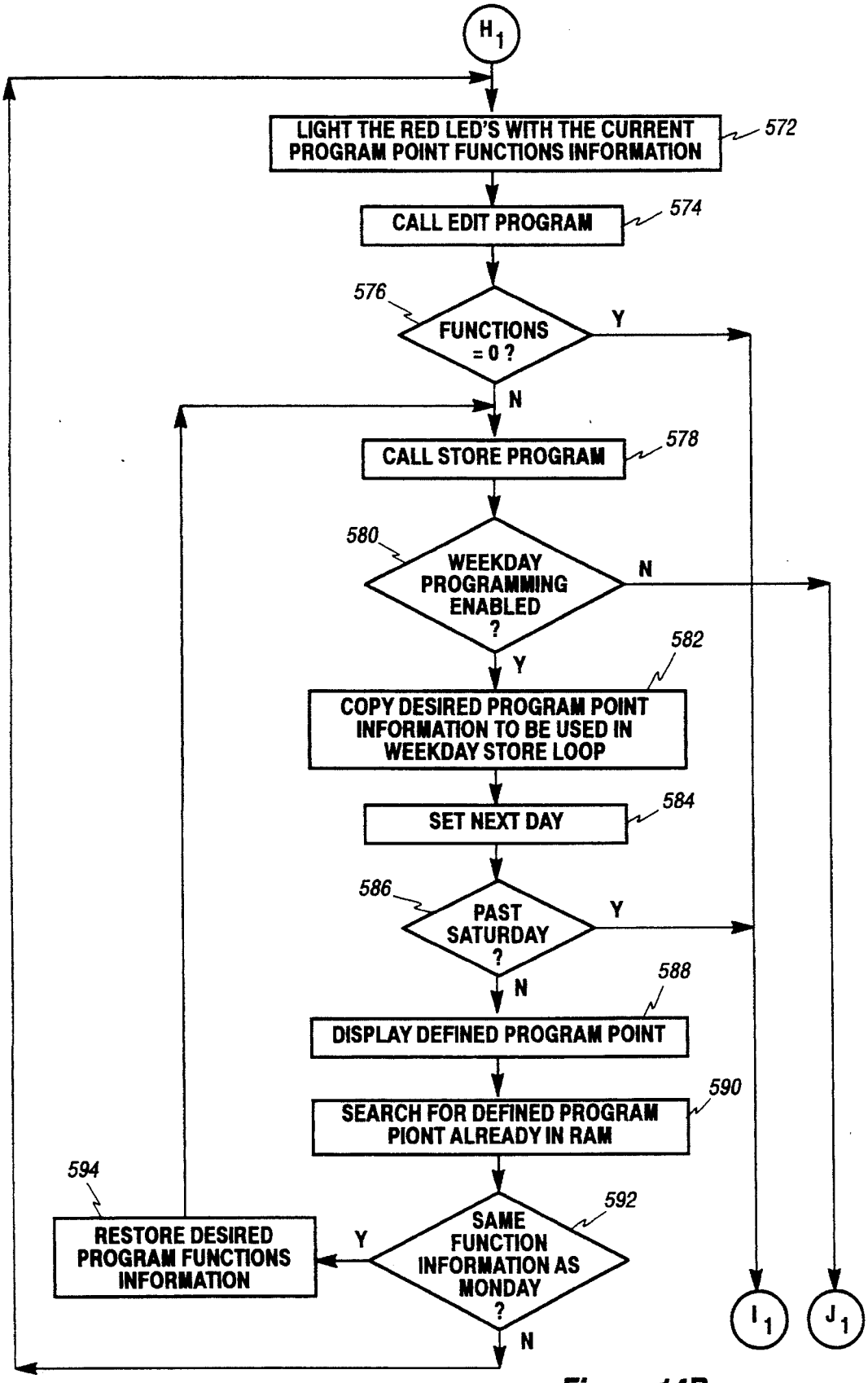
Figure 14C:
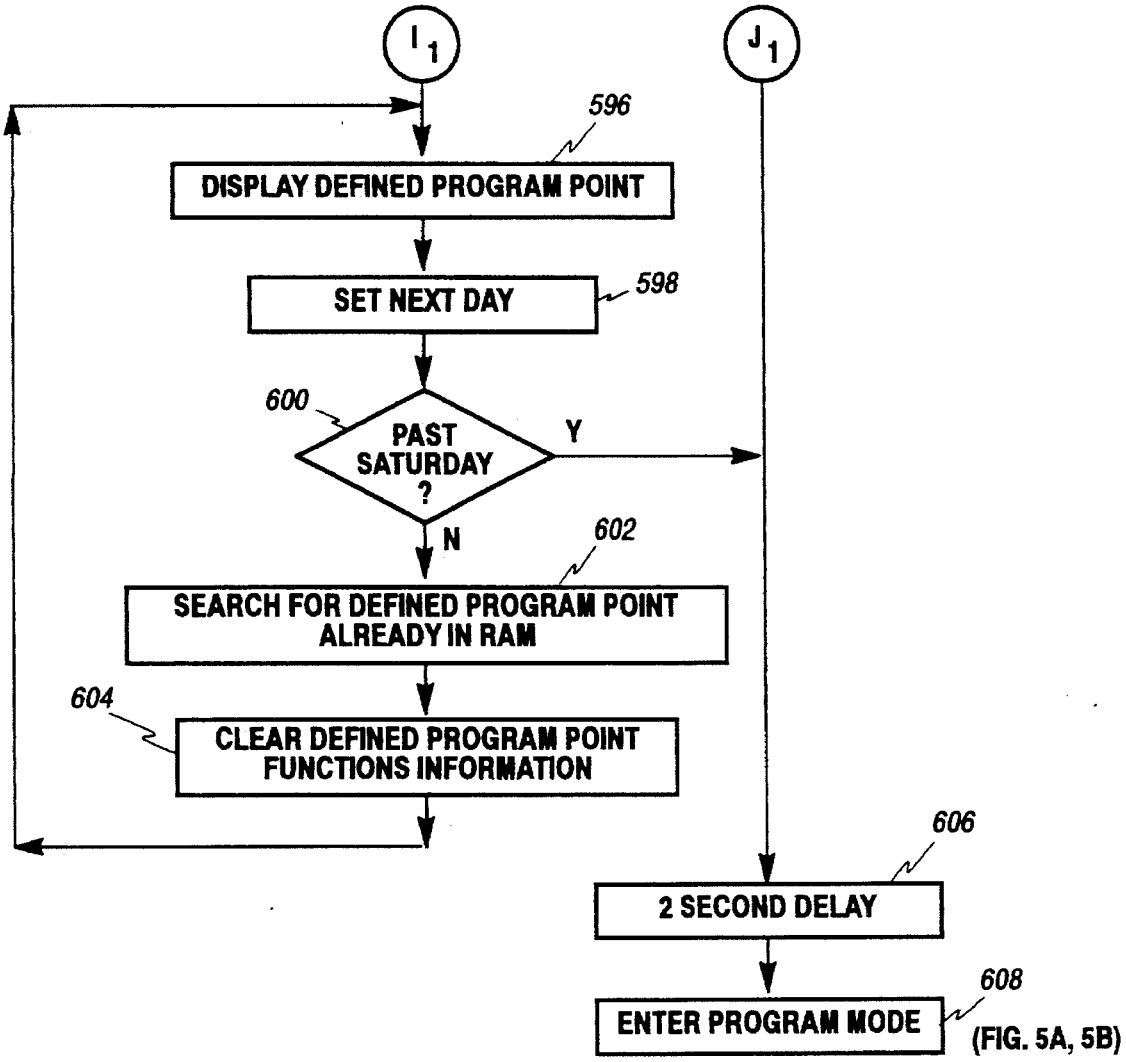

FIGS. 14A–14C depict the LOAD/EDIT routine represented by block 150 of FIG. 5A. Upon entering this routine, the "workspace" RAM is cleared at block 550. Next, at input block 552, the user is asked to input an indication of the day of the week for which a program is to be developed. At decision block 554, a determination is made of whether the user has indicated a desire for "special programming." If special programming is desired, a SPECIAL PROGRAMMING routine is entered at block 556. If special programming is not desired, the user is prompted at input block 558 to input the time of day for which the program is to be made. At decision block 560, a determination is made of whether weekday programming is enabled; if so, a NEW DAY byte is set up for weekday programming at block 562. At block 564, the defined program point is displayed. At block 566, a search is made for the defined program point in memory. At decision block 568, a determination is made of whether weekday programming is enabled; if so, Monday program point information is compared at block 570 against the information corresponding to Tuesday through Saturday.

Referring now to FIG. 14B, at block 572 the red LEDs of the sequencer module are used to display the current program point FUNCTIONS information. At block 574, an EditProgram routine is called. At decision block 576, a test is made of whether FUNCTIONS equals zero; if so, the LOAD/EDIT routine branches to block 596 (see FIG. 14C); if FUNCTIONS is not equal to zero, a StoreProgram routine is executed at block 578. At decision block 580, a check is made of whether weekday programming is enabled; if not, the routine branches to block 606 (see FIG. 14C). If weekday programming is enabled, the desired program point information is copied at block 582 for use in the WEEKDAY STORE loop. At block 584 the next day is set. At decision block 586, a determination is made of whether Saturday has passed; if so, the LOAD/EDIT program branches to block 606; if not, the defined program point is displayed at block 588. At block 590, the defined program point is searched for in RAM. At decision block 592, a determination is made of whether the FUNCTIONS information is the same as the corresponding information for Monday; if not, the routine branches to block 572; if so, the desired program FUNCTIONS information is restored at block 594 and the program branches back to block 578.

Referring to FIG. 14C, the defined program point is displayed at block 596. The next day is set at block 598. At decision block 600, a test is made of whether Saturday is passed; if so, the program branches to block 606; if not, the RAM is searched for the defined program point at block 602. At block 604, the defined program point FUNCTIONS information is cleared. At block 606, the routine delays for two seconds, and at block 608 the PROGRAM MODE routine is entered (see FIGS. 5A and 5B).

Figure 15:
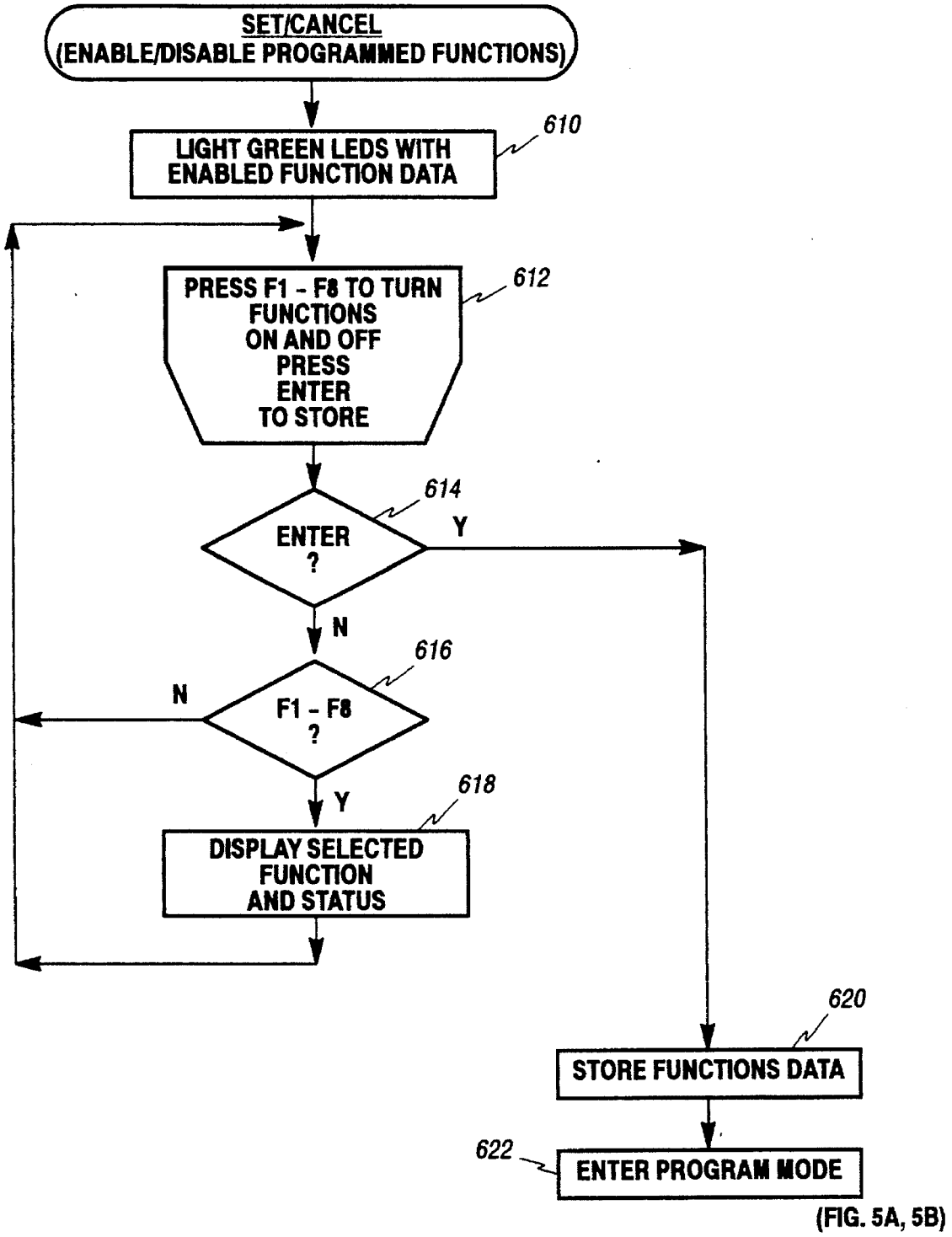
FIG. 15 is a flowchart of a program corresponding to the SET/CANCEL block of FIG. 5A.

FIG. 15 is a flowchart of the SET/CANCEL routine referred to in block 154 FIG. 5A. Upon entering this routine, green LEDs are lit at block 610 to indicate the enabled function data. At input block 612, the user is asked to press function keys F1 through F8 to toggle their corresponding functions on and off, and to press "ENTER" to store the desired function data. At decision block 614, a determination is made of whether the "ENTER" key has been pressed; if so, the program stores the FUNCTIONS data at block 620 and then enters the PROGRAM MODE routine at block 622. If the "ENTER" key was not pressed by the user, the system tests, at decision block 616, whether function keys F1 through F8 have been pressed; if not, the routine branches back to block 12; if so, the selected function and status are displayed at block 618, and then the routine branches back to block 612.

Figure 16A:
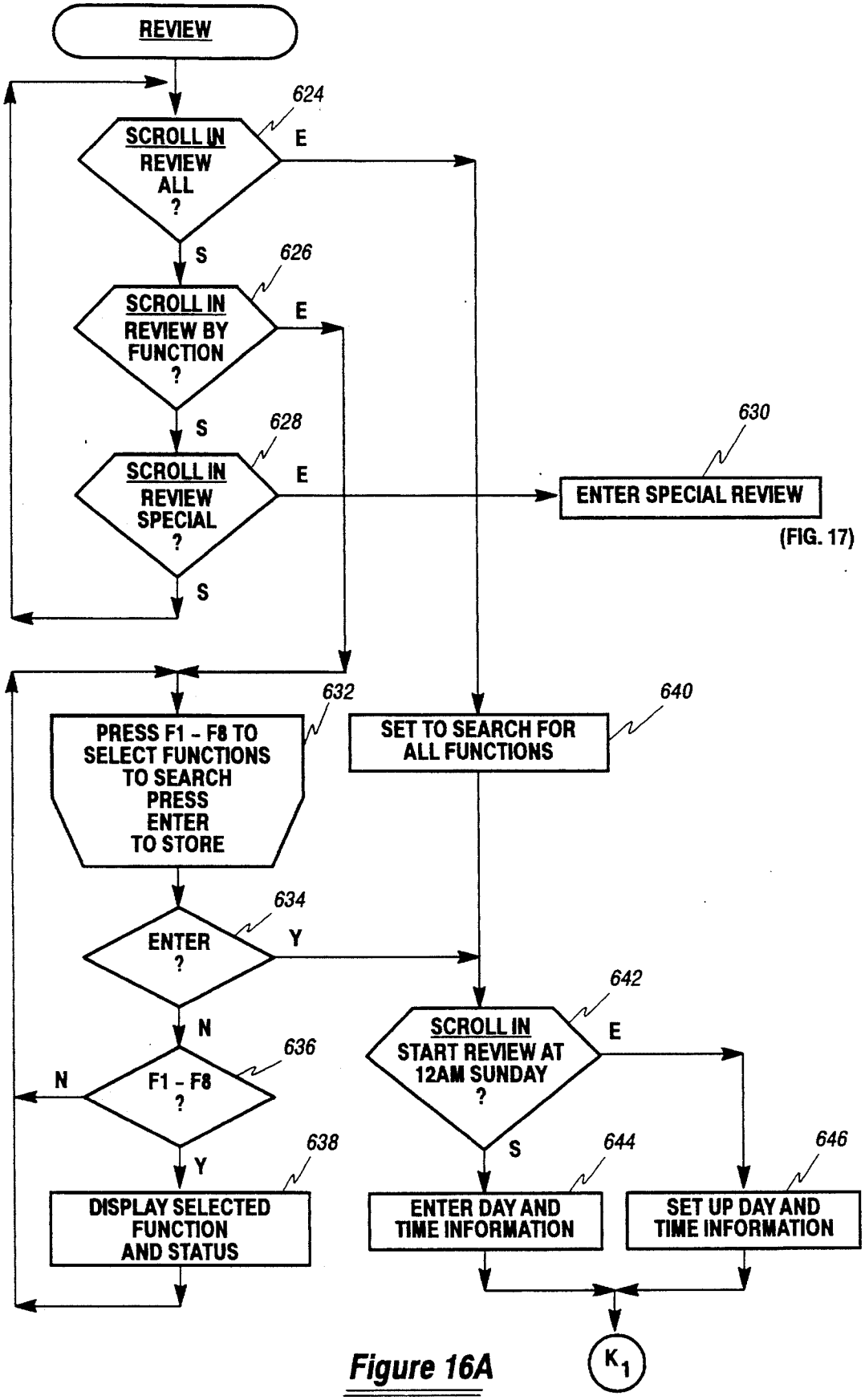
FIGS. 16A–16C are a flowchart of a program corresponding to the REVIEW block of FIG. 5B.
Figure 16B:
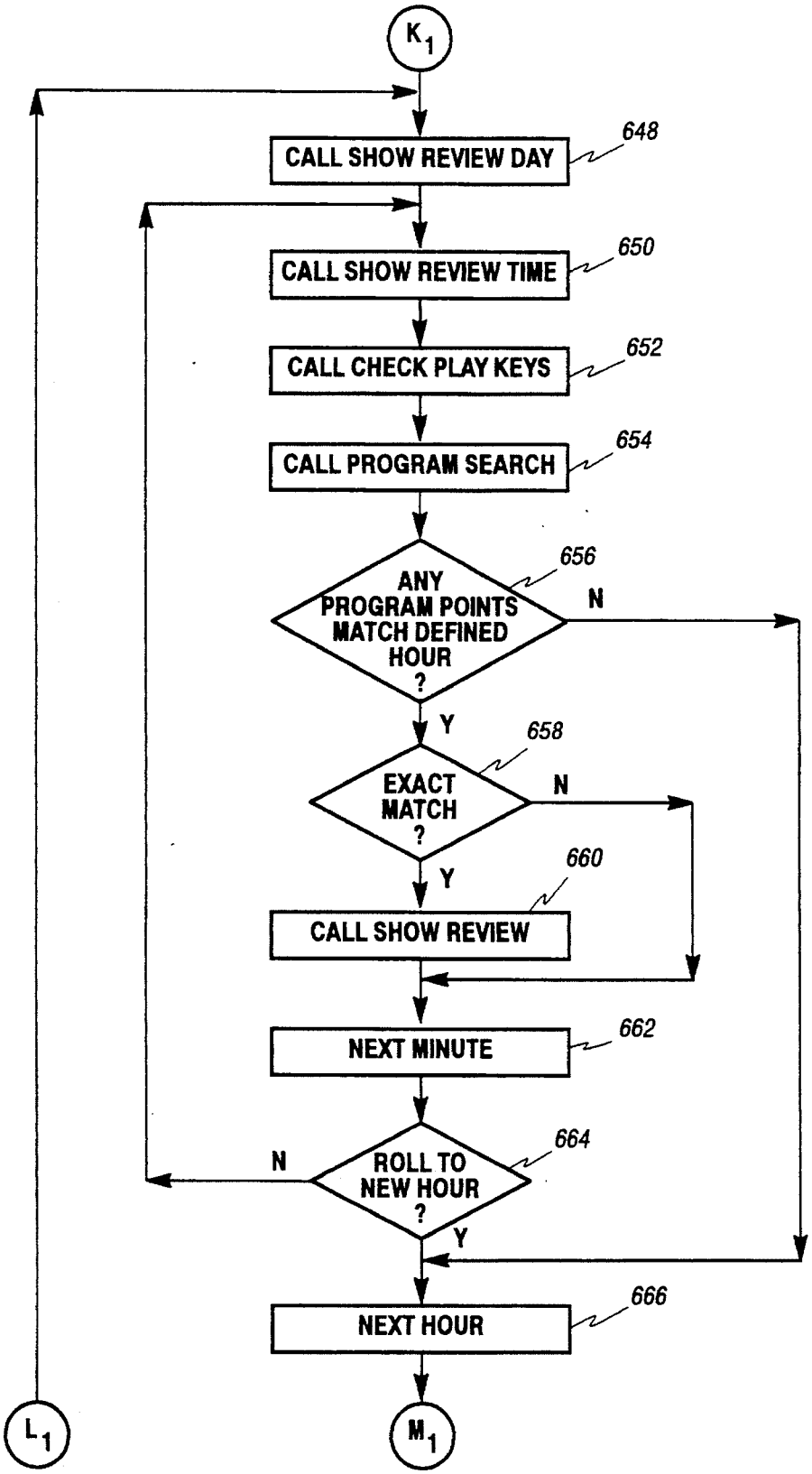
Figure 16C:
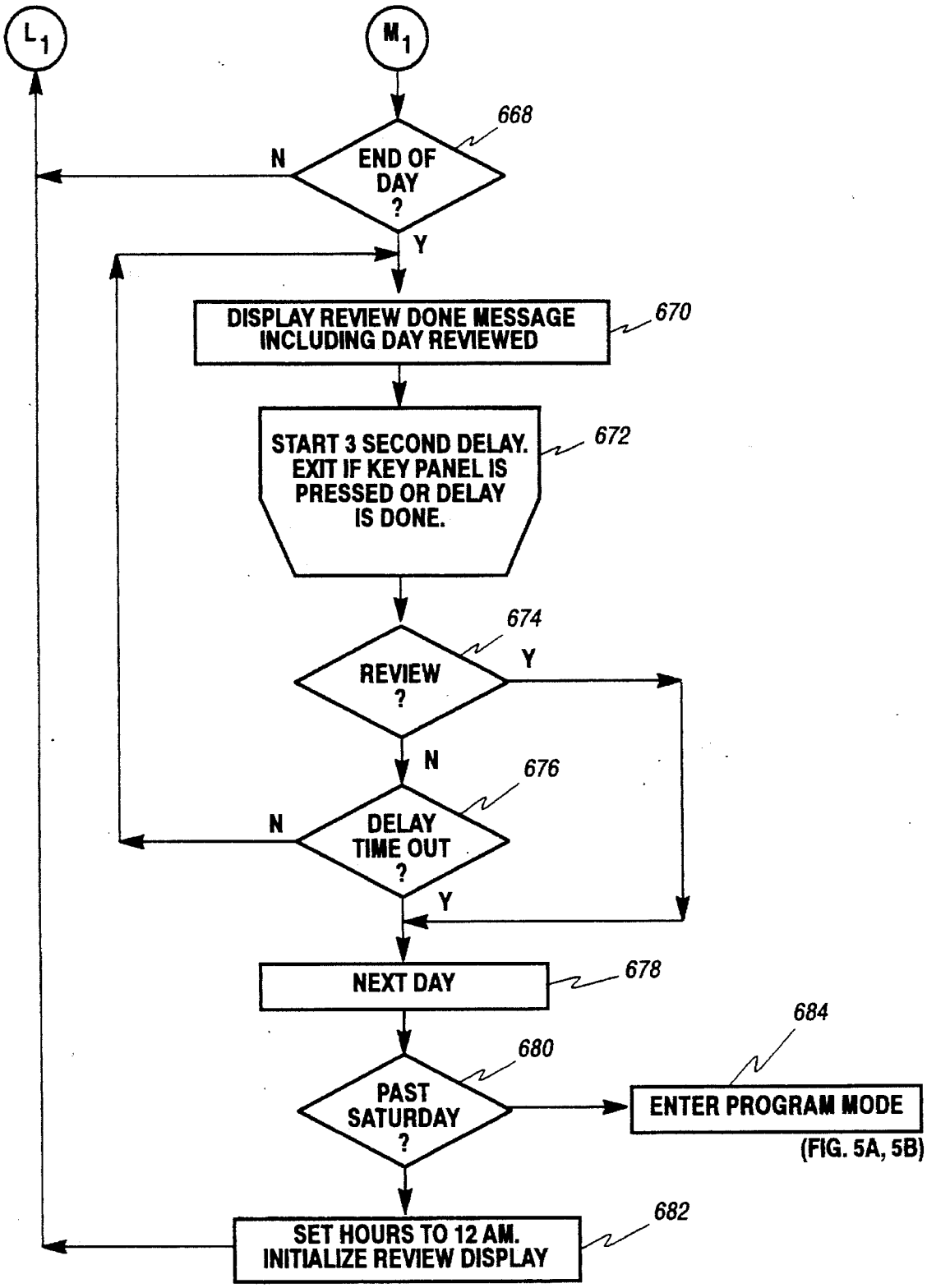

FIGS. 16A through 16C depict the REVIEW routine referred to in block 158 of FIG. 5B. Upon entering this routine, at block 624, the ScrollIn macro is executed with the message "REVIEW ALL?". If the users presses the "ENTER" key at this point the program branches to block 640 and is set to search for all functions. If, the user scrolls through the "REVIEW ALL? "message, the ScrollIn macro is executed at block 626 with the message "REVIEW BY FUNCTION?". If the user presses the "ENTER" key at this point the routine branches to input block 632; however, if the user presses the "SCROLL" key the ScrollIn macro is executed at block 628 with the message "REVIEW SPECIALS?". At this point, the routine branches to block 630 and enters the SpecialReview routine, which is described below with reference to FIG. 17, if the user presses the "ENTER" key. At input block 632, the user is prompted to either press function keys F1 through F8, to select a desired function to search, or to press the "ENTER" key to store selected data. At decision block 634, a determination is made of whether the "ENTER" key has been pressed. If so, the routine branches to block 642. If not, the program determines at decision blocks 636 whether any of the function keys F1 through F8 have been pressed. If no function keys have been pressed, the routine branches back to block 632; however, if one of the function keys has been pressed, the routine at block 638 displays the selected function and its status. At block 642, the ScrollIn macro is executed with the message "Start review at 12:00 A.M. Sunday?." If the user presses the "ENTER" key, the day and time information is set up at block 646. If the user presses the "SCROLL" key, the day and time information is entered at block 644.

Referring to FIG. 16B, a ShowReviewDaY routine is executed at block 648. At block 650 a ShowReview Time routine is executed. At block 652 a CheckPlayKeys routine is executed. At block 654 a ProgramSearch routine is executed. At decision block 656, a determination is made of whether any PROGRAM POINTS match the DEFINED HOUR data. If not, the routine branches to block 666. If a match is found, a determination is made at decision block 658 whether an exact match has been found. If not, the routine branches to block 662; if so, the routine calls a ShowReview routine at block 660. At block 662, data for the next minute is retrieved.

At decision block 664, a judgment is made of whether to roll to the new hour. If not, the REVIEW branches back to block 650. If so, the routine at block 666 retrieves the next hour data and proceeds to decision block 668 (FIG. 16C) to determine whether the end of day has been reached. If not, the REVIEW routine branches back to block 648 (FIG. 16B). If the end of day has been reached, the REVIEW routine at block 670 displays the message "ReviewDone" along with an indication of the day reviewed. At input block 672, the REVIEW routine initiates a three-seconds delay, but exits this delay before three seconds if the keypanel is pressed. At decision block 674, a test is made of whether the user desires a review. If not, a test is made at decision block 676 of whether the delay timeout period has elapsed; if it has, the REVIEW routine branches back to block 670. If a review is desired, the REVIEW routine branches to block 678 and retrieves the next day's data. At decision block 680, a test is made of whether Saturday has passed. If it has, the PROGRAM MODE routine is entered at block 684. If Saturday has not passed, at block 682 the HOURS data is set to 12 A.M. and the review display is initialized. Following block 682, the REVIEW routine branches back to block 648 (see FIG. 16B).

Figure 17:
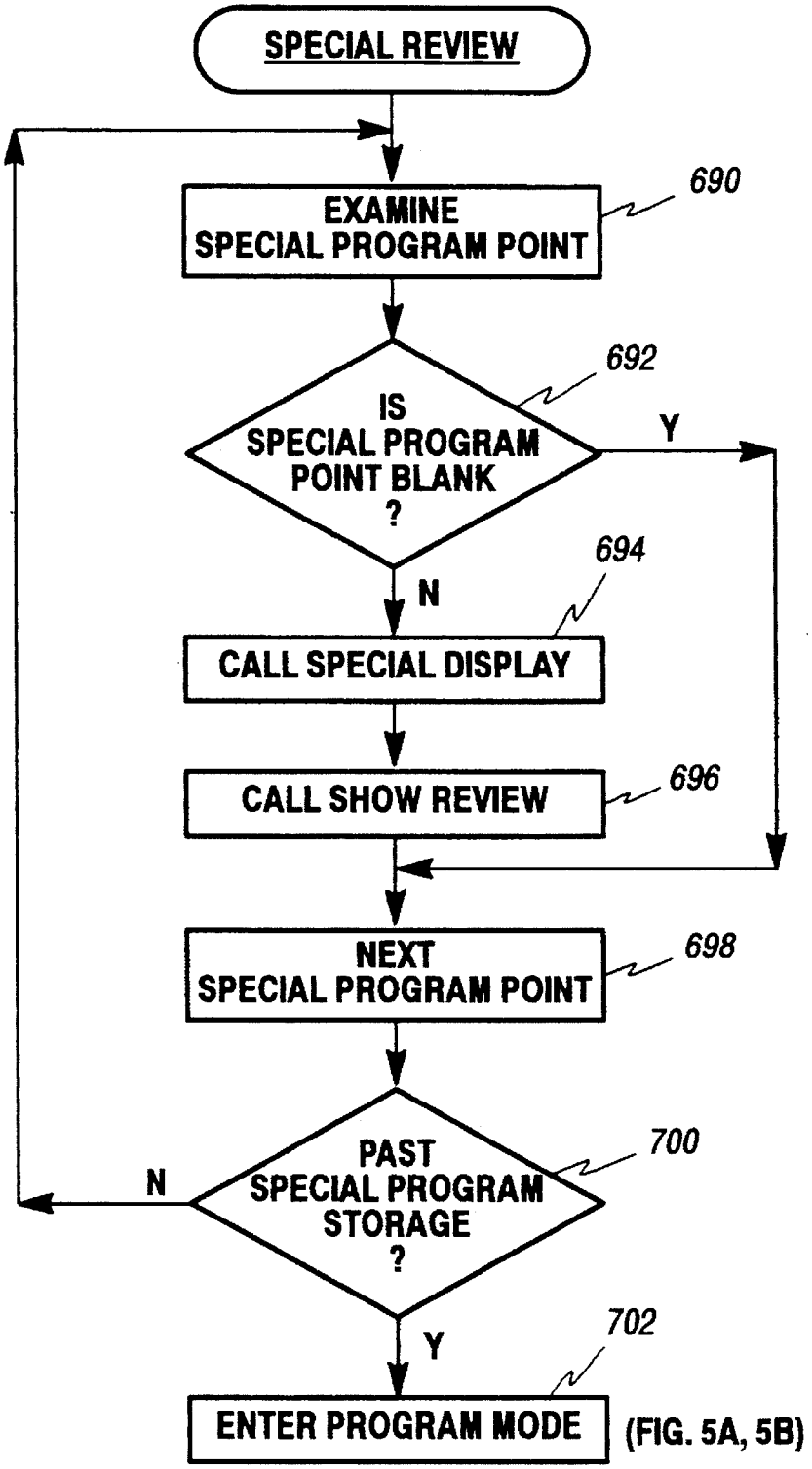
FIG. 17 is a flowchart of a program corresponding to the SPECIAL REVIEW block of FIG. 16A.

FIG. 17 depicts the SPECIAL REVIEW routine referred to in block 630 of FIG. 16A. First, the SPECIAL PROGRAM POINT data is examined at block 690. Next, at decision block 692 a determination is made of whether the SPECIAL PROGRAM POINT data is blank; if it is blank, the routine branches to block 698; if it is not blank, the SpecialDisplay routine is executed at block 694. At block 696, the ShowReview routine is executed. At block 698, the next PROGRAM POINT is retrieved. At decision block 700, a test is made of whether the SPECIAL PROGRAM storage area has been passed; if not, the SPECIAL REVIEW routine branches back to block 690; if so, at block 702 the SPECIAL REVIEW routine enters the PROGRAM MODE routine.

FIG. 18 is a flowchart of the SPRING and FALL routines respectively referred to in blocks 162 and 166 of FIG. 5B. Upon entering the SPRING routine, the ScrollIn macro is executed with the message "ENABLE FALL TIME CHANGE?"; if the user presses the "ENTER" key, the FALL routine at block 714 sets up a negative one (−1) hour time change, then at block 716 displays the message "FALL TIME CHANGE ENABLED" and at block 718 enables a time change indicator. If, at block 710, the user scrolls past the "ENABLE FALL TIME CHANGE?" message, the ScrollIn macro is executed at block 712 with the message "DISABLE TIME CHANGE?"; if the user presses the "ENTER" key, the routine branches to block 720 and clears the time change setup, then at block 722 displays the message "TIME CHANGE DISABLED." At block 724, the time change indicator is disabled. At block 734, the FALL routine delays for two seconds, and then at block 736 returns the sequencer to the PROGRAM MODE routine.

Upon entering the SPRING routine, the ScrollIn macro is executed at block 726 with the message "ENABLE SPRING TIME CHANGE?"; if the user presses the "ENTER" key, the routine at block 730 is set up for a positive one (+1) hour time change. At block 732, the message "SPRING TIME CHANGE ENABLED" is displayed. The SPRING routine then proceeds to the previously-described blocks 718, 734 and 736. If, at block 726, the user scrolled past the "ENABLE SPRING TIME CHANGE?" message, the ScrollIn macro is executed at block 728 with the message "DISABLE TIME CHANGE?"; if the user presses the "SCROLL" key at this point, the SPRING routine branches back to block 726; however if the user presses the "ENTER" key, the routine proceeds as described above to blocks 720, 722,724, 734 and 736.

Figure 19:
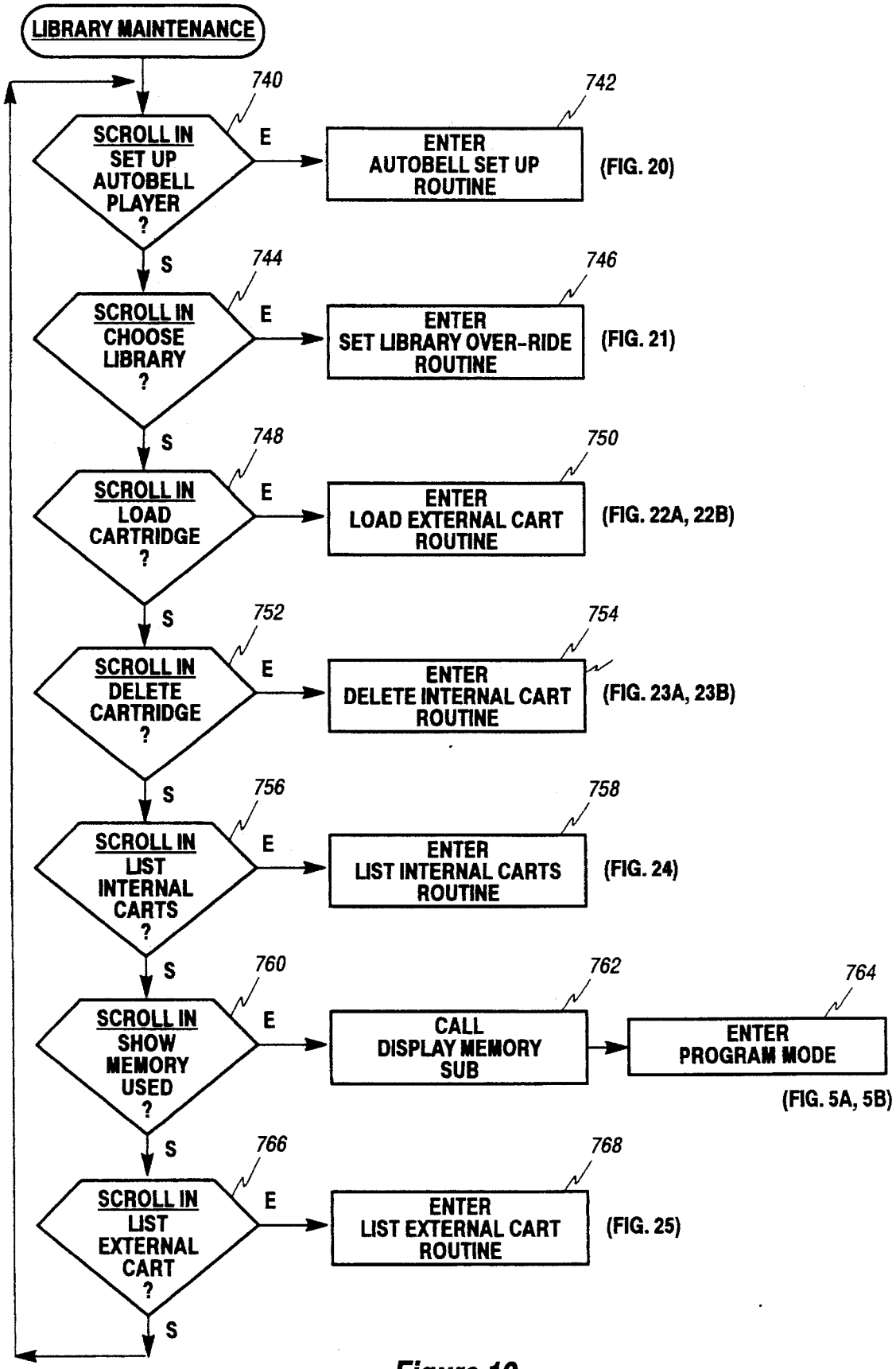
FIG. 19 is a flowchart of a program corresponding to the LIBRARY MAINTENANCE block of FIG. 5B.

FIG. 19 depicts the LIBRARY MAINTENANCE routine referred to in block 174 of FIG. 5B. Upon entering this routine, the ScrollIn macro is executed at block 740 with the message "SET UP AUTOBELL PLAYER?". If the user presses the "ENTER" key, an AUTOBELL SETUP routine is executed at block 742. The AUTOBELL SETUP routine is described below with reference to FIG. 20. At block 744, the ScrollIn macro is executed with the message "CHOOSE LIBRARY?". If the user presses the "ENTER" key, a SET LIBRARY OVER-RIDE routine is executed at block 746. This routine is described below with reference to FIG. 21. At block 748, the ScrollIn macro is executed with the message "LOAD CARTRIDGE?". If the user at this point presses the "ENTER" key, a LOAD EXTERNAL CART routine is executed. This routine is described below with reference to FIGS. 22A and 22B. At block 752 the ScrollIn macro is executed with the message "DELETE CARTRIDGE?". If the user presses the "ENTER" key, at block 754 a DELETE INTERNAL CART routine is executed. This routine is described below with reference to FIGS. 23A and 23B. At block 756, the ScrollIn macro is executed with the message "LIST INTERNAL CARTS?". If the user presses the "ENTER" key at this point, a LIST INTERNAL CARTS routine is executed at block 758. This routine is described below With reference to FIG. 24. At block 760, the ScrollIn macro is executed with the message "SHOW MEMORY USED?". If the user presses the "ENTER" key here, a DISPLAY MEMORY subroutine is called at block 762 and, after that subroutine is finished being executed, the system is returned to the PROGRAM MODE routine at block 764. At block 766, the ScrollIn macro is executed with the message "LIST EXTERNAL CART?". If the user presses the "ENTER" key at this point, a LIST EXTERNAL CART routine is executed at block 768. This routine is described below with reference to FIG. 25. Finally, if the user scrolls through all of the ScrollIn macro messages, the LIBRARY MAINTENANCE routine branches back to block 740 and repeats itself.

Figure 20:
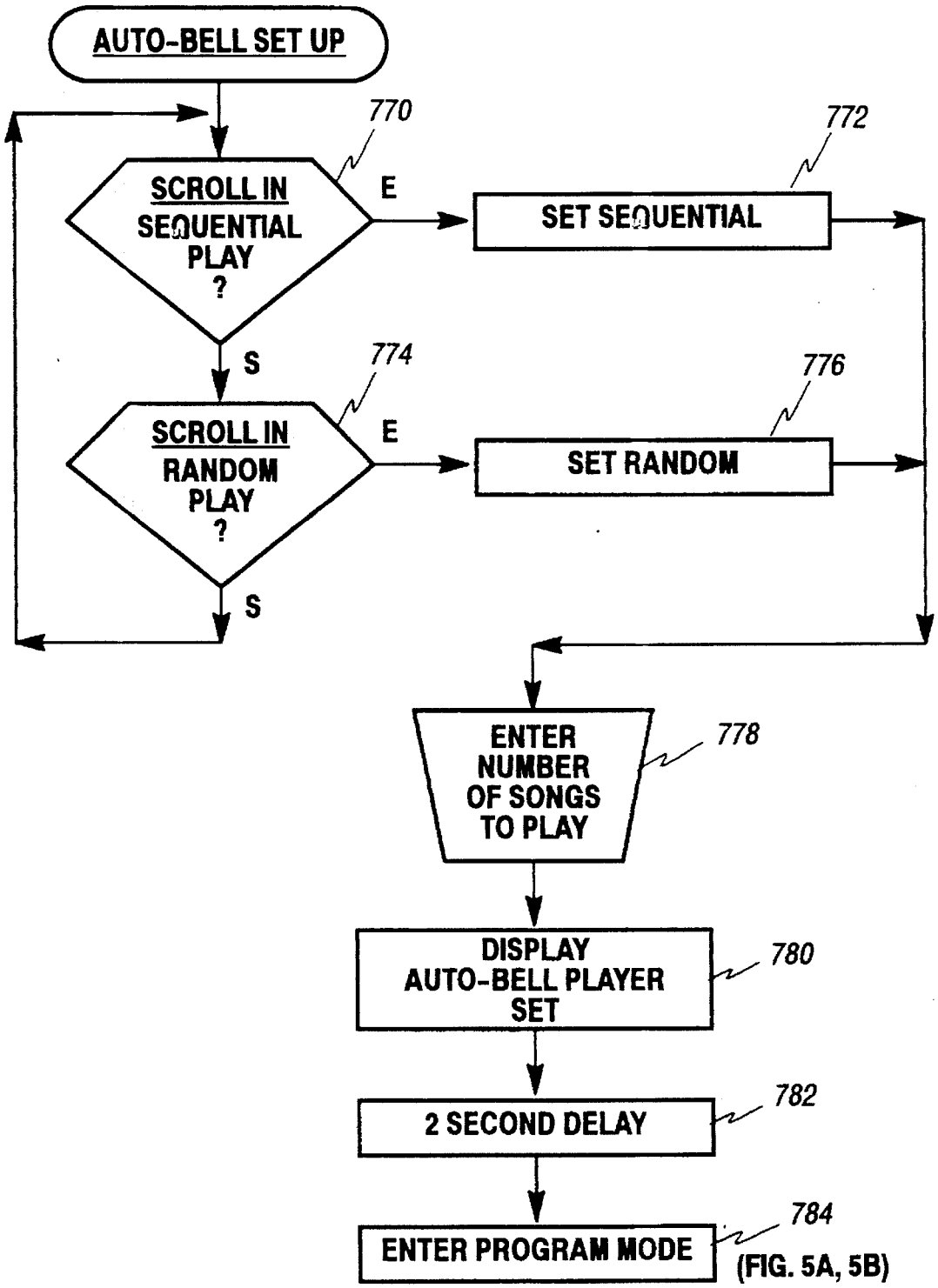
FIG. 20 is a flowchart of a program corresponding to the AUTOBELL SETUP block of FIG. 19.

FIG. 20 depicts the AUTOBELL SETUP routine referred to in block 742 of FIG. 19. Upon entering this routine, the ScrollIn macro is executed at block 770 with the message "SEQUENTIAL PLAY?". If the user at this point presses the "ENTER" key, a SEQUENTIAL flag is set at block 772 and the routine branches to block 778. If the user scrolls through the "SEQUENTIAL PLAY?" message, the ScrollIn macro is executed at block 774 with the message "RANDOM PLAY?". If at this point the user presses the "ENTER" key, the AUTOBELL SETUP routine sets a RANDOM flag at block 776 and then proceeds to input block 778. At input block 778, the user is prompted to enter the number of songs to play. At block 780, the message "AUTOBELL PLAYER SET" is displayed. At block 782, the system delays for two seconds. At block 784, the PROGRAM MODE routine is entered.

Figure 21:
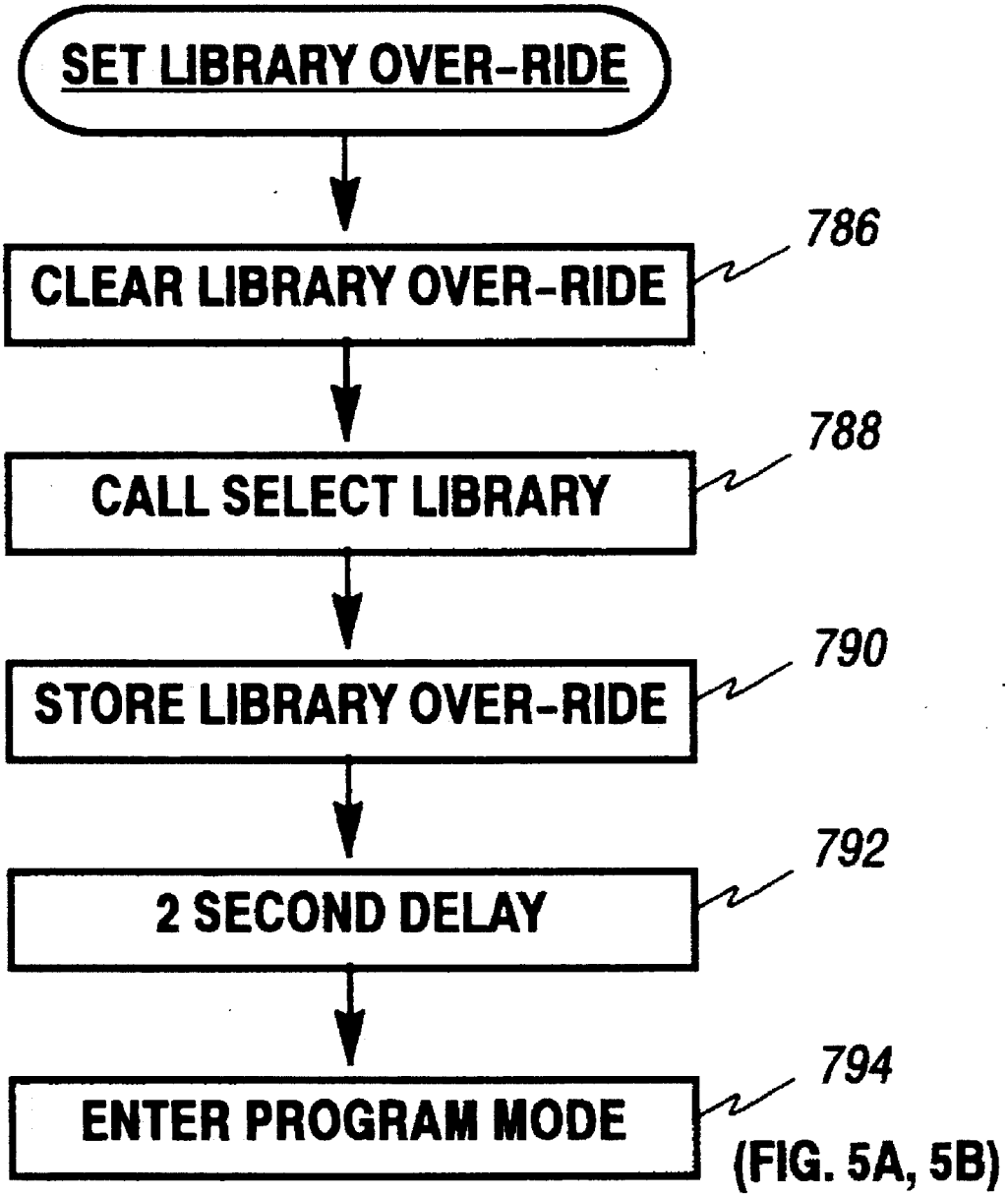
FIG. 21 is a flowchart of a program corresponding to the SET LIBRARY OVERRIDE block of FIG. 19.

FIG. 21 depicts the SET LIBRARY OVER-RIDE routine referred to in block 746 of FIG. 19. Upon entering this routine, the LIBRARY OVER-RIDE data is cleared at block 786. At block 788, a SELECT LIBRARY routine is called. At block 790, the new LIBRARY OVER-RIDE data is stored. At block 792, a two second delay is implemented. At block 794, the system is returned to the PROGRAM MODE routine.

Figure 22A:
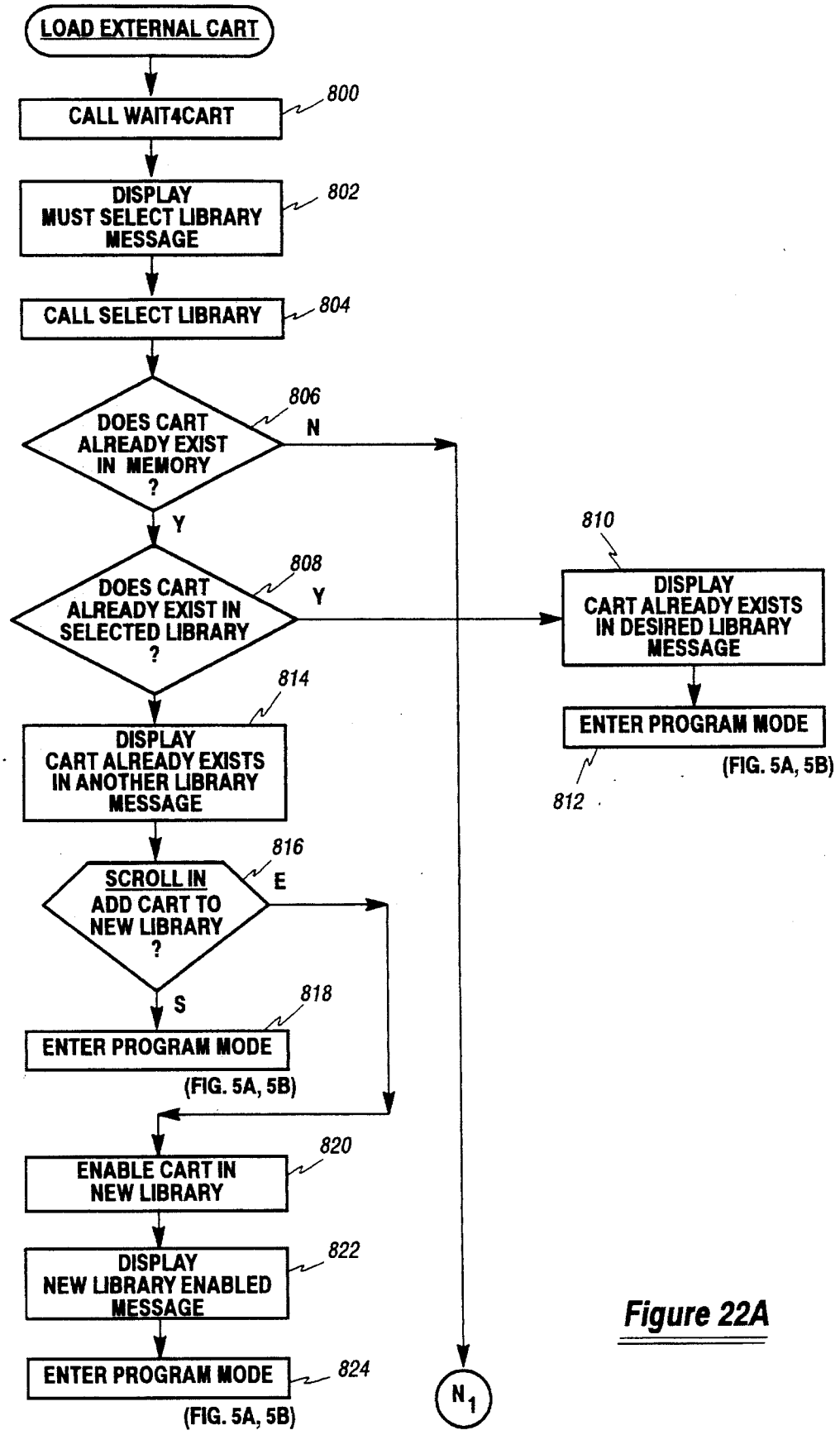
FIGS. 22A and 22B are a flowchart of a program corresponding to the LOAD EXTERNAL CART block of FIG. 19.
Figure 22B:
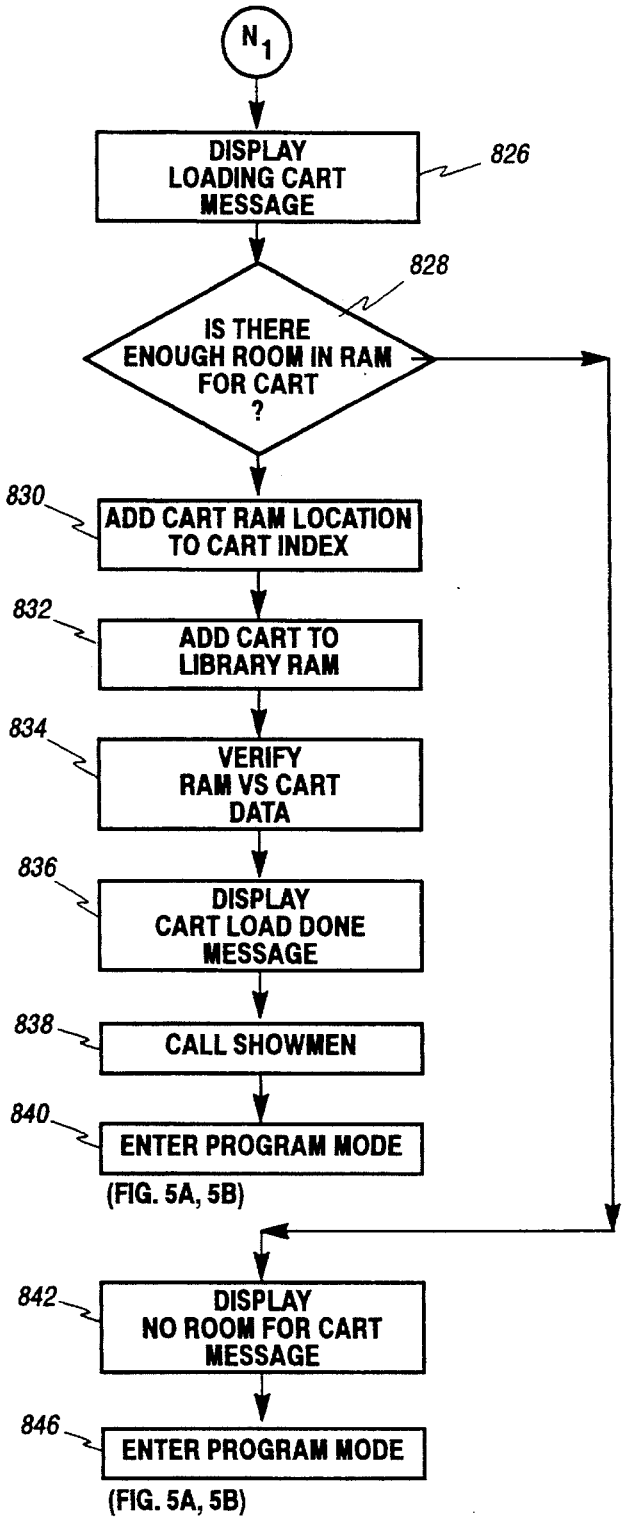

FIGS. 22A and 22B depict the LOAD EXTERNAL CART routine referred to in block 758 of FIG. 19. Upon entering this routine, a WAIT4CART routine is executed at block 800. At block 802, the message "MUST SELECT LIBRARY" is displayed. At block 804, the SELECT LIBRARY routine is called. At decision block 806, a determination is made of whether the "cart" already exists in memory. If the cart does not exist, the routine branches to block 826 (FIG. 22B); if the cart does exist, the message "CART ALREADY EXISTS IN ANOTHER LIBRARY" is displayed at block 814. At block 816, the ScrollIn macro is executed with the message "ADD CART TO NEW LIBRARY?". If the user presses the "ENTER" key at this point, the LOAD EXTERNAL CART routine will branch to block 820 and enable the cart in the new library. If at block 816 the user scrolls past the "ADD CART TO NEW LIBRARY?" message, the system at block 818 will branch to the PROGRAM MODE routine. Following block 820, the message "NEW LIBRARY ENABLED" is displayed at block 822. At block 824, the system branches to the PROGRAM MODE routine. If at decision block 808 it is determined that the cart already exists in the selected library, the program branches to block 810 and displays the message "CART ALREADY EXISTS IN DESIRED LIBRARY." The system then branches to the PROGRAM MODE routine at block 812.

Referring to FIG. 22B, at block 826 the message "LOADING CART" is displayed. At decision block 828, a test is made of whether there is room in RAM for the cart. At block 830, the cart RAM location is added to a CART INDEX. At block 832, the cart is added to the library RAM. At block 834, the routine verifies the RAM/cart data. At block 836, the message "CART LOAD DONE" is displayed. At block 838 a SHOWMEM (show memory) routine is called. At block 840, the system branches to the PROGRAM MODE routine. If at block 828 it is determined that there is not enough room in RAM for the cart, the LOAD EXTERNAL CART routine branches to block 842 and displays the message "NO ROOM FOR CART." At block 846, the system branches to the PROGRAM MODE routine.

Figure 23A:
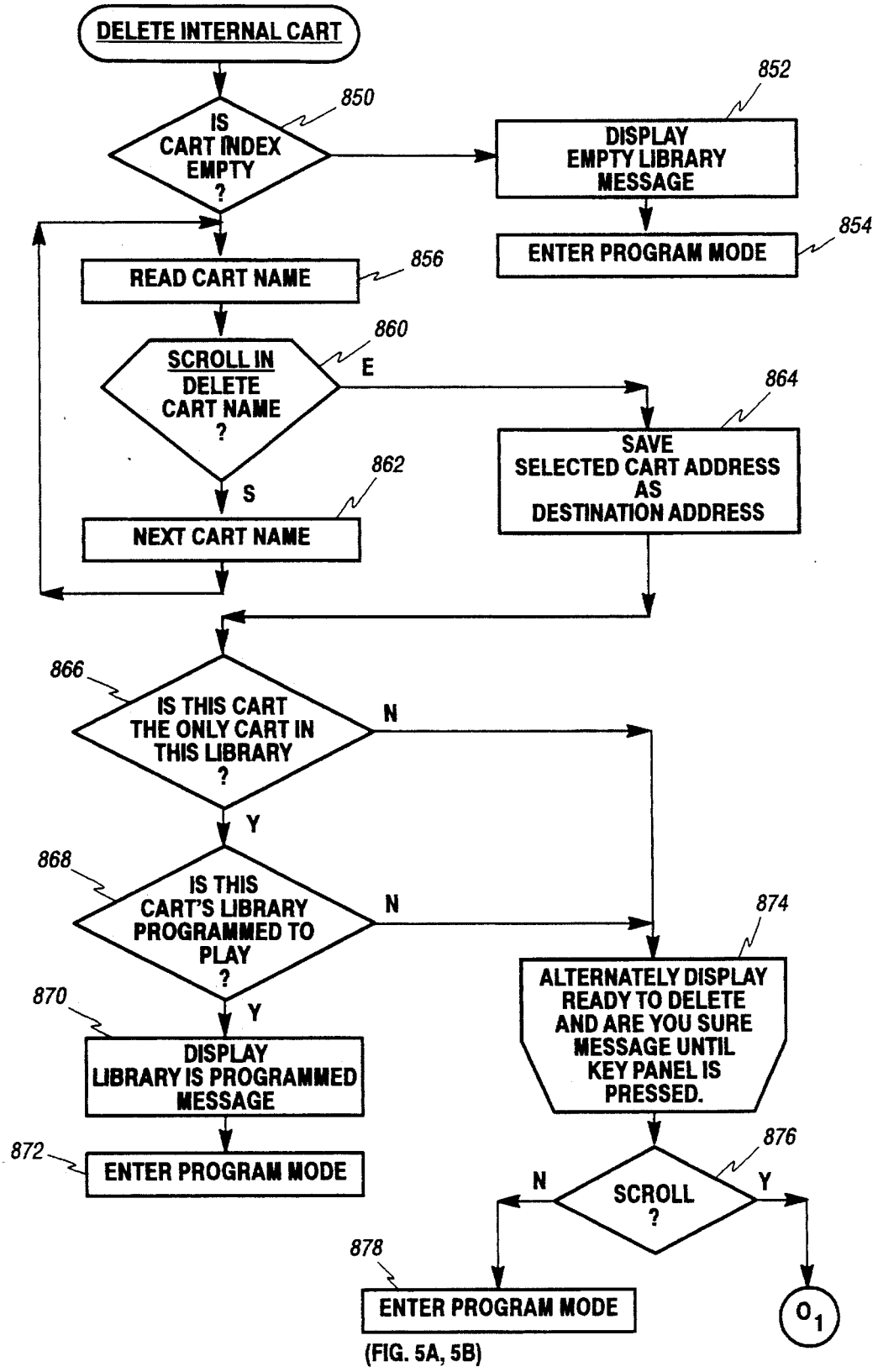
FIGS. 23A and 23B are a flowchart of a program corresponding to the DELETE INTERNAL CART block of FIG. 19.
Figure 23B:
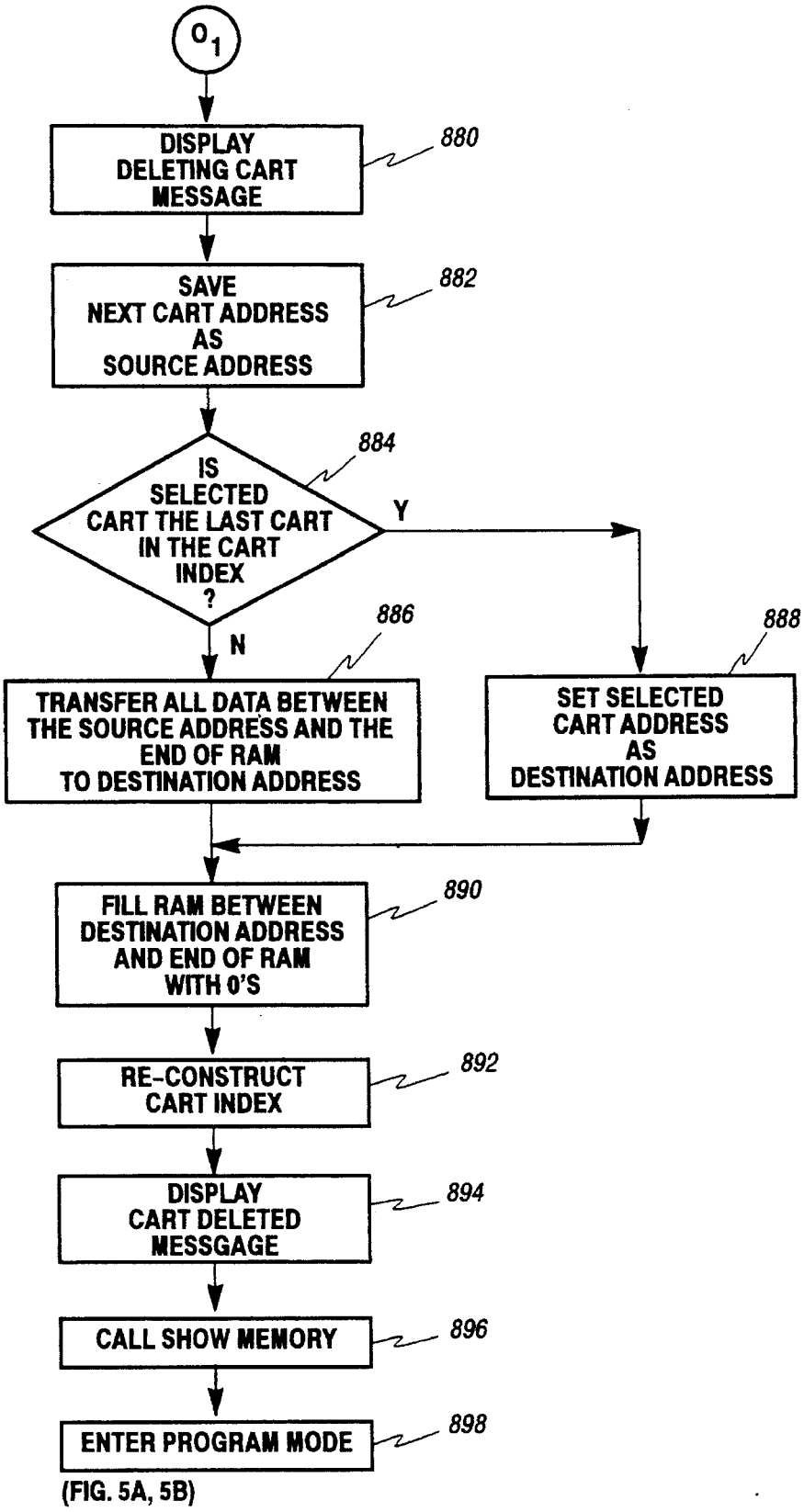

FIGS. 23A and 23B depict the DELETE INTERNAL CART routine referred to in block 754 of FIG. 19. Upon entering this routine, the system at decision block 850 determines whether the CART INDEX is empty. If the CART INDEX is empty, the message "EMPTY LIBRARY" is displayed at block 852 and at block 854 the system branches to the PROGRAM MODE routine. If the cart index is not empty, the cart name is read at block 856. At block 860, the ScrollIn macro is executed with the message "DELETE CART NAME?". If the user presses the "ENTER" key, the routine at block 864 saves the selected cart address as the "DESTINATION ADDRESS". If at block 860 the user scrolls past the "DELETE CART NAME?" message, the next cart name is retrieved at block 862 and the routine branches back to block 856. Following block 864, the routine at decision block 866 determines whether or not the selected cart is the only cart in the selected library. If it is, at block 868 a determination is made of whether the selected cart's library is programmed to play. If the selected cart's library is programmed to play, the message "LIBRARY IS PROGRAMMED" is displayed at block 870. At block 872, the system branches to the PROGRAM MODE routine. The negative branches of decision blocks 866 and 868 lead to input block 874. At this block, the messages "READY TO DELETE" and "ARE YOU SURE?" are alternately displayed until the keypanel is pressed. Next, at decision block 876, a test is made of whether the "SCROLL" key was pressed. If not, at block 878 the system branches to the PROGRAM MODE routine. If the "SCROLL" key was pressed, the DELETE INTERNAL CART routine branches to block 880 (FIG. 23B) and displays the message "DELETING CART."

Referring to FIG. 23B, at block 882 the NEXT CART ADDRESS is saved as the SOURCE ADDRESS. At decision block 884, a determination is made of whether the selected cart is the last cart in the cart index. If so, at block 888 the selected cart address is set as the DESTINATION ADDRESS. If not, at block 886 all of the data between the SOURCE ADDRESS and the end of RAM is transferred to the DESTINATION ADDRESS. At block 890, the RAM is filled with zeros between the DESTINATION ADDRESS and the end of RAM. At block 892, the cart index is reconstructed. At block 894, the message "CART DELETED" is displayed. At block 896, the SHOW MEMORY routine is called. At block 898, the system branches to the PROGRAM MODE routine.

Figure 24:
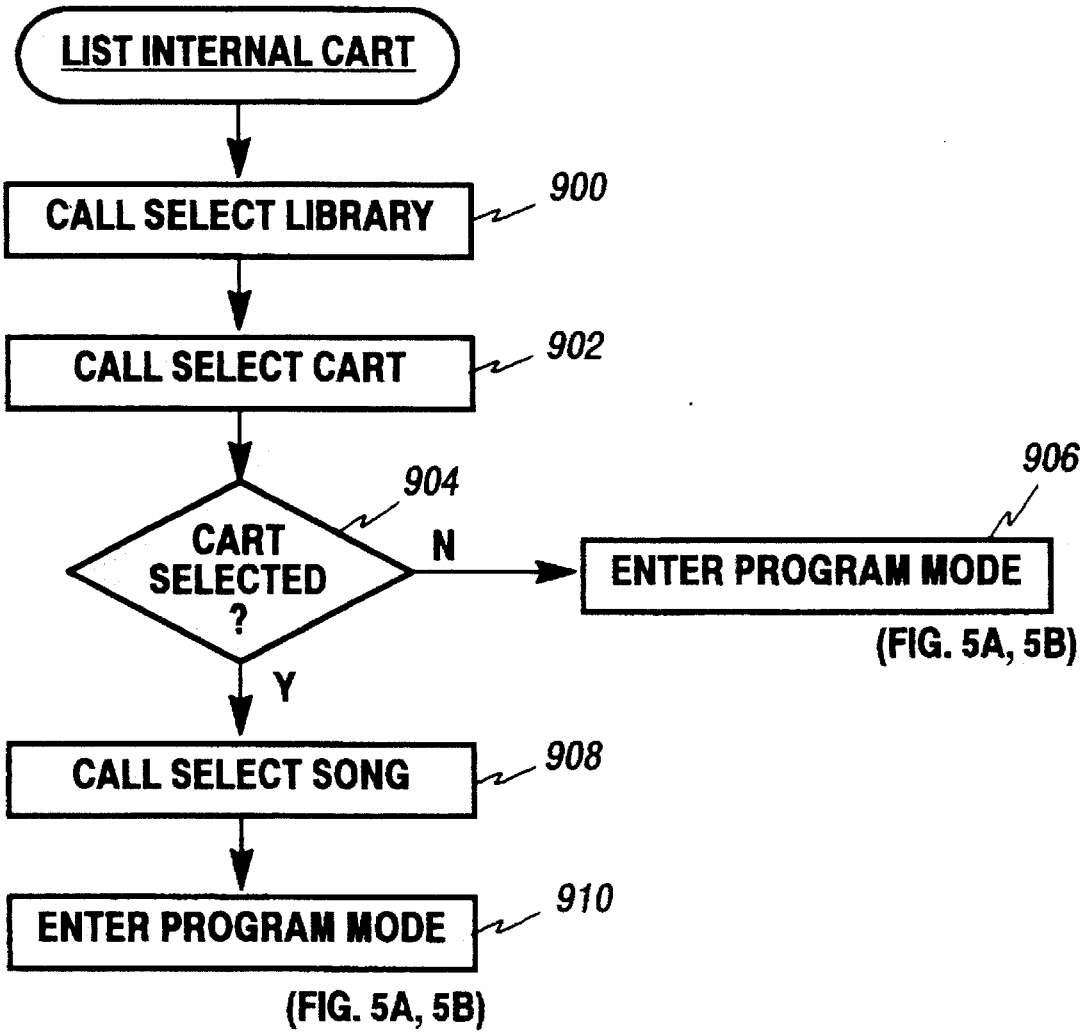
FIG. 24 is a flowchart of a program corresponding to the LIST INTERNAL CARTS block of FIG. 19.

FIG. 24 depicts the LIST INTERNAL CART routine referred to in block 768 of FIG. 17. Upon entering this routine, the SELECT LIBRARY routine is called at block 900. At block 902, the SELECT CART routine is called. At decision block 904, a determination is made of whether a cart has been selected. If not, the system branches to the PROGRAM MODE routine at block 906. At block 908, a SELECT SONG routine is called. At block 910, the system branches to the PROGRAM MODE routine.

Figure 25:
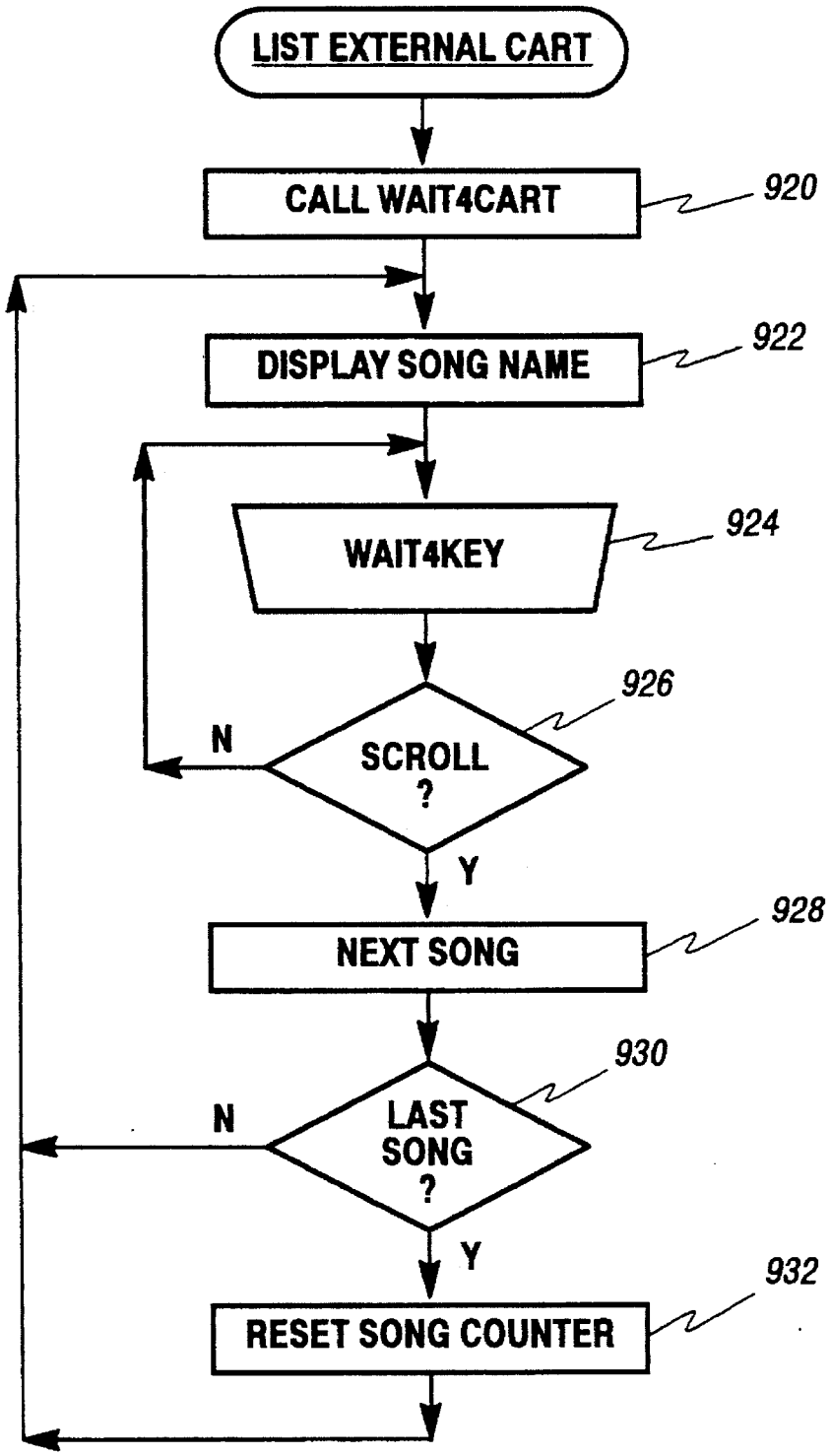
FIG. 25 is a flowchart of a program corresponding to the LIST EXTERNAL CART block of FIG. 19.

FIG. 25 depicts the LIST EXTERNAL CART routine referred to in block 768 of FIG. 19. Upon entering this routine, at block 920 the WAIT4CART routine is called. At block 922 the song name is displayed. At input block 924, the Wait4Key routine is executed. At decision block 926, a determination is made of whether the "SCROLL" key has been pressed. When this key is pressed, the data for the next song is retrieved at block 928. At decision block 930, a determination is made of whether this song is the last song. If not, the LIST EXTERNAL CART routine branches back to block 922. If so, at block 930 the song counter is re-set and the routine branches back to block 922.

Figure 26:
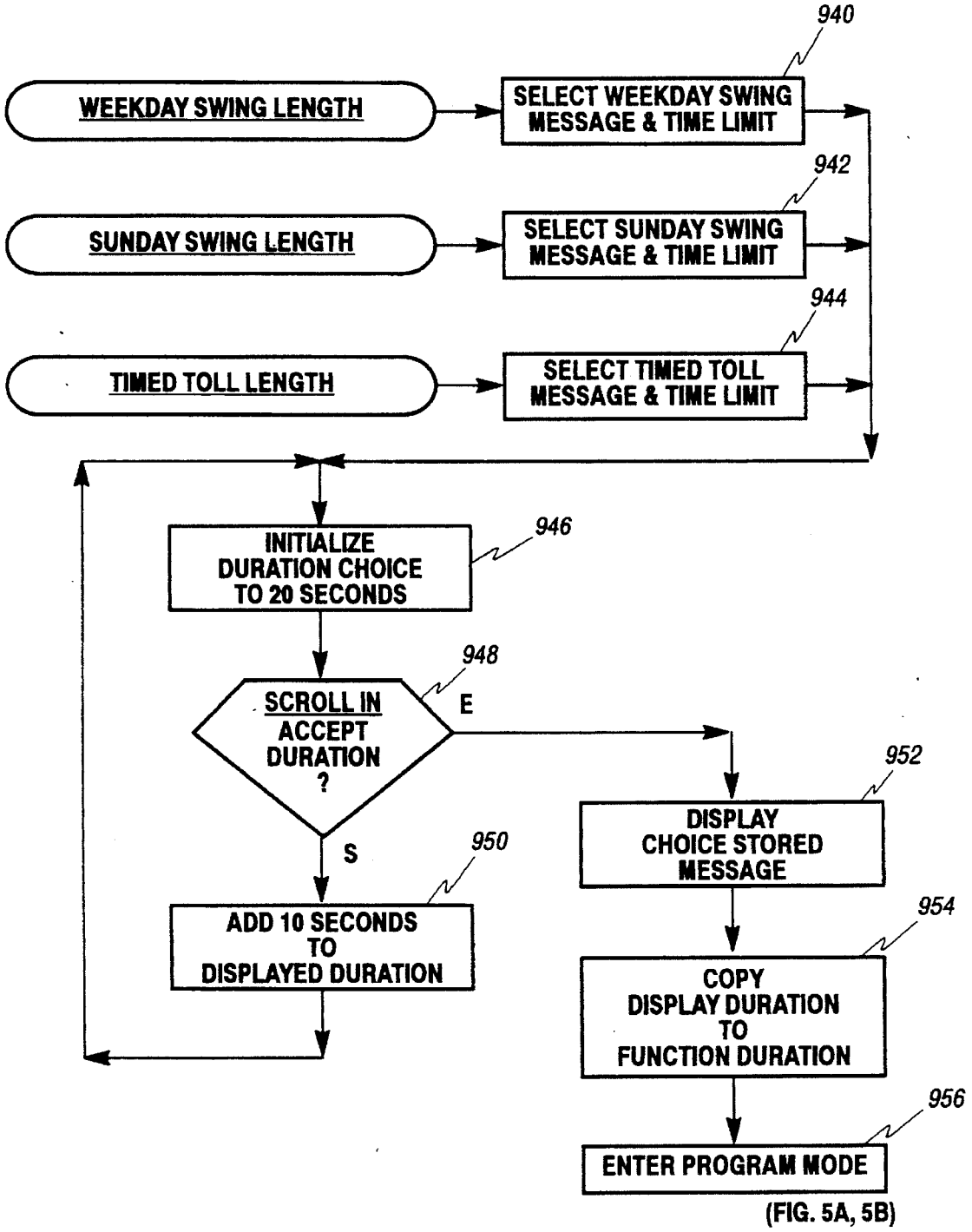
FIG. 26 is a flowchart of a program corresponding to the WEEKDAY SWING LENGTH, SUNDAY SWING LENGTH and TIMED TOLL LENGTH blocks of FIG. 5B.

FIG. 26 depicts the WeekdaySwingLength, SundaySwingLength, and TimedTollLength routines respectively referred in blocks 182,186 and 190 of FIG. 5B. Upon entering the WeekdaySwingLength routine, a weekday swing message and time limit are selected at block 940. Similarly, upon entering the SundaySwingLength routine a Sunday swing message and time limit are selected at block 942, and upon entering the TimedTollLength routine a timed toll message and time limit are selected at block 944. Next, at block 946 a DURATION CHOICE parameter is initialized to 20 seconds. Next, at block 948 the ScrollIn macro is executed with the message "ACCEPT DURATION?". If the user presses the "SCROLL" key at this point, ten seconds are added to the displayed duration at block 950 and the routine branches back to block 946. If at block 948 the user presses the "ENTER" key, the message "CHOICE STORED" is displayed at block 952. Next, at block 954 the displayed duration is copied to the function duration. Finally, the system branches to the PROGRAM MODE routine at block 956.

Figure 27:
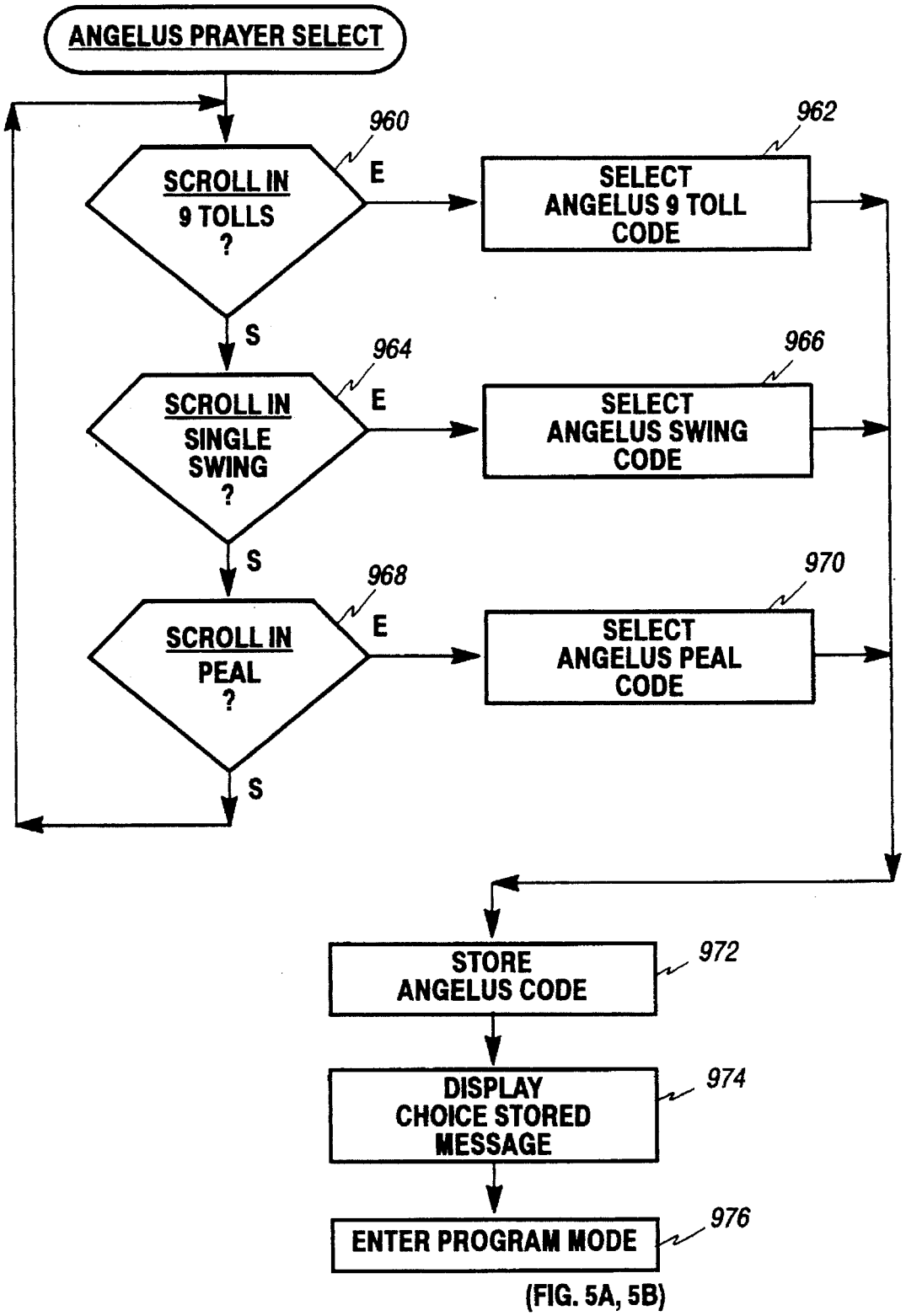
FIG. 27 is a flowchart of a program corresponding to the ANGELUS PRAYER SELECT block of FIG. 5B.

FIG. 27 depicts the ANGELUS PRAYER SELECT routine referred to in block 194 FIG. 5B. Upon entering this routine, the ScrollIn macro is executed at block 960 with the message "9 TOLLS?". If at this point the user presses the "ENTER" key, an ANGELUS 9 TOLL code is selected at block 962; this code is stored at block 972; the message "CHOICE STORED" is displayed at block 974, and at block 976 the system branches to the PROGRAM MODE routine. If at block 960 the user presses the "SCROLL" key, the ScrollIn macro is executed at block 964 with the message "SINGLE SWING?". If the user presses the "ENTER" key at this point, the ANGELUS SWING CODE is selected at block 966 and then the ANGELUS PRAYER SELECT routine branches to block 972. If at block 964 the user presses the "SCROLL" key, the ScrollIn macro is executed at block 968 with the message "PEAL?". If the user presses the "ENTER" key at this point, an ANGELUS PEAL CODE is selected at block 970 and the routine branches to block 972. If at block 968 the user presses the "SCROLL" key, the routine branches back to block 960.

In sum, one preferred embodiment of the present invention comprises: a sequencer module (10) programmed for receiving, storing and outputting timing data and sequence data representing a prescribed number of distinct bell strikes; a tone generator (12) for generating, in accordance with sequence and timing data, analog bell-strike signals; amplifiers (18, 20) for amplifying the bell-strike signals; and speakers (22, 24) for converting the bell-strike signals, after amplification, to audible bell sounds. The sequencer module comprises a clock for generating clock signals indicative of the time of day; program memory for memorizing user-defined program points representing intervals of time during which an event is to occur; music sequencer hardware and software for reading musical selections composed of predefined arrangements of the bell strikes from an electronic memory card and memorizing the selections; user-interface hardware and software for programmatically displaying information to and receiving information from a user, and review hardware and software for displaying previously-entered program points in response to inputs received via the user-interface.

It should be noted that the true scope of the present invention is not limited to the specific hardware and software elements described above, and thus many variations of the examples described above will fall within the scope of protection of the following claims. For example, as described above, the tone generator 12 may synthesize signals representing bell sounds. However, embodiments of the present invention may also employ sampling techniques whereby actual bell sounds are sampled and the sample data is used to reproduce the actual bell sounds. Other variations will be apparent to those skilled in the art after reading this specification.

What is claimed is:

1. An electronic carillon system, comprising sequencer means for programmatically receiving, storing and outputting timing data and sequence data representing a prescribed number of distinct bell strikes, each bell strike being composed of a unique combination of bell tones, said sequencer means comprising:

(a) program memory means for memorizing user-defined program points representing intervals of time during which an event is to occur;

(b) music sequencer means for reading musical selections from an electronic memory and memorizing said selections, said musical selections being composed of pre-defined arrangements of said bell strikes, said musical selections being represented by sequence and timing data identifying individual notes to be played and a time delay between successive notes;

(c) user-interface means for programmatically displaying information to and receiving information from a user; and (d) program code means for controlling the operation of said music sequencer means and user-interface means, said program code means controlling said music sequencer means in outputting sequence and timing data for a selected composition.

2. An electronic carillon system as described in claim 1, further comprising:

tone generator means (12) operatively connected to said sequencer means for generating, in accordance with said sequence and timing data, analog bell-strike signals representative of both individual bell strikes and/or a selected combination of bell strikes;

amplifier means (18, 20) for amplifying said bell-strike signals; and speaker means (22, 24) coupled to said amplifier means for converting said bell-strike signals, after amplification, to audible bell sounds.

3. An electronic carillon system as described in claim 2, further comprising volume control means for receiving volume control information from a user and outputting the same to said tone generator means.

4. An electronic carillon system as described in claim 1, further comprising lock switch means for selectively preventing said sequencer means from performing at least one pre-defined set of functions.

5. An electronic carillon system as described in claim 1, further comprising means for automatically generating, at selected intervals within a selected block of time during a prescribed set of days, a sequence of bell strikes indicative of the time of day followed by sequence and timing data representing a musical arrangement.

6. An electronic carillon system as described in claim 1, further comprising means for automatically generating, at selected intervals during a prescribed set of days, sequence and timing data representing the swinging of a selected combination of bells for a selected length of time.

7. An electronic carillon system as described in claim 1, further comprising means for automatically generating, at selected intervals during a prescribed day, sequence and timing data representing the swinging of a selected combination of bells for a selected length of time.

8. An electronic carillon system as described in claim 1, further comprising means for automatically generating, at selected intervals during a prescribed set of days, sequence and timing data representing the tolling of one selected bell for a selected length of time.

9. An electronic carillon system as described in claim 1, further comprising means for automatically generating sequence and timing data representing an Angelus followed by a selected prayer comprising one of: a pre-defined number of bell tolls, a single bell swing, and a multi-bell peal.

10. An electronic carillon system as described in claim 1, further comprising means for manually initiating the generation of sequence and timing data representing the tolling of a single bell a selected number of times and means for manually initiating the generation of sequence and timing data representing the tolling of a selected combination of bells until stopped by a user.

11. An electronic carillon system as described in claim 1, further comprising means for manually initiating the generation of sequence and timing data representing the swinging of a selected combination of bells until stopped by a user.

12. An electronic carillon system as described in claim 1, further comprising remote control means for displaying information to and receiving information from a user at a remote location.

13. An electronic carillon system as described in claim 1, further comprising:

tone generator means operatively connected to said sequencer means for generating, in accordance with said sequence and timing data, analog bell-strike signals representative of both individual bell strikes and/or a selected combination of bell strikes;

amplifier means for amplifying said bell-strike signals;

speaker means coupled to said amplifier means for converting said bell-strike signals, after amplification, to audible bell sounds;

volume control means for receiving volume control information from a user and outputting the same to said tone generator means; and lock switch means for selectively preventing said sequencer means from performing at least one pre-defined set of functions.

14. An electronic carillon system as described in claim 13, further comprising:

means for automatically generating, at selected intervals within a selected block of time during a prescribed set of days, a sequence of bell strikes indicative of the time of day followed by sequence and timing data representing a musical arrangement;

means for automatically generating, at selected intervals during a prescribed set of days, sequence and timing data representing the swinging of a selected combination of bells for a selected length of time;

means for automatically generating, at selected intervals during a prescribed day, sequence and timing data representing the swinging of a selected combination of bells for a selected length of time;

means for automatically generating, at selected intervals during a prescribed set of days, sequence and timing data representing the tolling of one selected bell for a selected length of time;

means for automatically generating sequence and timing data representing an Angelus followed by a selected prayer comprising one of: a pre-defined number of bell tolls, a single bell swing, and a multi-bell peal;

means for manually initiating the generation of sequence and timing data representing the tolling of a single bell a selected number of times and means for manually initiating the generation of sequence and timing data representing the tolling of a selected combination of bells until stopped by a user;

means for manually initiating the generation of sequence and timing data representing the swinging of a selected combination of bells until stopped by a user; and remote control means for displaying information to and receiving information from a user at a remote location.

15. An electronic carillon system as described in claim 1, further comprising means for generating, in accordance with said sequence and timing data and pre-recorded sample data, analog bell-strike signals representative of both individual bell strikes and/or a selected combination of bell strikes.

16. An electronic carillon system as described in claim 1, wherein said sequencer means comprises means for outputting timing and sequence data in accordance with the format:

$$0XXX,\ XXXX=NOTE=1\rightarrow126_{(dec)}=(01\rightarrow7E)_{hex}$$

$$1XXX,\ XXXX=DELAY\ BYTE-1\rightarrow127_{(dec)}=(01\rightarrow7F)_{(hex)}.$$

17. An electronic carillon system as described in claim 1, further comprising a tone generator operatively coupled to said sequencer means for outputting electrical signals representative of bell strikes in accordance with said sequence and timing data.

18. An electronic carillon system as described in claim 17, wherein said tone generator outputs electrical signals representative of synthesized bell strikes.

19. An electronic carillon system as described in claim 17, wherein said tone generator outputs electrical signals representative of reproduced bell strikes.

20. A method for operating an electronic carillon system, comprising the steps of:

(a) reading and memorizing program points representing intervals of time during which an event is to occur;

(b) reading a pre-recorded musical arrangement from a storage medium and memorizing said arrangement, said musical selection being represented by sequence and timing data identifying individual notes to be played and a time delay between successive notes; and (c) automatically generating, in accordance with previously-entered program points, sequence and timing data representing a selected composition of bell strikes indicative of the time of day followed by a musical arrangement.

21. The method recited in claim 20, further comprising the step of automatically generating, at selected intervals during a prescribed set of days, sequence and timing data representing the swinging of a selected combination of bells for a selected length of time.

22. The method recited in claim 20, further comprising the step of automatically generating, at selected intervals during a prescribed set of days, sequence and timing data representing the tolling of one selected bell for a selected length of time.

23. The method recited in claim 20, further comprising the step of automatically generating sequence and timing data representing an Angelus followed by a selected prayer comprising one of: a pre-defined number of bell tolls, a single bell swing, and a multi-bell peal.

* * * * *

UNITED STATES PATENT AND TRADEMARK OFFICE

CERTIFICATE OF CORRECTION

PATENT NO. : 5,471,006

DATED : November 28, 1995

INVENTOR(S) : Gregory L. Schwartz et al

It is certified that error appears in the above-indentified patent and that said Letters Patent is hereby corrected as shown below:

Col. 5 and 6, line 7, "3a3 [02] = ENGUSH BELL UPPER STOP" should be --3a3 [02] = --ENGLISH BELL UPPER STOP--.

Col. 5 and 6, line 15, "3b3 [02] = ENGUSH BELL LOWER STOP" should be --3b3 [02] = --ENGLISH BELL LOWER STOP--.

Col. 19, line 20, between "722,724" there should be a space.

Col. 19, line 45, the word "With" does not start the sentence, so it should be lower case --with--.

Signed and Sealed this

Twenty-first Day of January, 1997

*Attest:*

Bruce Lehman

BRUCE LEHMAN

*Attesting Officer*

*Commissioner of Patents and Trademarks*